US011273971B1

(12) United States Patent
Jessop

(10) Patent No.: US 11,273,971 B1
(45) Date of Patent: Mar. 15, 2022

(54) ENHANCEMENTS OF THE FOOD COOKING CAPABILITIES OF FOOD CONTAINERS TO BE USED IN A MICROWAVE OVEN

(71) Applicant: Richard Vernon Jessop, Cali (CO)

(72) Inventor: Richard Vernon Jessop, Cali (CO)

( * ) Notice: Subject to any disclaimer, the term of this patent is extended or adjusted under 35 U.S.C. 154(b) by 0 days.

(21) Appl. No.: 17/187,592

(22) Filed: Feb. 26, 2021

Related U.S. Application Data

(60) Provisional application No. 62/981,812, filed on Feb. 26, 2020.

(51) Int. Cl.
*H05B 6/80* (2006.01)
*H05B 6/64* (2006.01)
*B65D 81/34* (2006.01)

(52) U.S. Cl.
CPC .. *B65D 81/3453* (2013.01); *B65D 2581/3444* (2013.01); *B65D 2581/3447* (2013.01); *B65D 2581/3472* (2013.01); *B65D 2581/3493* (2013.01); *B65D 2581/3498* (2013.01)

(58) Field of Classification Search
CPC ..... H05B 6/64; H05B 6/80; A47J 37/1219; A47J 37/1266; Y10S 99/14; B65D 81/34; B65D 81/3453; B65D 2581/3444; B65D 2581/3447; B65D 2581/3472; B65D 3581/3493; B65D 2581/3498
USPC ..... 219/730, 731, 720, 719, 678, 679; 426/107, 241, 243; 99/403, 329 R, 451, 99/DIG. 14, 410
See application file for complete search history.

(56) References Cited

U.S. PATENT DOCUMENTS 5,568,765 A * 10/1996 Andoh ..... H05B 6/80 99/403
2016/0088690 A1* 3/2016 Kubo ..... H05B 6/70 219/749

* cited by examiner

*Primary Examiner* — Quang T Van
(74) *Attorney, Agent, or Firm* — Schneer IP Law PLLC

(57) ABSTRACT

A microwaveable food container that incorporates at least one microwave-obstructing movable object. An actuator-induced controlled movement of the at least one microwave-obstructing movable object serves to controllably vary the microwave power density reaching a material which is located within the food container.

15 Claims, 16 Drawing Sheets

13C

ENHANCEMENTS OF THE FOOD COOKING CAPABILITIES OF FOOD CONTAINERS TO BE USED IN A MICROWAVE OVEN

CROSS-REFERENCES TO RELATED APPLICATIONS

This application claims priority from U.S. Provisional Application Ser. No. 62/981,812 filed Feb. 26, 2020, which is hereby incorporated herein by reference in the respective in its entirety.

FIELD OF THE INVENTION

The present inventions relate to technological means whereby food can be cooked in a microwave oven by means more closely resembling traditional cooking techniques than is currently possible, with consequently enhanced results in terms of taste, texture and appearance.

BACKGROUND

Microwave ovens are widely regarded as being quite good for cooking vegetables, and tolerably good for cooking a quick meal. However, many people regard dishes cooked in a microwave oven as being typically markedly inferior to food cooked using traditional cooking methods.

Different kinds of food which is not pre-cooked require different amounts of cooking time in a microwave oven to be at their best in terms of taste, texture and appearance. But in a pre-packaged food container containing a meal comprising different types of food which is designed for cooking in a microwave oven, different types of food making up a meal must perforce be cooked for the same amount of time.

In traditional (i.e., non-microwave) cooking methods, different food items making up a 'meal', or a dish in its entirety (e.g., a lasagna) are quite often first cooked by one cooking method—and then by a different method. Thus, lasagna may for example first be baked, and in the final stage of cooking, it may be grilled on the top to crisp and brown the upper areas of the dish. This 'first cooking by one method, and then by another' is not generally possible in the case of existing pre-packaged 'microwave meals'.

In traditional cooking, different types of food making up a meal interact with each other while they are being cooked, thereby exchanging flavors, and creating distinctive near flavors as a result of that interaction. But a significant amount of such interaction of different kinds of food items comprising a 'meal' in a pre-packaged 'microwave meal' container is in many cases not possible, with consequently inferior results, when compared with traditionally cooked meals.

The key to much of the flavour of conventionally (i.e., non-microwave) cooked food is a sequence of chemical events called the Maillard reaction. Cooking food with microwaves in many cases does not allow the Maillard reaction to take place—or at least, not to a great extent.

The inventions disclosed herein aim to address and resolve the above deficiencies of pre-prepared meals provided in food containers to be cooked in a microwave oven—and to provide other novel inventions to enhance the taste, quality, texture and appearance pre-prepared 'microwave meals', to enable dishes cooked in a microwave oven to more closely emulate the taste, texture and appearance of food cooked using traditional cooking methods.

BRIEF SUMMARY OF THE INVENTION

Most of the disclosures in this patent application relate to using novel actuator means to change the shape, location, angle, dimensions or other properties of a substrate or other object incorporating microwave-obstructing material, so as to thereby controllably change the intensity of microwaves reaching food or other material; or alternatively, using the same or very similar arrangements and means to change the shape or other properties of substrates or other objects bearing a distribution of susceptor material in order to thereby controllably change the intensity of heat generated by microwave-exposed said susceptor material which reaches adjacent food or other materials in a food container which is located in a switched-on microwave oven.

Using the above said means, disclosures herein include, for example, arrangements whereby different food items making up a pre-packaged 'microwave meal', located in different compartments of a food container, can each be exposed to microwaves for different amounts of time—thereby enabling each type of food to be cooked for its own ideal duration.

Similar arrangements can also be used, for example, to control and vary the microwave-induced cooking temperature of food in different food compartments of a food container during the time that the microwave oven container said food container remains switched on.

Other disclosures relate to the use of antennas converting microwaves into electrical power, to for example provide different ways of achieving the above said types of operations.

Another disclosure relates to a novel low-cost electrical power-switching and timing means of controlling many of the different above said operations described in this document. Novel means are disclosed whereby a wide range of fairly complex traditional meals can be cooked totally automatically within a food container located in a microwave oven, using both microwave and non-microwave cooking means to produce results in terms of taste, texture and appearance far exceeding those currently achievable using existing technology.

BRIEF DESCRIPTION OF THE DRAWINGS

FIG. 5A illustrates a plan view of a area of heat-conducting material, where the time that heat takes to be conducted across that area serves as a time-delay means.

FIG. 7B illustrates a time-delay arrangement which will release the tensioned 'lids' of FIG. 7A, a certain time period after the microwave oven is switched on.

DETAILED DESCRIPTION OF THE PREFERRED EMBODIMENTS

Figure 1A:
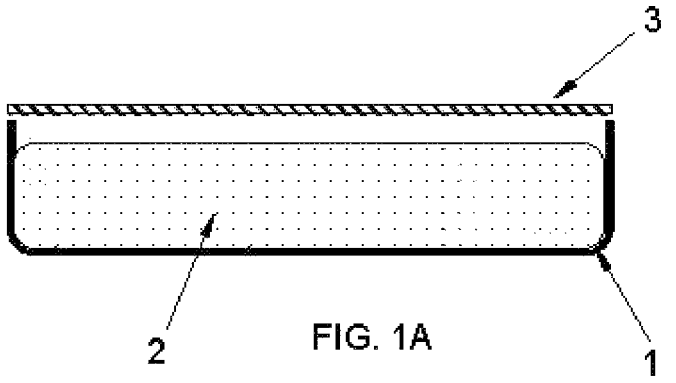
FIG. 1A illustrates a microwave-obstructing substrate 3 covering the aperture of a microwave-shielded food container in a switched-on microwave oven.

All inventions described in text and represented in drawings in this patent application are intended to be used in one or more food containers located in a switched-on microwave oven.

Lines in drawings in this document showing electrical connections—for example, between antenna(s) and resistive heating areas of material—are often not included within the drawings in this patent application, in order to keep the drawings clear and simple, focusing instead on the inventive ideas being introduced. Such electrical connections and their possible layouts are well-known to those skilled in the art.

Where in the drawings in this document single line, or a single substrate is shown, this does not necessarily indicate that in reality, a single substrate would be used for the purposes explained: many other possible types of material, such as for example paper board or other substrates, materials or objects could in different arrangements be incorporated in, or attached to, such a substrate which are shown in the drawings in this document.

Thus for example, a single line in a drawing cited as representing a 'microwave-obstructing substrate' may actually incorporate, for example, a substrate of aluminum foil, as well as a polymer substrate which might for example be heat-shrinkable polymer—or in various different possible embodiments, that substrate or combination of substrates attached to each other might also have other material—e.g., paper board sections—attached to them. Thus, descriptions herein using such terms as 'a substrate' changing location, shape, angle or other properties adjacent to (for example) the aperture of a food container for example should not necessarily be taken to mean that said 'substrate' is unaccompanied by or unattached to other substrates, or to other material, provided together with it.

FIG. 1A

FIG. 1A shows a microwave-obstructing (e.g., aluminum foil) food container 1 containing food 2, and a movable substrate 3 incorporating a distribution of microwave-obstructing material (e.g., aluminum foil) provided over the substrate, which is covering or occupying the area of the aperture of said food container 1, preventing any significant amplitude of microwaves in a switched-on microwave within which this container is located oven from reaching the food 2 within the container 1.

FIG. 1B

Figure 1B:
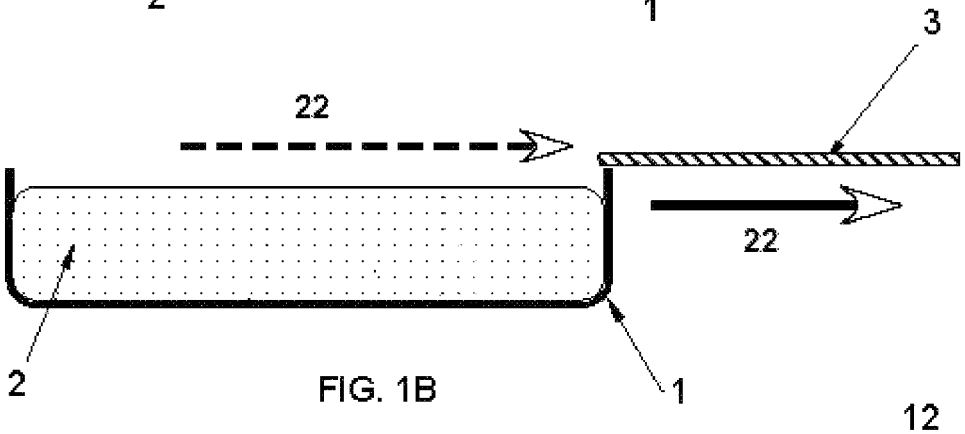
FIG. 1B shows the substrate 3 after being moved by a suitable actuator means to no longer a obstruct microwaves from reaching adjacent food, thereby causing the food to be heated or cooked by microwaves.

In FIG. 1B, said microwave-obstructing substrate 3 has been moved by any suitable actuator means (examples of which are provided below) to no longer obstruct microwaves in a switched-on microwave oven from reaching the food 2 within said food container 1, thereby causing said food 2, which in FIG. 1A had not been being cooked by microwaves, to now be cooked or heated by microwaves in a switched-on microwave oven.

As one example of an actuator means used to effect the movement of the substrate 3 shown in FIG. 1B, the controlled release of a tensioned substrate could be used to apply force to the microwave-obstructing substrate 3, causing it to change its location as shown in FIG. 1B, where the movement towards the 'at rest' state of said tensioned substrate which is first restrained, and is then controllably released, serves to move the substrate 3 as shown in this drawing.

Figure 2B:
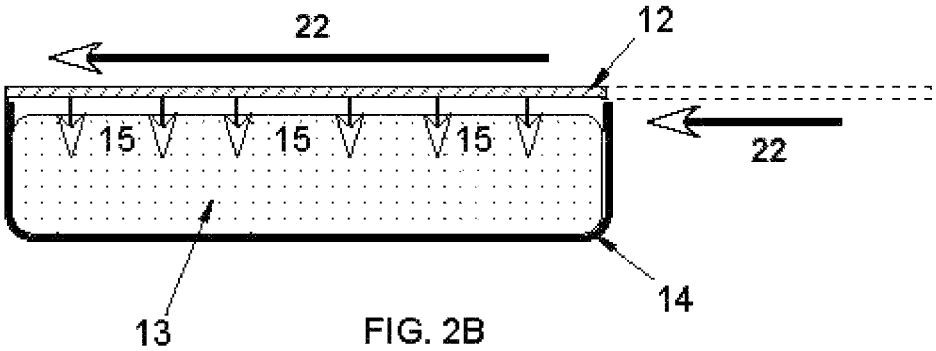
FIG. 2B shows a microwave-exposed susceptor material-bearing substrate which has been moved by suitable actuator means to become adjacent to food in a container, consequently grilling, cooking or heating that food.
Figure 3A:
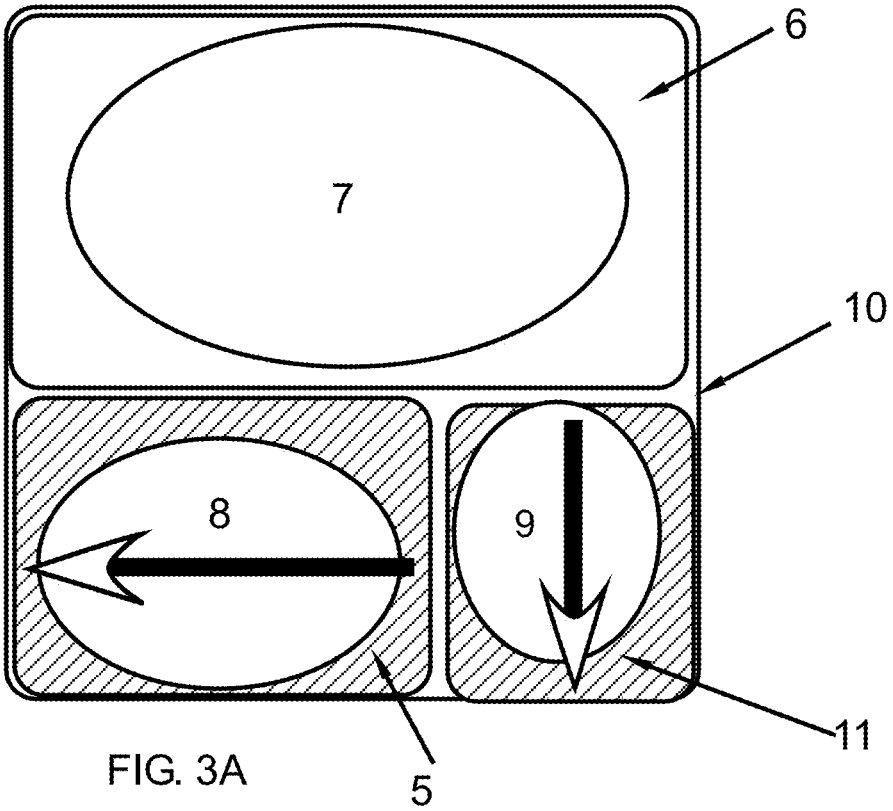
FIG. 3A is a plan view of a 'microwave meal' tray in a switched-on microwave oven, showing the food in two compartments 5, 11 being shielded from microwaves, while the food in the largest compartment 6 is being cooked.
Figure 3B:
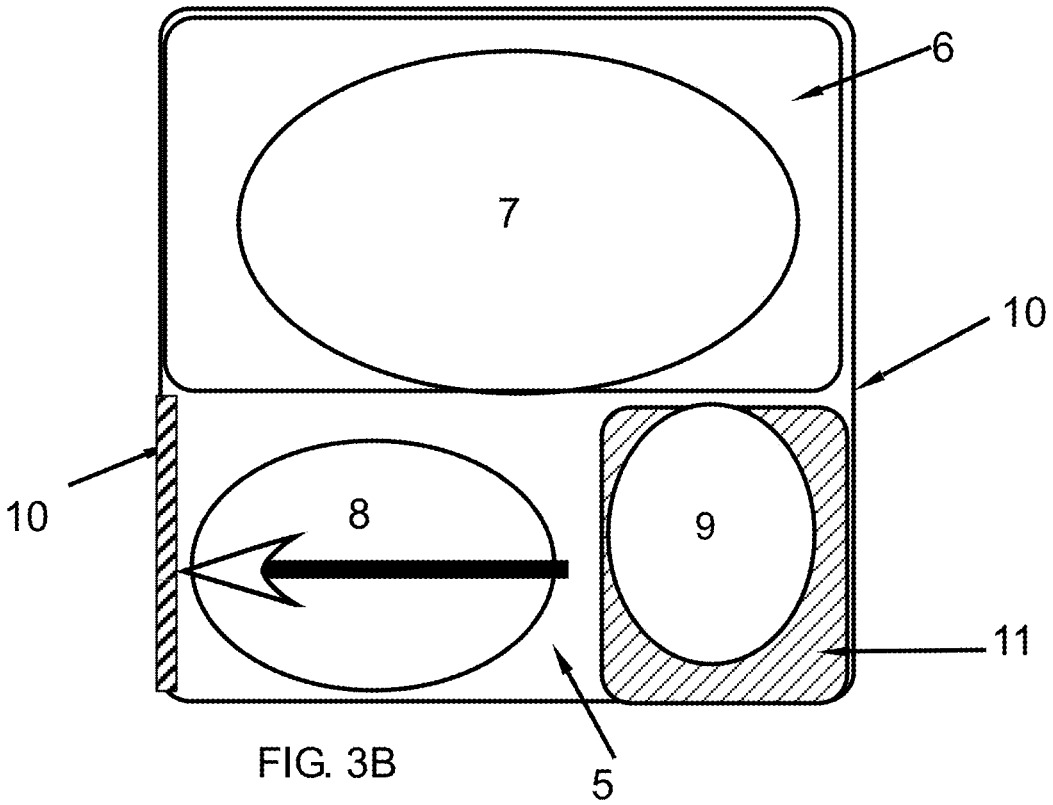
FIG. 3B shows the same tray as FIG. 3A, but where the microwave-obstructing substrate previously covering one compartment 5 has been 'scrolled-up' to one side by an actuator means, and the food within that compartment is now being cooked by microwaves.

Various drawings in FIGS. 4A-D illustrate this tension-release approach which can be used to change the location, shape, angle, dimensions or other properties of a substrate or other item, and which could for example be used as the actuator means to cause the shown change of location by the substrate 3 in FIGS. 1B and 2B, or the substrate 12 in FIGS. 3A and 3B are provided below in this document. And in addition, examples of various other, non-tension types of novel actuators which could be used to perform the above said movement of substrates 3 and 12 in the above said drawings are also illustrated and explained. In addition, of course, there are many other types of well-established types of actuator well-known to those skilled in the art which could alternatively be used to cause the movement of the substrates 3, 12 in the above said drawings.

It can be understood from the above explanation, and from FIGS. 1A and 1B, that using the novel design principles used in these arrangements, that if a suitable timing means is incorporated to trigger a suitable actuator to move the substrate 3 between the aperture-covering situation shown in FIG. 1A and the uncovered aperture situation shown in FIG. 1B, the food 2 within said container 1 could be heated or cooked by microwaves for some controllable portion of the time that said food container 1 is located in a switched-on microwave oven, and could be shielded from microwaves, and not cooked by microwaves, for some other controllable portion of that time period.

If there were a plurality of food compartments or receptacles using the design arrangements described above and illustrated in FIGS. 1A and 1B provided within a larger food container, with suitable actuator means used in the case of each said food container 1 to change the location, shape, angle or other properties of the movable microwave-obstructing substrate 3 of each said compartment being independently controlled, then it can be understood that the food in each of said food containers or compartments could be cooked by microwaves for different respective amounts of time, or for different respective portions of the time during which all said containers are located in the same switched-on microwave oven.

Thus, if for example each of said different compartments contained different kinds of food, the above said novel invention and capability could be used to provide the ideal cooking time for each of the said different types of food provided in said different said compartments of a larger food container—so that instead of different kinds of food in a pre-packaged food container perforce being all cooked for the same amount of time, each type of food could be cooked by microwaves for their own ideal amount of cooking time.

Alternatively, instead of each said compartments within a larger food container containing different types of food, said different compartments might for example instead contain different dishes requiring different amounts of cooking time by microwaves.

In addition to the above said important capabilities provided by the above said novel and inventive arrangements, if the microwave-obstructing substrate 3 were caused by a suitable actuator means to move to different positions where different portions of the food container aperture is controllably obstructed by microwaves, a plurality of food compartments as are described above, where the microwave-obstructing substrate 3 used in each said container is independently controlled, would also provide a means of cooking the food provided within each of said different compartments at different microwave-induced temperatures, even though the food in said different compartments are all located within the same switched-on microwave oven during the same period of time—cooking temperatures which could, if desired, be changed during the time that the microwave oven containing said different compartments of food remains switched-on.

The use of a suitable actuator means to change the location of the substrate 3 shown in FIGS. 1A and 1B can also be used as a means of changing the microwave-induced cooking temperature of the food 2 within the food container 1. As an example of one such means, the substrate 3 shown in FIGS. 1A and 1B could alternatively be changed in its location by any suitable actuator means to neither completely block microwaves from reaching the food 2 in the food container 2 shown, nor to completely expose the food 2 in the container 1 to the full power of microwaves in the switched-on microwave oven within which it is located, but instead, to allow only a limited amplitude or intensity of microwaves to reach the food 2 in the container 1.

Thus for example, the substrate 3 in FIG. 1A could be moved by a suitable actuator means some distance to the right of its location shown in FIG. 1A, so that only a portion of the area of the container's 1 aperture is covered or occupied by the microwave-obstructing substrate 3.

This would enable microwaves in the switched-on microwave oven to reach, and to heat or cook, the food 2 within the food container 1, but in smaller strength or intensity—and thus, cooking the food 2 at a lower heating temperature—than would have been the case if the microwave-obstructing substrate 3 had been moved by said actuator means to, for example, the location shown in FIG. 1B, where it is not obstructing any microwaves from reaching the food 2 in the food container.

Thus, it can be understood that by controllably changing the proportion of the aperture of the food container 1 shown in FIGS. 1A and 1B which is covered or occupied by the microwave-obstructing substrate 3, the microwave-induced cooking temperature of the food 2 within the cooking container 1 shown can be controllably changed during the time that said container 1 is located within said switched-on microwave oven.

In this context, it should be pointed out that in FIGS. 1A, 1B, 2A and 2B, the substrates 3, 12 shown changing their location are moving only in a horizontal axis. This particular axis of movement of the substrate 3 is used in these drawings simply to illustrate the inventive principles being introduced and explained here.

As other drawings and explanations provided below in this document illustrate, however, a substrate (or other object performing the same microwave-obstructing function as is performed by the substrate 3 in FIGS. 1A and 1B) could be alternatively be caused by suitable actuator means to move in many other ways than simply changing its location in a horizontal axis as is shown in these two drawings.

Such a microwave-obstructing substrate could, for example, instead be caused to change its shape or angle (as is explained below, and illustrated in drawings such as FIGS. 4A-D, and FIG. 6, for example), which would in many cases be a better way of thereby controllably changing the amplitude of microwaves able to reach adjacent food provided within a food container, thereby controllably changing the heating or cooking temperature of the food within that container, than would be the case using the horizontal axis of movement of a microwave-obstructing substrate being used for that purpose as is described above.

The same inventive principles explained above and illustrated in FIGS. 1A and 1B can also be used with other cooking methods. For example, with reference to FIG. 1A, in one possible alternative arrangement, in addition to the microwave-obstructing substrate 3 shown, there could be provided an additional (e.g., polymer) substrate located below and parallel with the microwave-obstructing substrate 3 shown in FIG. 1A, filling the aperture area of the container 1 shown, optionally with a venting means, which will serve to steam the food within the container 1 shown when the food 2 is exposed to microwaves to heat and steam the food 2, as shown in FIG. 1B.

In that arrangement, only when the movable microwave-obstructing substrate 3 is caused by suitable actuator means to move to a location or state where microwaves in the switched-on microwave oven can reach the food 2 will microwaves then start the steaming of the food 2 in said container 1.

As an example of one possible use of such an arrangement, we can imagine that the food container 1 in FIG. 1A is a food compartment in a larger food container, wherein there is another food compartment containing food which requires a longer cooking time than the rice in food container 1.

In such an arrangement, the food requiring a longer microwave cooking time than the rice in the food container 1 shown in FIG. 1A will first cook for some time, while the microwave-obstructing substrate 3 remains as shown in FIG. 1A, preventing the (e.g.) rice from being cooked by microwaves.

Then, when the food in said other container has been cooked for a certain amount of time, the microwave-obstructing substrate 3 in FIG. 1A is caused by suitable actuator means to be moved to a location (or shape, etc.) where it allows microwaves to reach the food 2 (e.g., as shown in FIG. 1B)—and the rice then starts to be steamed by microwaves. Examples of timing means to provide the above said time-delayed movement of the microwave-obstructing substrate 3 in FIG. 1A are provided below in this document.

Alternatively, as an example of a different cooking method which could be controlled using the novel design principles exampled in FIGS. 1A and 1B, a substrate bearing a distribution of susceptor material could be provided below and parallel with the microwave-obstructing substrate 3 in FIG. 1A, above the surface of the food 2, filling the aperture of the food container 1.

If the microwave-obstructing substrate 3 is moved by any suitable actuator means to a location which allows microwaves to reach said susceptor material, said susceptor material will heat up due to microwaves, and would commence 'grilling' or heating adjacent food 2 in the food container 1.

Thus, it can be understood from the latter examples, above, that an actuator-induced change 22 of location (or as will be shown below, of shape, angle or other properties of a microwave-obstructing substrate) caused by a suitable actuator means acting on a microwave-obstructing substrate can serve to controllably change not only the amplitude of microwaves reaching adjacent food—but in addition, can also serve to controllably change the amplitude of microwaves reaching other adjacent material(s) which are not food, but which are also located in a food container located in a switched-on microwave oven.

FIG. 2A

Figure 2A:
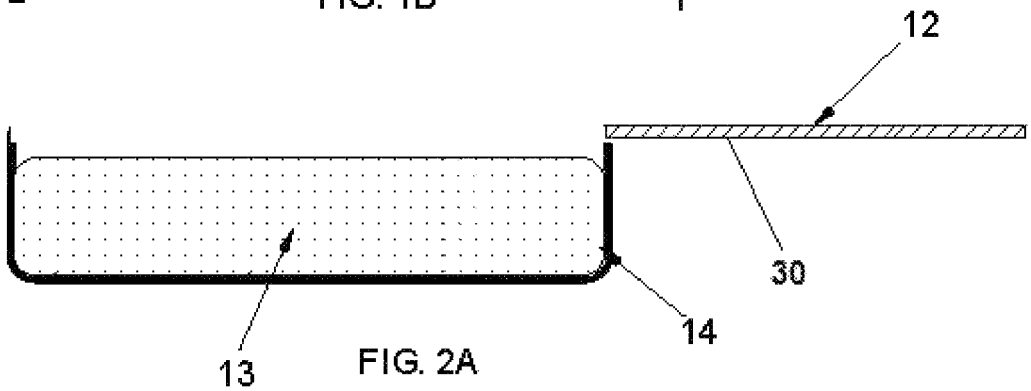
FIG. 2A illustrates a food container, and an adjacent susceptor material-bearing substrate 12, which is sufficiently far from the food in the container to not be heating or cooking it.

FIG. 2A shows a food container 14 containing food 13 in a switched-on microwave oven. A substrate 12 incorporating a distribution of susceptor material is shown located to the right of the aperture of said food container 14.

We can assume that in that location, the microwave-exposed susceptor material-bearing substrate 12 is having no significant heating effect on the food 13 in the food container 14.

The food container 14 shown could be made of or incorporate microwave-obstructing material (e.g., aluminum foil) on its sides and bottom in this example, if it were desired that the food within the food container 1 is shielded from microwaves. Or if that were not the case, the food container could be made of any suitable material, not necessarily obstructing microwaves—or alternatively, there might be no food container used at all, and the food 13 might instead, for example, be simply provided on a flat or other surface. Although in this drawing, the food is exposed to microwaves, alternatively for example, a microwave-obstructing substrate might be provided over the aperture of the food container 14 shown which could be removed by a suitable actuator means, for example, before or when the susceptor material-bearing substrate 12 is moved to be located above the food 12. (Or alternatively, for example, said area of microwave-obstructing material might comprise a portion of the movable substrate 12, which also has a portion of its area occupied by susceptor material 30).

FIG. 2B

In FIG. 2B, the susceptor material-bearing substrate 12 in a switched-on microwave oven has been moved by any suitable actuator means (examples of which are illustrated and explained below) to a location adjacent to and immediately above the top surface of the food 13 in the food container 14 shown.

In some possible implementations of this approach, there may be an air gap between the microwave-exposed susceptor material-bearing substrate 12; alternatively, the substrate 12 may be in contact with the food 13 shown.

The microwave-exposed susceptor material incorporated in said substrate 12 converts microwaves into heat, thereby causing at least some portion of the adjacent food 13 to be heated, cooked, 'grilled', crisped or browned by the heat emitted by said susceptor material.

The particular actuator means used in FIG. 2B might for example have employed the controlled release of a tensioned substrate or other tensioned item to apply force onto said susceptor material-bearing substrate 12, causing said substrate 12 to change its location as shown in FIG. 2B, where the 'at rest' state of said tensioned substrate or other tensioned item which is first restrained, and is then controllably released, serves to move said susceptor material-bearing substrate 3 as shown in FIG. 2B.

Various detailed examples and explanations of different controlled tension-release methods which can be used to change the location, shape, angle, dimensions or other properties of a substrate or other item, and which could be used as the actuator means to perform the function shown in FIG. 2B, are provided below (e.g., in FIGS. 4A-D) in this document, in addition to examples of other novel types of actuator means which could alternatively be used to perform the actuator-induced movement of the substrate 12 shown in FIG. 2B, or alternatively, to cause a substrate or other item bearing a distribution of said susceptor material to controllably change its shape, angle or other properties, so as to thereby controllably change the amplitude or intensity of the heating effect of microwave-exposed said susceptor material on adjacent or nearby food.

The downward-pointing arrows 15 in FIG. 2B represent the heating effect of microwave-exposed said susceptor material on the adjacent food 13.

The same or a different actuator means might for example some amount of time later, while the microwave oven within which the arrangement shown in FIG. 2B is located is still switched on, then cause the susceptor material-bearing substrate 12 to be moved away from the food—for example, to the location shown in FIG. 2A—thereby ending the heating of cooking of the food 13 by said susceptor material.

Thus, it can be understood from this example that by using the novel design principles illustrated in FIGS. 2A and 2B, a means is provided whereby one or more portions or items of food in a switched-on microwave oven can be 'grilled', cooked or heated by adjacent or nearby microwave-exposed susceptor material for some portion of the time that the food container 14 shown is located in a switched-on microwave oven—and not 'grilled' or heated by that susceptor material for some other portion of that time period.

It can also be understood that by using suitable actuator means to controllably change the location, shape, angle, dimensions or other properties of a movable substrate or other item incorporating susceptor material, the distance between susceptor material and food can thereby be controllably varied—and by that means, the heating effect of microwave-exposed said susceptor material on adjacent or nearby portions, items or areas of food, and the cooking temperature of said food, can be controllably varied during the time that a microwave oven containing said food and said susceptor material remains switched on.

This controllable variation in the distance between microwave-exposed susceptor material and adjacent or nearby food is not particularly well demonstrated by the arrangement shown in FIG. 2B, because the substrate 12 is shown as being caused to change location in a horizontal axis, for the sake of illustrating the inventive principles being introduced and explained in FIGS. 1A, 1B, 2A and 2B.

Such a horizontal axis of movement as is shown in FIG. 2B serves well enough to 'switch on' or 'switch off' the heating effect of microwave-exposed susceptor material in the substrate 12 on adjacent food, but is not the ideal axis of movement to controllably modulate the amplitude of that heating effect by controllably varying the distance between said susceptor material and said food 13.

Many of the other axis, directions or manner of shape-change that are shown below in this document would be better suited to achieve a controllable change in the distance between the susceptor material incorporated in a movable substrate (or other suitable object or item) and adjacent or nearby food, to thereby controllably change the heating effect of microwave-exposed said susceptor material on said adjacent food, than is shown in FIG. 2B, using a horizontal axis of movement.

A substrate incorporating susceptor material which is caused by suitable actuator means to 'curl-up' or lift up above the food, or to descend from such a posture or state towards the food surface, for example, would be a better way of controllably modulating the distance between food and the microwave-exposed susceptor material, and thereby controllably modulating the heating effect of said susceptor material on said food—and examples and explanations of various actuator means to achieve such types of movement of a substrate are provided below.

It should also be understood that by employing the inventive principles shown in FIGS. 2A and 2B, a portion or item of food could be first for example be cooked by microwaves, and could then be cooked by microwave-heated susceptor material—or visa-versa—thereby providing a new capability for use in pre-prepared 'microwave meals': namely, the ability to first cook food using one cooking method, and then to cook that food by a different cooking method.

Thus, for example, the food 13 in FIG. 2A might be a lasagna—which is first cooked by microwaves in the arrangement shown in FIG. 2A—and then, as in FIG. 2B, the susceptor material-bearing substrate is moved by actuator means to be located above the lasagna, the upper part of which food is then grilled, crisped or browned by the heat from the microwave-exposed susceptor material in the movable substrate 12.

This sequential cooking of food first in one way, and then in another, is a key cooking technique which is very often used in traditional cooking methods. The provision of a means of achieving a similar capability in pre-prepared 'microwave meals'—of first cooking food in one way, and then cooking it in another way—provided by the inventions disclosed in this document represents an important novel technological advance for that industry, allowing pre-packaged 'microwave meals' to thereby far more closely emulate the cooking methods and results in terms of taste, texture and appearance achieved using traditional cooking methods.

The particular direction and axis of movement shown taken by the substrates 3 and 12 in FIGS. 1A, 1B, 2A and 2B are provided as examples, to illustrate the inventive principles being introduced here. Clearly for example, the movement of either of the substrates shown 3, 12 in FIGS. 1A, 1B, 2A and 2B could instead have taken place in the opposite direction to that shown, producing the opposite order of effects or results to those described above; and equally, the movable substrates could of course alternatively have moved to the left of the food containers shown, instead of to the right.

Thus for example, the microwave-obstructing substrate 3 shown in FIGS. 1A and 1B could have initially been located as shown in FIG. 1B, so that it did not obstruct microwaves reaching adjacent food 2—and it could then have been moved by any suitable actuator means to the location shown in FIG. 1A, where it serves to shield the food 2 in the food container 1 from microwaves, thereby preventing that food from being heated or cooked by microwaves.

Thus in that example, the food 2 would have initially been heated or cooked by microwaves—and after the movement of said substrate 3 to cover the aperture of said container 1, the cooking of the food 2 within the food container 1 by microwaves would have stopped.

Similarly, if the susceptor material-bearing substrate 12 shown in FIG. 2A had instead been initially covering the aperture of the food container 14, then the microwave-exposed susceptor material incorporated in the substrate 2 would have been heating, cooking or 'grilling' adjacent food 13 in the food container 14.

It the susceptor material-bearing substrate 12 was then moved away from the food 13 by any suitable actuator means to the location shown in FIG. 2A, the substrate would in that location be sufficiently distant from the food 13 in the food container 14 to no longer be having any significant heating or cooking effect on that food 13.

In the case of the susceptor material-bearing substrate 12 shown in FIGS. 2A and 2B, if it were desired for example that only food located in the right-hand half of the food container 14 should be significantly heated, cooked or 'grilled' (or browned or crisped) by microwave-exposed susceptor material incorporated in the substrate 12, then said substrate 12 might for example be moved by suitable actuator means from the location shown in FIG. 2A to a location where it occupies only the right-hand half of the aperture of the food container 14—thereby causing the strongest heating effect on the food in the right-hand side of said container.

An alternative way of using microwave-exposed susceptor material to only (or mainly) heat or 'grill' food occupying only some portion (in horizontal terms) of the food 13 in the container 14 would be that only some portion of the susceptor material-bearing substrate 12 in FIGS. 2A and 2B incorporates a distribution of susceptor material. Thus for example, if only the right-hand half of the area of the substrate 12 incorporates susceptor material in FIGS. 2A and 2B, then the strongest heating effect of microwave-exposed susceptor material in the substrate 12 would affect food located in the right-hand side area of the container 14. If for example 'sear marks' or 'grill marks' were required on the food upper surface, then susceptor material might only be provided on the susceptor material-bearing substrate 12 in those areas where such marks achieved by susceptor-generated heating were required.

The horizontal axis movement of the substrate 12 in FIG. 2B can certainly serve as a means of effectively 'switching on or off' the heating by susceptor material of at least upper areas of the food 13 in the container 14 shown. But horizontal axis movement of the susceptor-bearing substrate is not the most attractive way of controllably modulating the amplitude of the heating effect of the susceptor material in that substrate on adjacent food.

Examples of other axis or manners of movement by susceptor-bearing substrates which would provide a more evenly-distributed increase or decrease in the heating effect of the susceptor material on adjacent food are provided below, in this document—for example, by changing the angle of the susceptor-bearing substrate so that it was raised or lowered to different angles between a horizontal angle immediately above the food 13 and a vertical angle hinged on (for example) the extreme left-hand side of the substrate 12.

In the case of FIGS. 2A and 2B, the susceptor material-bearing substrate 12 could by such means be moved by any suitable actuator means to be various different distances from one or more portions or items of food, thereby providing a controllably means of varying the heating effect of microwave-exposed said susceptor material on adjacent or nearby food.

Substrates which Allow Some Portion of Microwaves to Pass Through the Substrate, and to Reach Adjacent Food It should also be noted that the distribution of microwave-obstructing material provided in a movable substrate located adjacent to food in a food container (such as for example the substrate 3 shown in FIG. 1A) can optionally be configured not to prevent all microwaves from passing through it (e.g., and to reach adjacent food)—but instead, to allow some portion of microwaves to pass through said microwave-obstructing substrate—and thus, to allow some microwaves to reach adjacent food.

For example, a pattern of microwave-blocking material might be provided over the substrate's area which would permit some portion of microwaves to pass through it, or alternatively to provide across the substrate 3 a distribution of material which would not, due to its microwave-obstructing properties, prevent all microwaves reaching it from passing through said substrate 3. The manipulation of the properties of materials which could be used to achieve this purpose, or alternative arrangements to serve this purpose, are well-known to those skilled in the art.

In such a case, a microwave-obstructing substrate such as that in the arrangement shown in FIG. 1A could be configured to allow sufficient amplitude of microwaves to penetrate the substrate 3 that the food within was for example being simmered or cooked at a low temperature by microwaves, even though the microwave-obstructing substrate 3, as shown in FIG. 1A, entirely occupies the aperture of the container 2 shown.

The subsequent actuator-induced movement of the substrate 3 from the location shown in FIG. 1A to the location shown in FIG. 1B would in that case serve to increase the amplitude of microwaves reaching adjacent food 2 from a low heating effect to a full microwave-induced heating effect.

By this means, controlled modulation of the temperature of the microwave-induced heating or cooking of food in such a container can be achieved by a means which does not involve changing for example the proportion of a food container's aperture which is occupied by a microwave-obstructing substrate.

It should be noted that although in all of the drawings provided in this document, movable substrates serving to change the heating or cooking conditions of adjacent food (whether frozen or not) are shown as being located in or adjacent to an aperture in the top area of a food container, such (e.g.) shape-changing substrates could if desired be provided adjacent to the sides or bottom of a food container, where there may be no apertures—either instead of, or in addition to, such a substrate operating in or adjacent to an aperture the top area of a food container.

These same operations could alternatively be executed to the side or underneath food, for example. A substrate incorporating susceptor material, changing shape so as to grill adjacent food, for example, could do so underneath or to the side of the food—provided that there is a means whereby heat from the microwave-exposed susceptor material can reach and heat, or cook, the intended food items.

Although food is provided in many drawings and descriptions in this document as being the material which is affected by controlled changes in the amplitude of microwave or susceptor—emitted heating based on the principles explained and illustrated above and elsewhere in this document, the same inventive ideas, principles and arrangements disclosed above—for example, the changes in the intensity of microwaves, or if infra-red or conducted heat, reaching adjacent food shown in FIGS. 1A, 1B, 2A and 2B—and elsewhere in this document can alternatively be applied to many other kinds of materials, items or devices which are not food, but which are located in or adjacent to a food container in a switched-on microwave oven.

For example, novel arrangements to use an actuator-caused change of shape, angle, location or other properties of a susceptor-bearing or microwave-obstructing substrate to controllably vary the amplitude of susceptor-emitted or microwave radiation reaching heat-shrinkable polymer material, causing said polymer to serve as an actuator means, are disclosed later in this document. As another example, novel means of controllably varying the intensity of microwaves reaching one or more adjacent antennas, thereby controllably changing the amplitude of electrical energy said antenna(s) generate and apply to connected devices or materials within a food package, are also disclosed later in this document.

Very many different types of actuator are available for the market today, well-known to those skilled in the art, which could be used to perform the changes of shape, location, angle or other properties of a substrate or other object to serve as a means of changing the amplitude of microwaves or susceptor-emitted heat affecting an object or material in a food container in a switched-on microwave oven using the inventive principles explained and illustrated above.

We will however in this document be focusing on disclosing various novel and inventive new types of low-cost actuators which can perform the inventive new functions described in this document.

FIG. 3A

FIG. 3A shows a schematic plan view drawing of a food container 10 incorporating different food compartments 6, 5, & 11 containing respectively, as an example, a leg of chicken in a sauce 7, chopped potatoes 8 and peas 9.

The lower two food compartments 5 & 11 in the drawing incorporate or include food containers (e.g., which are made of aluminum foil) which shield the food within against microwaves coming from all directions other than from above those two compartments. Thus, where a microwave-shielding substrate (e.g., incorporating a distribution of aluminum foil over their area) covers or occupies the whole area of the aperture of a food container or compartment (as is indicated in FIG. 3A is the case by the shading over the two compartments 5 and 11), no significant amplitude of microwaves will be reaching the food within those containers or compartments.

The shading shown in the drawing for food compartments 5 & 11 in FIG. 3A represents the fact that there are separate (and separately controlled) microwave-obstructing substrates covering or filling the apertures of the two compartments 5 & 11, in an arrangement similar to that shown in FIG. 1A, above.

Thus, in a switched-on microwave oven, there would in this example be no significant heating effect by microwaves on the food contents of the two compartments 5 & 11 in the situation shown in FIG. 3A.

Let us assume that the chicken in a sauce 7 provided in the largest food compartment 6 requires the longest cooking time in a microwave oven of the three types of food in the three different compartments shown in FIG. 3A. There is thus in this example no microwave-obstructing substrate shielding the chicken 7 in the upper food compartment 6 from microwaves: the chicken will start cooking as soon as the microwave oven is switched on, and will continue to be cooked until the microwave oven timer switches the oven off.

The potatoes 8 and peas 11 in compartments 5 and 11, by contrast, both have microwave-shielding substrates covering those respective compartments in this drawing, and thus, they will not start to cook until the microwave-obstructing substrates located filling or covering the apertures of the two food compartments 5 & 11 are moved (e.g., changed in their location, shape, angle or other properties) by any suitable actuator means to allow microwaves to reach the food within said two compartments.

The broad arrows shown in the two lower compartments 5, 11 in FIG. 3A indicate—purely as examples, with the respective directions having no significance—the directions in which the microwave-obstructing substrates above the peas and the potatoes compartments 5 & 11 might be caused, for example, to curl-up, lift up, or to otherwise move away from obstructing microwaves from reaching the food 8, 9 in said compartments, when for example different amounts of time (in respect of each of said two compartments shown) have elapsed since the microwave oven was switched on, or when other conditions have been met.

FIG. 3B

In FIG. 3B, representing some later stage of the cooking operation in the still switched-on microwave oven, we see that the microwave-shielding substrate covering the aperture of the food compartment 5 containing the chopped potatoes 8 has been moved to the left-hand side 10 of the lower left-hand side compartment 5 aperture by any suitable actuator means, such for example as any of the novel actuator means disclosed in this document (see FIGS. 4A-D, for examples of tension-based actuator means which could be used to achieve said movement of the substrate).

Since said microwave-obstructing substrate previously covering the compartment 5 containing potatoes 8 in FIG. 3A is now no longer significantly obstructing microwaves from reaching the chopped potatoes 8 in FIG. 3B, the potatoes 8 have now started to be cooked by microwaves.

In FIG. 3B, the peas 9, being the food ingredient in the dish shown requiring the shortest cooking time, are still shielded from microwaves, and have thus not yet started to cook.

In this way, all of the different components of a meal could 'arrive' (i.e., complete their cooking) at the same time, each having been cooked for their own respective ideal lengths of time when the microwave oven timer ends the cooking operation.

Thus for example the peas, which if they are to be crisp and bright green for example in color, probably require the least cooking time, can be as many people would ideally like them to be—instead of being greatly over-cooked (in many people's view), as would be the case with many existing pre-packaged 'microwave meals', where all items in a 'meal' must perforce be cooked for the same amount of time by microwaves.

This revolutionary means of controlling the respective cooking times of a number of different types of food, or of different dishes provided in different compartments or areas of a food container, provides a means of providing people with freshly-cooked fresh ingredients making up a meal—instead of pre-cooked, non-fresh, ingredients. The above arrangements are also suitable for food which was frozen when fresh, and is de-frosted.

This invention thus represents a big step forward for pre-packaged 'microwave meals'—allowing the consumer to enjoy a meal where each different food element in the meal has been cooked for its own ideal amount of time.

If the Movable Substrates in FIGS. 3A & 3B had Instead Incorporated a Distribution of Susceptor Material If the substrates described above as covering the compartments 5 & 11 in FIG. 3A had not incorporated microwave-obstructing material (e.g., aluminum foil), but had instead both incorporated a distribution of susceptor material (e.g., as shown in FIG. 2B) over at least most of their area, then the arrangement shown in FIG. 3A could have been used for example to 'grill' the food located adjacent to said substrates in the compartments 5 and 11 with microwave-exposed susceptor-generated heat.

In such a case, then in the situation shown in FIG. 3B, where the movable substrate over the potatoes 8 in the lower left-hand compartment 5 has been (e.g.) scrolled-up to no longer be located over said potatoes, the potatoes would prior to that movement have been being 'grilled' or cooked by heat from microwave-exposed susceptor material in said substrate—and would, after the 'scrolling up' of said substrate, no longer be being 'grilled' by said susceptor material-bearing substrate, and would instead be being cooked by microwaves—assuming that the microwave oven is still switched on, and that no other type of substrate is moved by actuator means to locate itself over the potatoes 8.

Of course, the movement of the substrate shown in FIG. 3A as covering the potatoes 8 could instead have initially been scrolled or positioned to not obstructed microwaves reaching the potatoes—and that substrate could later by moved by said actuator means to cover the potatoes. In such a case, if the substrate incorporated microwave-obstructing material, the potatoes would initially have been being cooked by microwaves—and then, when the substrate was moved to cover the compartment 5, that cooking operation would stop. If instead the substrate had incorporated a distribution of susceptor material, then the potatoes would have initially have been being cooked by microwaves—and when the substrate was moved over the potatoes, they would have been 'grilled' by the adjacent susceptor material in that substrate.

It should be pointed out that although different food compartments are shown and described in the above examples, different dishes, or portions, or food items, would not necessarily be divided into different said compartments within a larger food container. They could, alternatively, simply be different food items or portions distributed in different areas, or at different locations, within a food container—although in the case of controllably varying the intensity of microwaves heating different items or portions of food, not shielding different dishes or portions of food would reduce the effectiveness of different intensities of microwaves reaching said food due to changes in the location or other properties of said movable substrates.

As a demonstration of yet another cooking method—steaming—which this type of arrangement can provide control over, let us imagine that the contents of compartment 5 is rice, instead of potatoes—and that the rice is to be cooked by steaming it.

In that scenario, it may be that one function of the substrate covering that compartment 5 is to release the steam from the rice container a certain approximate amount of time after the microwave oven containing the items shown in FIGS. 3A and 3B is switched on. Any of the different actuators disclosed in this document to change the shape or other properties of a substrate could be used to release the steam at a certain time, or when certain conditions are met, could for example be used to release steam.

In that scenario, the substrate covering the rice in that compartment 5 could be a microwave-transparent polymer film incorporating a small vent, which would not allow most of the steam to escape, as long as it covers that compartment's 5 aperture.

Then, after an appropriate amount of time has elapsed after the microwave oven was switched on to allow the rice to be steamed inside that compartment 5, the substrate covering compartment 5 would be caused by any suitable actuator means (for example, the tension-release system shown in FIGS. 4A and 4B) to for example scroll-up, partially or entirely, to release the steam within the compartment.

It should be noted that although in many drawings and descriptions in this document, only a single substrate over or adjacent to the aperture of a food container is changed in its shape or other properties to perform various different functions or purposes, in certain situations, more than one movable substrate may be provided over, or adjacent to, the aperture of a food container.

If this example of rice, instead of potatoes, was the food occupying the lower left-hand side food compartment 5 shown in the drawing—it might be that it was desired that the chicken 7 should cook for a period of time, before the steaming of the rice commenced.

In that scenario, a microwave-blocking substrate could be provided over the rice compartment 5, just as it was over the potatoes in that compartment 5 in the initial example of possible uses of the arrangements shown in FIGS. 3A and 3B. Underneath that microwave-blocking substrate, there could be provided another, separate, substrate, which is a microwave-transparent substrate to be used for keeping most of the steam inside the compartment 5 during the steaming process.

Thus, in this example, a period of time after the microwave oven was switched on, the microwave-blocking substrate would be moved by any suitable actuator means to a location or state where it no longer blocked microwaves from reaching the rice—thereby causing the rice to start to be steamed. Examples of low-cost time-delay means to achieve the timing functions described above are provided below, in this document.

The controlled movement of susceptor material in substrates or other objects so as to change the distance between microwave-exposed susceptor material and food surfaces can also be used to vary the heating intensity of susceptor-generated heat reaching different areas of a single food item—a pizza, for example. It may be that the crust of a pizza requires a different amplitude of susceptor-generated heat, or to be heated for a different amount of time, for example, than some other part of a pizza. Separately-controlled susceptor-bearing substrates or other items, using the same inventive arrangements as are described above, could be used to achieve suchlike objectives of exposing different parts of a food item to susceptor heating for different portions of the time that said food container is in a switched on microwave oven—and actuators such as those disclosed in this document could be used to controllably vary the distance of susceptor material from different areas of the food item, as described above and elsewhere in this document.

FIG. 4A

Figure 4A:
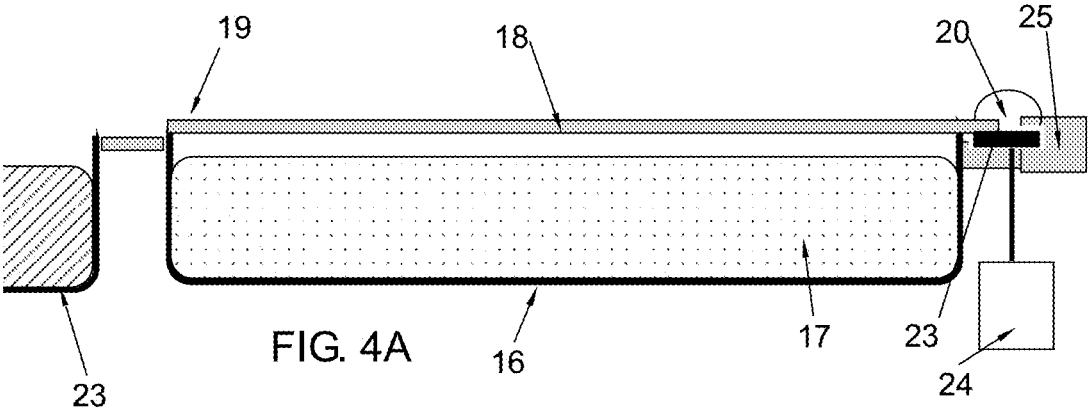
FIG. 4A illustrates a cross-sectional view of a food container, where a tensioned substrate covering the food container's aperture is prevented from moving to its 'at rest' shape or state by restraining means 20.

FIG. 4A shows a schematic cross-sectional drawing of one example of many possible different possible embodiments of a novel actuator means to be used in a switched-on microwave oven which uses tension in a material, and the release of said tension, to (in this particular example) change the shape of a substrate 18 bearing, for example, a distribution of microwave-obstructing material, or susceptor material, over its area.

This novel type of actuator means is appealing due to its simplicity and low production cost, and can optionally be used to implement very many of the inventions disclosed in this document which employ an actuator.

In FIG. 4A, there is a food container 16 containing food 17 in a switched-on microwave oven, with a tensioned substrate 18 covering the aperture of said container, where said tensioned substrate 18 is restrained from moving to its 'at rest' state by a fastening or restraining means 20 which in this particular example is a solidified droplet of wax.

In FIG. 4A, largely for the sake of presenting a less than obvious kind of restraining means, to illustrate the fact that the range of possible restraining and release means is extremely wide, a solidified droplet of (say, edible) wax 20 is shown as the releasable fastening or restraining means.

The wax droplet 20 in FIG. 4A is acting as a restraining or fastening means by attaching the tensioned substrate 18 to a lip or part of the food container 25, thereby preventing the tensioned substrate 18 from being released to move towards its 'at rest' state, curled up at the left-hand side of the food container's aperture 19, as long as said wax droplet remains in solid form.

If the wax droplet is heated and melts or liquefies, it will lose its substrate-restraining capability or fastening capability, and the tensioned substrate 8 will be released.

One or more antennas 24 serving to convert microwaves into electrical energy are shown as an optional element in this particular embodiment. A small portion of an adjacent food container or compartment 23 is also shown in this drawing, to illustrate the fact that the food container 16 shown may be one of a number of food compartments or containers incorporated within the same larger food container, each optionally with a similar tensioned substrate and independent timed release arrangement to that shown here. Thus, the food container shown in FIG. 4A may, optionally, be one food compartment among other similar ones provided within a larger food container.

Figure 4B:
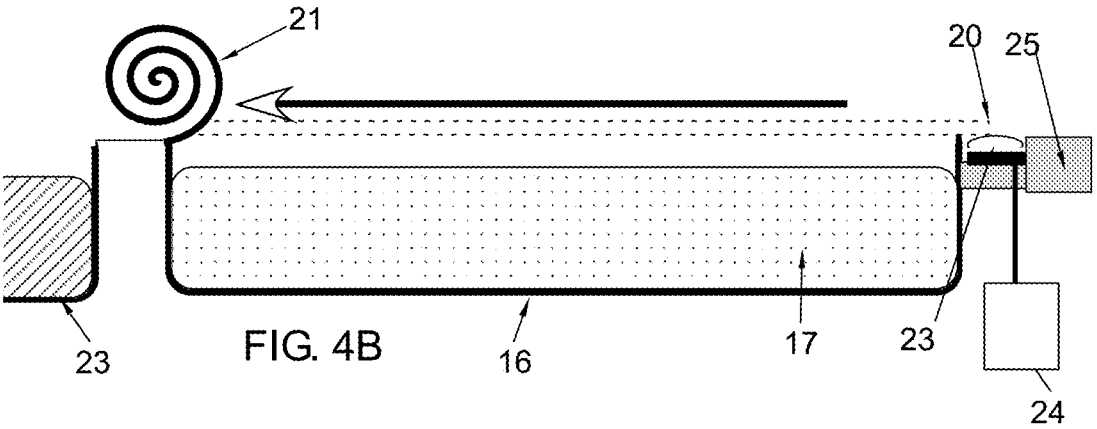
FIG. 4B illustrates the same food container as FIG. 4A, where the tensioned substrate has been released from restraining means, and has consequently scrolled-up 21 to one side of the food container.

The food container 16 shown can be assumed in most—but not all—possible embodiments to be made of or to incorporate microwave-shielding material (e.g., to be made of aluminum foil) if the substrate 8 is to incorporate a distribution of microwave-obstructing material, and is to be used to change the intensity of microwaves reaching food in the food container 16 by (in this example) curling-up to the left-hand said of the food container 21 as shown in FIG. 4B—and the substrate 18 may for example be permanently fastened to the food container at the left-hand edge of the food container 19.

FIG. 4B

In FIG. 4B, said tensioned substrate 18 has been released from the wax droplet 20 restraining or fastening means due to the wax droplet 20 having been heated, and thus having melted or liquefied, thereby losing its restraining capability, causing the tensioned substrate 18 to move to its 'at rest' shape and location, curled-up 21 at the left-hand side of the food container.

If the substrate 18 incorporates a distribution of microwave-obstructing material over its area, the food 17 shown in FIG. 4A would have been shielded from microwaves—and in FIG. 4B, after said substrate 18 had been released to curl-up 21 to the side of the container, the food would be exposed to microwaves, and would thus start to be heated or cooked by microwaves.

If alternatively, the substrate 18 had incorporated a distribution of susceptor material over at least a substantial portion of its area, then in FIG. 4A, said susceptor material would have been converting microwaves into heat, and would be grilling, heating, browning or crisping the adjacent areas of food 17, until such time as the substrate 18 was released as shown in FIG. 4B, thereby causing said susceptor material-bearing substrate 18 to scroll-up 21 at the side of the container's aperture, and thereby effectively ending the heating, cooking or 'grilling' effect of said microwave-exposed susceptor material incorporated in the substrate 18 on the adjacent food 17.

Thus, it can be understood that the arrangement shown in FIGS. 4A and 4B could for example have been used to achieve the changes and purposes shown in FIGS. 3A and 3B, and as explained above in reference to those drawings.

Thus, for example, two or more different food compartments incorporated in a larger food container could each use a duplicate of the arrangements shown in 4A and 4B in each of said food compartments, so that with independent control over the timing of the release of each movable substrate (for example) in each said food compartment, the food items or portions in each food compartment could each be cooked differently during the time that said larger food container is located in the same switched-on microwave oven.

For example, the food in each compartment could be cooked using different cooking methods (e.g., by microwaves, or being grilled or steamed) for different amounts of time, or at different temperatures (as explained above) during that time. Examples of different means whereby said tension release means can be independently actuated in the case of each said different food compartment, and examples of different novel and inventive means of timing the triggering of said tension release in the case of one or more food containers, are provided below.

Clearly, there are very many other different kinds of materials well known to those skilled in the art which would lose their tensile strength sufficiently when heated, or actuators which would be caused by heating or other means to change their shape, angle, dimensions, location or other properties so as to release the tensioned substrate shown in FIG. 4A, which could be used in place of the wax droplet cited here: a wax droplet is no more than one example among almost countless other materials or devices which could alternatively perform this restrain >release function.

However, in this particular example of a wax droplet performing this role, many of the examples of different ways of heating that droplet to cause the tensioned substrate shown in FIG. 4A to be released can be divided into two categories: those where the heating effect of microwaves in the switched-on microwave oven causes susceptor material in or adjacent to said wax droplet to be heated up, and to thereby cause, directly or indirectly, the wax droplet to melt or liquefy; or alternatively, where electrical power is applied by said (optional) antenna(s) to resistive heating material in or adjacent to said wax droplet to heat and melt or liquefy the droplet.

Said wax droplet 20, or material adjacent to it, could for example incorporate susceptor material which is heated by microwaves some amount of time after the microwave oven is switched on. The amount (or other properties) of susceptor material provided in or adjacent to said droplet 20 could for example be adjusted to determine the approximate amount of time after the microwave oven is switched on which would elapse before the wax droplet was sufficiently heated to lose its ability to any longer restrain the tensioned substrate—thereby providing one possible adjustable time-delay means.

Another means of providing such a time delay function would include for example providing shielding against microwaves around susceptor material located in or adjacent to said droplet, the microwave-shielding properties of which could be varied, so as for example to slow the rate of the microwave-induced heating up of said susceptor material, and to thereby delay by the desired amount of time the melting of said droplet, and the release of said tensioned substrate, after the microwave oven is switched on.

Or alternatively—as only one further example of almost innumerable other possible means of controlling the amount of time after the microwave oven is switched on which will elapse before said tensioned substrate is released by said wax droplet—electrical power generated by one or more antennas 24 incorporated in the food container 16 or elsewhere within a larger container containing the food container 16 could be applied by a suitable switching or timing means to resistive heating material 23 in or adjacent to said wax droplet, thereby heating and melting or liquefying it, when for example a desired amount of time has elapsed since the food container 16 was first exposed to microwaves in the microwave oven within which it is located.

In such an approach, said wax droplet would preferably not contain susceptor material, relying instead on the heating of resistive heating material in or adjacent to the droplet to melt or liquefy the droplet.

A novel and very low-cost timing and electrical power generating and switching means is disclosed, below, in this document as one example of a means of timing the application of electrical power generated by antenna(s) converting microwaves into electrical power to one or more devices or materials incorporated within a food container, such as said resistive heating material adjacent to said wax droplet—but of course, there are many other timing and switching means well-known to those skilled in the art which could alternatively be used.

As is the case with all arrangements and inventions described in this document which employ resistive heating material, if necessary, any resistive heating material 23 provided in or nearby to said wax droplet if necessary be shielded from microwaves, to prevent it heating up due to microwaves, instead of due to the application of electrical power from said antenna(s).

Thus, for example, if necessary, the resistive heating material 23 shown in FIG. 4A, located adjacent to the wax droplet 20, could be shielded by a small area of aluminum foil above and below the resistive heating element or area of material to prevent the resistive heating material (e.g., a carbon-based material) being heated by microwaves. When heated by electrical power applied by one or more antennas in this apparatus, the heat from said resistive heating material 23 could be conducted through the (e.g.) aluminum foil microwave shielding material above (for example) the resistive heating means, thereby heating said wax droplet.

The use of one or more antennas converting microwaves into electrical power of course opens up the option of using almost countless alternative electrically-powered actuator or timing means well known to those skilled in the art which could be used to release the tensioned substrate shown in FIGS. 4A and 4B, instead of using said wax droplet—including for example shape-changing materials. And of course, this is to say nothing of almost innumerable non-electrical other means of releasing said substrate, including for example microwave or heating-triggered chemical means to sufficiently weaken the restraining means, or the restraining means being sufficiently weakened or degraded in tensile strength due to microwave exposure. The list of optional means of controllably releasing the tensioned item when a desired approximate amount of time after the microwave oven is switched has elapsed is almost endless.

There are, clearly, almost innumerable alternative directions, axis or ways of movement in which a tensioned substrate can be caused to change its shape, location, angle or other properties when moving from a restrained state towards its 'at rest' state, other than that shown in FIG. 4B, to for example thereby change the amplitude of microwaves or susceptor-generated heating effect reaching adjacent food or other items.

Thus for example, if desired, the 'scrolling-up' of the substrate 18 shown in FIG. 4B could instead have been caused to take place in reverse, where the substrate was initially scrolled up 21 as shown in FIG. 4B, and was restrained in that tensioned state—and was later, during the time that the microwave oven remains switched on, released to move to its 'at rest' state lying horizontally over the aperture of the food container 16. In addition to such tension-based actuator means, many other ways of achieving such an 'un-scrolling' of a substrate are disclosed below.

Thus, it can be appreciated that tension in a substrate or other object, and the controlled release of that tension, can be used in many different directions or different axis, to achieve many different kinds of functions or effects, including functions which are not related to changing the microwave or susceptor heating effects on adjacent food or other material. And instead of a tensioned substrate being the actuator means, it might instead have been the release of a spring, or an elastic band for example which causes force to be applied some object which is not a substrate, but which incorporates for example a distribution of microwave-obstructing or susceptor material, thereby causing a change in its shape, location, angle or other properties, which thereby causes a change in the amplitude of microwaves or susceptor heating effects on adjacent food or some other material.

Although in FIGS. 4A and 4B and in other drawings in this document, there is a substrate shown as being the movable item which, in this particular example, scrolls-up, this is mainly to illustrate in the most simple way the inventive principles being introduced here. Some other movable object which is not a substrate, but which performs the same functions as are described here, could alternatively be used as the movable item, instead of a substrate. Or the substrate 8 shown could for example incorporate or be attached to other substrates or other items, or could have other materials attached to it, such as paper board for example—but the inventive principles introduced here would remain the same.

The flexible substrate 18 shown might for example have one or more paper board sections of material attached to it—which optionally might for example incorporate the susceptor or microwave-obstructing material cited in reference to FIGS. 4A and 4B as being materials which may optionally be incorporated with the substrate 18. Clearly a movable item incorporating one or more sections of paper board which is caused to move in some direction or way due to the release of tension in some item would not 'scroll-up' 21 as shown, but would move in a different way to (for example) thereby change the amplitude of microwaves reaching the food 17 shown.

In some cases, tension can be induced in a substrate due to it having been stretched in the manufacturing process, so that if not allowed to return towards its earlier, smaller dimension, there will be stress or tension in that substrate. Or a substrate of a suitable polymer used in a food package might for example be heated so as to cause a shrinking effect, thereby introducing tension or stress if it not permitted to reduce its dimensions. Or a spring or a rubber band, for example, can be moved so that they are far from their respective 'at rest' states—thereby creating stress or tension in those items. There are almost countless ways, well-known to those skilled in the art, of introducing tension into a material or item, so that it is under tension,—and to later release that material or item from restraining means, which causes it to move towards its 'at rest' state.

Many more old-fashioned yogurt container foil lids, for example, often comprise or comprised two layers of material: an aluminum foil substrate bonded to a polymer substrate, where the polymer substrate or layer had been stretched in the manufacturing process before being attached to the aluminum foil.

When such a yogurt container is opened, one could sometimes notice a phenomenon known in the packaging industry as 'curling'—where the foil-polymer combined substrate curls up to one side of the aperture of the yogurt container, because the previously stretched polymer layer or substrate was seeking to return towards its previous, smaller dimensions. This is also an example of 'tension'—because the previously-stretched polymer substrate is not in its 'at rest' state, and thus seeks to shrink back towards those smaller dimensions when freed from restraining means preventing it from doing so.

Indeed, the same principle could be used to achieve the 'scrolling up' of the substrate 18 shown in FIGS. 4A and 4B, if desired—using for example a previously stretched (in the manufacturing process) polymer substrate being bonded to an aluminum (or other material which does not seek to shrink its dimensions) substrate, with said polymer substrate being provided 'above' (in terms of FIG. 4A) the aluminum substrate, so that when released from (for example) the melted wax droplet, the polymer substrate, seeking to shrink back towards its earlier smaller dimensions, would, together with the (e.g.) aluminum foil substrate to which it is bonded, 'curl up' as shown 21 in FIG. 4B.

Or of course, alternatively—as just another of almost countless examples of different ways to achieve a 'tensioned substrate' such as is described here—a single substrate of material with suitable properties could simply have previously be 'scrolled up' or 'rolled up'—for example, during the manufacturing process—and in a 'shape memory' sort of phenomenon, seeking to return towards its previously curled-up shape, once released, it could on its own scroll-up as shown, for example.

Or alternatively, 'tension' can be induced in a substrate after (for example) it is secured by some restraining means such as is shown here 20—and if desired, heating could be used to achieve that. A heat-shrinkable polymer, for example, bonded to and located 'above' (in terms of FIG. 4A) a substrate which would not shrink in response to heating, could be used to similarly 'scroll-up' as shown in FIG. 4B.

Of course, 'scrolling up' as shown in FIG. 4B is just one of countless different changes of shape, location, angle or other properties which could be caused to take place in a substrate or other item performing the functions described above. Such a substrate—on its own, or attached for example to one or more paper board substrates—could be caused by tension (or by other actuator means which will be exampled below) to for example lift-up in its angle, or change its location, or undergo many other types of shape or other changes to perform the functions described above.

The wax droplet cited above and used in FIGS. 4A and 4B is just one of almost countless means, materials or devices which could serve a similar restrain >release function, many of which are well-known to those skilled in the art. A list of such materials, devices and technologies which could perform this function would fill many pages. Temperature-triggered shape-changing materials or combinations of materials could clearly be used to change shape when a certain microwave or resistive heating-triggered temperature is achieved, or when electrical power is applied to it, to release the tensioned substrate or other item. Any number of different electrically-powered actuators or actuator technologies could do the same thing, when for example electrical power was applied to them by a suitable switching or timing means linked to one or more antennas in the apparatus shown converting microwaves into electrical power. An adhesive fastening said tensioned substrate to (e.g.) the lip of the food package 26 shown could de-bond in response to the heating of susceptor material in the adhesive or adjacent material, or due to electrical power from an antenna being applied to it . . . the list of alternative means of first restraining and then controllably releasing said tensioned substrate or other tensioned item performing the same functions is almost endless.

FIG. 4C

Figure 4C:
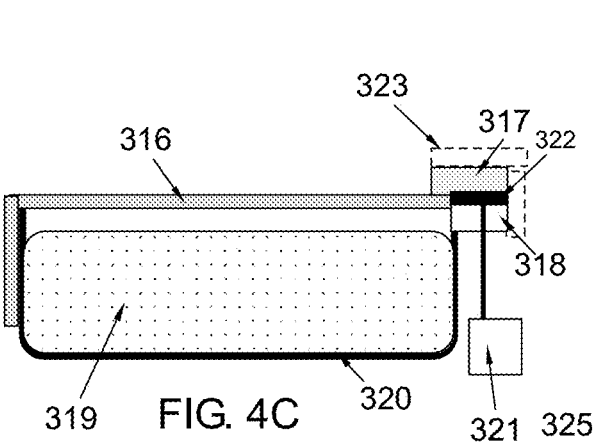
FIG. 4C illustrates a tensioned substrate above a food container, which is restrained by heat-shrinkable polymer material.

FIG. 4C shows a different embodiment of the disclosure, among the almost countless different ways of releasing a tensioned item. In this particular example, the 'substrate' shown is rigid. It might for example be a paper board substrate incorporating or attached to a substrate of polymer substrate providing the tension force.

Figure 4D:
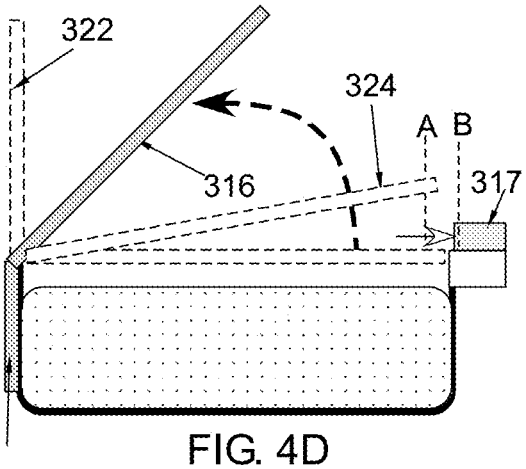
FIG. 4D illustrates the tensioned substrate of FIG. 4C after being released from heat-shrinkable restraining means, due to that material having been caused to shrink, due to heating.

If a tensioned polymer substrate were for example part of the 'substrate', it might for example be attached to the left-hand vertical wall 325 of the food container, with an 'at rest' angle and power sufficient to achieve the different possible angle(s) of 'lift' shown in FIG. 4D. Alternatively, for example, there might be a tensioned item (not shown) external to the substrate—e.g., an elastic material—which is applying force onto said substrate to cause it to rise in angle to the required extent.

Figure 10A:
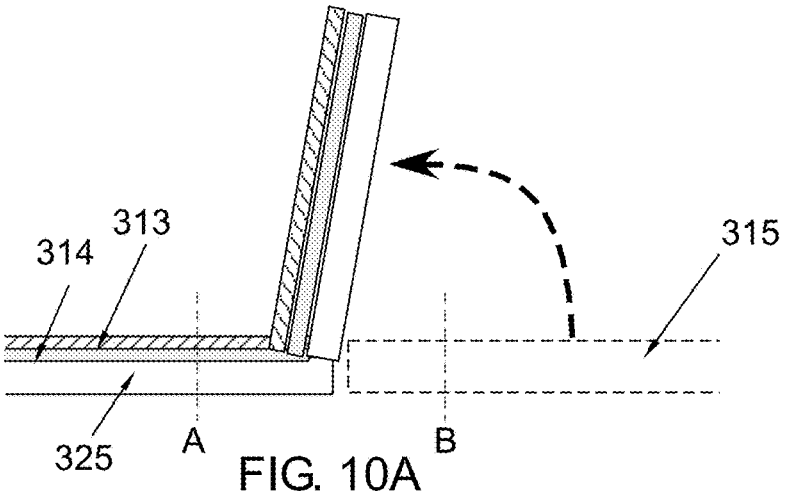
FIG. 10A illustrates a substrate incorporating heat-shrinkable being heated, causing an adjacent hinged substrate to change angle.
Figure 10B:
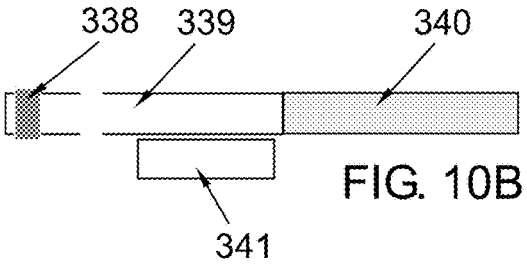
FIG. 10B shows a heat-shrinkable polymer attached to another substrate.
Figure 10C:
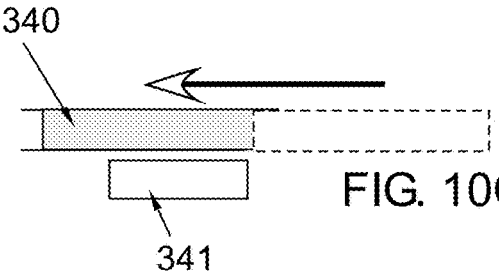
FIG. 10C shows an heated heat-shrinkable polymer pulling an adjacent substrate to the left.

FIG. 10B shows a food container 320 containing food 319, where a tensioned substrate 316 with an 'at rest' angle of, say, 45 degrees, is covering the aperture of said container 320, and is prevented from lifting up in angle by an area of heat-shrinkable polymer material 317 which is attached to a lip 318 of said food container 320.

In one possible design approach, the substrate-restraining area of said heat-shrinkable polymer material 317 incorporates susceptor material, which might for example take the form of small 'dots' or areas of susceptor material distributed over the area or volume of said polymer material, the size or other properties of which would help to determine the amount of time which would elapse after the microwave oven within which the food container 320 shown is located is switched on—until said polymer material would shrink sufficiently due to heating to release said tensioned substrate 316.

The configuring of properties of said polymer material could alternatively, for example, be used to provide the same desired length of time-delay—for example, by changing the volume or mass of said polymer material, thereby affecting the time which will elapse after the microwave oven is switched on until said polymer material heats up sufficiently to shrink, and to release said tensioned substrate 316.

An optional, alternative means of heating said heat-shrinkable polymer is to provide one or more antennas 321 connected to resistive heating material 322 in or adjacent to said area of heat-shrinkable polymer material. A switching or timing means would apply electrical power from said antenna(s) to heat said resistive heating material, which would heat up and cause to shrink said polymer material, thereby releasing said tensioned substrate 316.

It should be pointed out that the above restrain >release means are only two examples of almost countless means of achieving the same purpose, well-known to those skilled in the art. In addition, for example, any of the novel shape-changing actuators disclosed in this document could alternatively be used to first restrain, and to then release, a tensioned substrate such as that shown in these drawings.

FIG. 4D

FIG. 4D shows that the area of heat-shrinkable polymer material 317 has shrunk in its dimensions, from 'A' to 'B', thereby no longer restraining said tensioned substrate 316—and said substrate 316 has moved to its 'at rest' angle of, say, 45 degrees, or 90 degrees to the surface of the food 318.

Thus, if for example, said tensioned substrate 316 incorporated a distribution of susceptor material over its area, then if its 'at rest' angle was about 45 degrees difference with the horizontal, that would cause the 'grilling' or heating effect of microwave-exposed said susceptor material in said substrate 316 on adjacent areas of the food 319 shown to be at least reduced in intensity or strength—perhaps to a low or moderate level of 'grilling' or heating that was required. If the 'at rest' angle of said substrate were instead vertical 322, then said heating effect on said food 319 would probably cease completely.

As a simple example of how the substrate 316 could, if desired, be prevented from rising in angle more than, say, 10 degrees, there could for example be a physical obstacle 323 (as shown in FIG. 4C) attached to the lip 318 of said food container 320 to achieve that purpose.

If such a physical obstacle 323, which would not shrink due to heating (e.g., a right-angled plastic injection item) had been provided in FIG. 4D for example, the substrate 316 might have been restricted to rise only by 10 degrees 324—thereby for example only thereby reducing the susceptor-generated heating effect on adjacent food 319 by a moderate amount.

Thus, either for example by providing different 'at rest' angles for the substrate, or by for example providing a physical restriction on the angle to which the substrate 316 can (in this example) rise, the amplitude or intensity of the heating effect of microwave-exposed said susceptor material on adjacent food can be controllably varied, by controllably varying the distance between said microwave-exposed susceptor material in said substrate 316 and adjacent food 319.

If instead said substrate 316 incorporated a distribution of microwave-obstructing material, then there might be little difference in the intensity of microwaves reaching the food shown between a substrate angle of 45 degrees or 90 degrees to the surface of the food 320. If however instead, the substrate 316 were for example restricted by a physical obstacle such as that shown in FIG. 4C 323 to only rise by 10 degrees in angle 324, or had an 'at rest' angle of such, then the rise in angle from the horizontal by a substrate incorporating (e.g.) aluminum foil to such an angle would serve to cause a relatively low intensity of microwave heating of the food 319 contents compared with if the substrate were vertical.

By such means, for example, as well as many others, the intensity of microwaves—or the amplitude of susceptor-generated heat—which reaches the food 319 can be controllably varied, during the time that the microwave oven within which said food container 320 is located remains switched on.

Figure 5B:
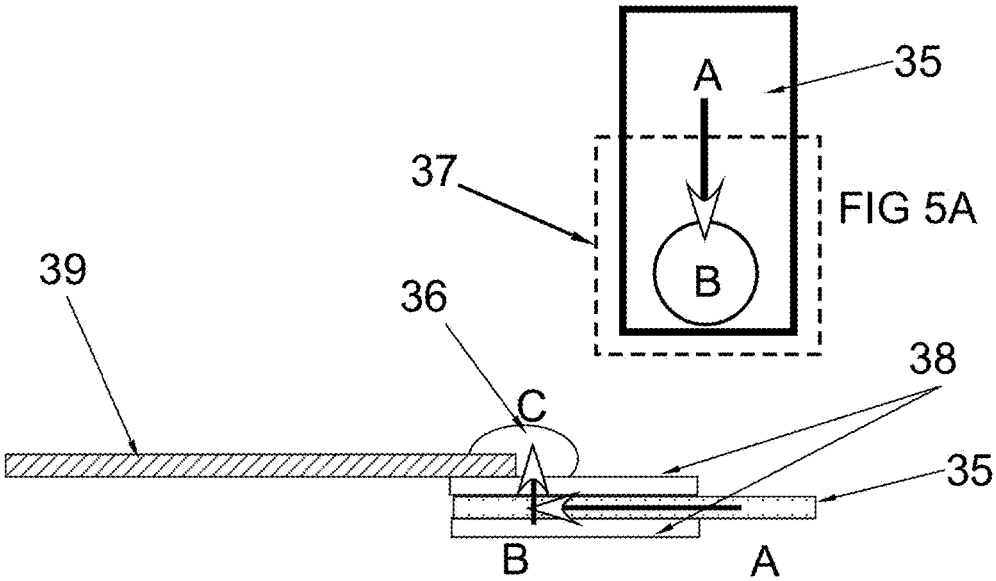
FIG. 5B provides a cross-sectional view of the time-delay means shown in FIG. 5A, illustrating how the heat conducted over an area serves as a time-delay means to release a tensioned substrate 39.

FIGS. 5A and 5B

Many of the inventions disclosed in this document in certain situations require a timing or time-delay facility to be incorporated with them, to execute their particular function a certain amount of time, for example, after the microwave oven within which they are located is switched on.

FIGS. 5A and 5B show a schematic drawing of one example among the many possible means of providing a 'time delay' function in a switched-on microwave oven, which can be used to control the timing of the triggering or actuation of actuators, or of many other functions which are performed by the inventions disclosed in this document.

The function of the arrangement shown in 5A and 5B is to delay some event (in this example, the melting of a wax droplet) in order to (in this example) release the tensioned substrate shown in FIGS. 4A and 4B) an approximate amount of time after the microwave oven within which this apparatus is located is switched on.

FIG. 5A is a schematic plan view of this arrangement, and FIG. 5B is a schematic cross-sectional view of the same arrangement. In the particular example, variation of the time that it takes for heat generated by microwaves heating susceptor material to be conducted across or through an area of heat-conducting material 35 serves as the means to determine the approximate amount of time which will elapse after the microwave oven is switched on that the wax droplet will be melted.

In FIG. 5A, a rectangular area of heat-conducting susceptor material 35 is shown. This area of material might for example be an area of aluminum on a polymer (e.g. PET) substrate. A portion of said heat-conducting material 35 represented by a dotted rectangle 37 is shielded from microwaves—for example by aluminum foil substrates 38 provided above and below the heat-conducting substrate 35 as shown in FIG. 5B.

As soon as the microwave oven is switched on, the area of susceptor material 35 which is exposed to microwaves will start to heat up due to microwaves, while the remainder of the heat-conducting strip 37 will be initially relatively cool, due to said microwave shielding.

The heat from area 'A' will be conducted at a fairly predictable speed from area 'A' to area 'B' of the heat-conducting (e.g.) substrate 35, and will then be conducted (in this particular example) through the microwave shielding material at 'B' to heat the material acting as a fastening means restraining (in this example) a tensioned substrate 39 from being released to change its shape, angle, location or other properties.

When the temperature of the wax droplet 36 (or other alternative suitable fastening means) is heated to a certain temperature, it will melt or liquefy, and release the tensioned substrate 39.

In this particular example, a wax droplet which does not incorporate susceptor material is used as the fastening means securing the tensioned substrate. The wax droplet could for example be replaced by the heat-shrinkable area of material shown in FIGS. 4C and 4D. Any suitable and cost-effective device or area of material which changes its shape, dimensions, angle or other properties when a certain temperature is reached, for example, could alternatively be used to release said tensioned substrate, including for example the other novel actuators disclosed in this document.

The variation of the distance from Area 'A' to Area 'B', or of other controllable variables such as the heat-conducting or susceptor properties of the materials shown 35, 37 can be used to determine the approximate amount of time after the microwave oven is switched on which will elapse before the wax droplet 36 (in this particular example) melts or liquefies, and releases the tensioned substrate.

Although in the example shown in FIGS. 5A and 5B, this time-delay apparatus is used to melt a wax droplet to release a tensioned substrate such as that shown in FIGS. 4A and 4B, the principles used in the novel time-delay means shown here could be used as a time-delay means to control the actuation of many other kinds of actuator means, for example, including all of the novel inventions disclosed in this document which employ an actuator means.

FIG. 6

Figure 6:
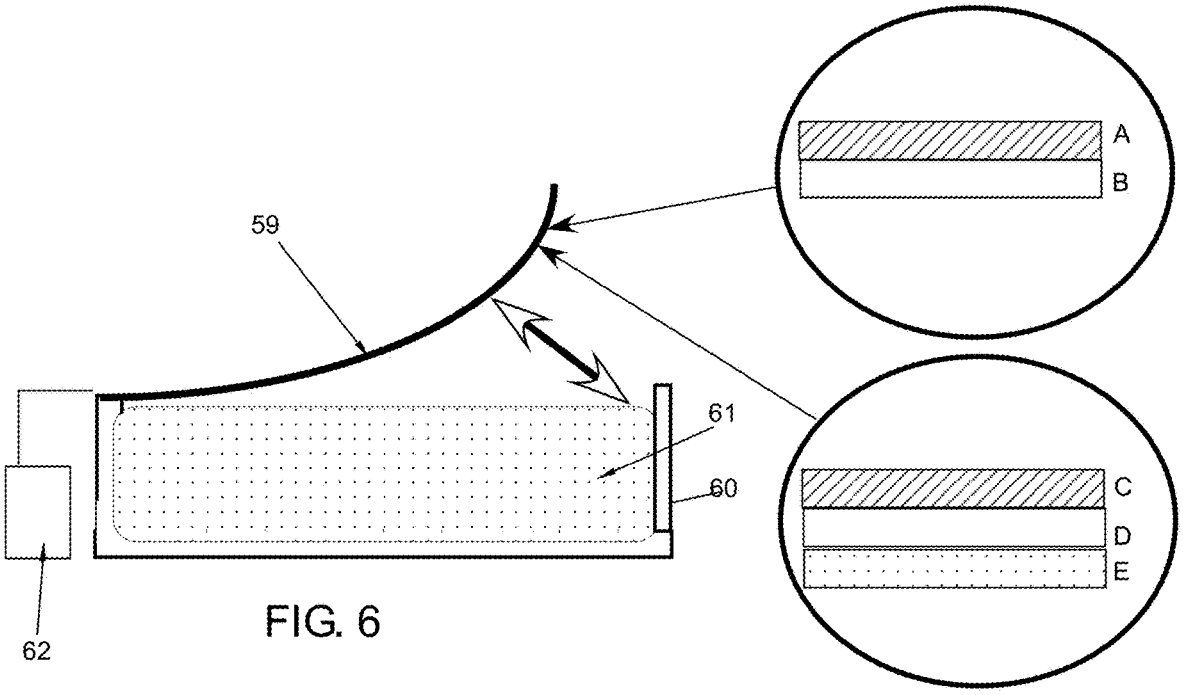
FIG. 6 illustrates a food container with an angled movable substrate 59 rising, or alternatively descending, above the container, with an insert showing examples of different materials which could serve as actuator means in that movable substrate.

FIG. 6 shows a food container 60 containing food 61 with a substrate 59 lifting up from (or alternatively, descending downwards towards) the upper surface of the food 61 shown.

There are very many already existing technologies and actuator types, well-known to those skilled in the art, other than the various different novel actuator means disclosed in this patent application, which could be used to cause a substrate or other item to change its shape, location, angle or other properties, so as to achieve the inventive purposes and functions described in this document.

The different (inset drawings) in FIG. 6 show multiple layers or substrates of different materials which could be incorporated in a movable substrate serving to achieve the change of location, angle, shape or other properties of substrates which are described in this document as performing various different functions.

There are so many different arrangements of different types of material which could be used to make the substrate 59 serve as an actuator means to change its shape or other properties that it is only practical to provide a small number of examples of such different possible arrangements, as listed below, to be used in a switched-on microwave oven.

Example 1

Layer/substrate A: a non-susceptor heat-shrinkable polymer material; Layer/substrate B: a microwave-obstructing material—e.g., aluminum foil—which does not heat up due to microwaves.

Layer/substrate C: a distribution of resistive heating material connected to one or more antennas incorporated in a (in this example) food container.

With this approach, a suitable switch means applies electrical power from said antenna(s) to said resistive heating material in layer/substrate C, heating it up. That heat is conducted through layer/substrate B to heat up layer/substrate A, causing it to shrink. Due to layer/substrate B not shrinking due to heating, differential thermal strain can be used to cause the substrate to bend or lift upwards in terms of FIG. 6, or to scroll up.

Using this approach, if the microwave-obstructing (i.e., due to layer/substrate B) substrate 59 was horizontal, covering or filling the aperture of the microwave-shielded food container 60, it would obstruct microwaves from reaching the food 61 shown until such time as electrical power is applied to said resistive heating material in layer/substrate C, causing said substrate 59 to rise up or curl-up, thereby (as just one example of an application of this arrangement) exposing the food 61 to microwaves, causing said food 61 to then be heated or cooked.

If, alternatively, said substrate 59 had initially not be positioned over the aperture of the food container 60 shown, but had instead been for example scrolled-up to (say) the left-hand side of aperture of the food container 60 shown, or had been angled (for example) vertical above the left-hand side of the aperture of the food container 60 shown, then an alternative arrangement, for example, could be used, as provided in Example 2.

Example 2

Layer/substrate A: a microwave-blocking material—e.g., aluminum foil;

Layer/substrate B: Layer/substrate B: a distribution of resistive heating material connected to one or more antennas incorporated in (for example) a food container.

Layer/substrate C: a heat-shrinkable polymer material;

Layer/substrate A: a microwave-blocking material—e.g., aluminum foil;

In this arrangement, the application of electrical power via a suitable switching/timing means from said antenna(s) to layer/substrate B can be used, for example, to cause said substrate 59 to lower itself (in terms of this drawing) or un-scroll itself so that it descends to be horizontal over the aperture of the food container 60 shown in FIG. 6—thereby for example causing at least most microwaves in the microwave oven within which this food container 60 is located to be obstructed from reaching the food 61 within the container 60.

Example 3

Two materials with vastly different coefficients of thermal expansion can be used to employ the differential thermal strain resulting from heating those materials to change the shape of the substrate 59. One of many possible arrangements using this technique would be:

Layer/substrate A: a microwave-blocking material—e.g., aluminum foil;

Layer/substrate B: Layer/substrate B: a low thermal coefficient of expansion material bearing a distribution of resistive heating material connected to one or more antennas incorporated in a food container.

Layer/substrate C: a material with a high thermal coefficient of expansion

This arrangement could for example be used where the substrate 59 was initially (i.e., as manufactured and sold) secured covering the aperture of an (e.g.) aluminum foil food container 60, so that microwaves would not (at least, to any significant degree, depending on the precise arrangements used) reach the underside of the substrate 59 while the substrate was in that location.

Once electrical power is applied to said resistive heating material, causing layer/substrate C to expand, thereby lifting the 'combined substrate' 59 above the aperture of the food container 60, microwaves would tend to add to the heating effect on said resistive heating material, which would continue to rise/bend upwards/scroll-up.

If this method were used to change the shape or other properties of the substrate 59 from a position or shape where the underside of the substrate 59 is exposed to microwaves, then an additional (layer/substrate D) of (e.g.) aluminum foil can be added, to prevent said resistive heating material from being heated by microwaves, which would otherwise cause an undesired change of shape or other properties in said substrate.

It should be understood that the actuators described in this patent application can be used in a switched-on microwave oven for many purposes apart from obstructing or not obstructing microwaves, or moving susceptor material. Some of these uses or missions of such actuators need protection against microwaves, and some do not.

For example, if it is desired that a substrate is changed in its shape, angle or other properties by microwaves as soon as (or very soon after) the microwave oven is switched on, then shielding against microwaves is not needed. The arrangements for such a actuator might for example simply be two layers or substrates of material:

Example 4

Layer/substrate A: heat-shrinkable polymer material incorporating susceptor material, or with susceptor material which will heat up due to microwaves provided adjacent to it.

Layer/substrate B: a material which does not shrink in response to heating—or which shrinks substantially less than layer/substrate A due to heating.

This structure of substrate could also be used in a time-delayed situation—where restraining means such as those shown used for tensioned substrates could be used to restrain the above said substrate, until the time that it was desired to let me move further.

There are many situations where it could be useful for a substrate to change shape or other properties almost as soon as the microwave oven is switched on. For example, as a steam release vent. It may be desired for a food container to remain sealed, until it is located in a switched-on microwave oven. Using any of the shape-changing actuators introduced herein, for example, a section of the substrate covering the aperture of a food container could be caused to 'lift up', or 'scroll up' as shown elsewhere in this document. Different means whereby this 'venting door' could be freed from areas of substrate around it, to enable it to change shape or other properties, are disclosed in this document.

As another example, layer B could be aluminum foil, blocking microwaves. It could either 'lift up' or 'scroll up', for example, very quickly after the microwave oven is switched on—or it could be prevented from rising by a time-delay means (examples of which are described used for restraining tensioned substrates), so that it would only be allowed to (e.g.) rise and lift-up or scroll-up some pre-determined approximate amount of time after the microwave oven is switched on.

Or the same as above could instead incorporate susceptor material in substrate B—which could be similarly delayed from rising for a pre-determined period of time after the microwave oven is turned on. Or layers A and B could be reversed—so that said susceptor-bearing or microwave-blocking substrates could be caused to descend (e.g., from a raised or vertical angle) to a horizontal angle above the food surface X amount of time after the microwave oven is switched on. These examples are, clearly, only a tiny proportion of the possible uses of the above described substrate-actuation arrangement.

Example 5

Layer/substrate A: a material which does not expand due to heating, or which expands substantially less than layer/substrate B, or which is microwave-transparent.

Layer/substrate B: a material which expands substantially in response to heating by microwaves— where either layer A or layer B (or both) incorporate susceptor material.

In this type of arrangement, the substrate 59 shown would bend, angle or curl upwards in terms of FIG. 6.

Clearly, the above examples are only a few of the many possible arrangements of different layers of material by which a substrate can be caused to change its shape or other properties.

Optionally, many different combinations of different novel actuators disclosed in this document can be used to provide for example a two-way or bi-directional actuator—so that for example a substrate could first rise up from being positioned horizontal immediately above food in a food container—and could then later be caused to move back towards is original position or state.

FIG. 7A

Figure 7A:
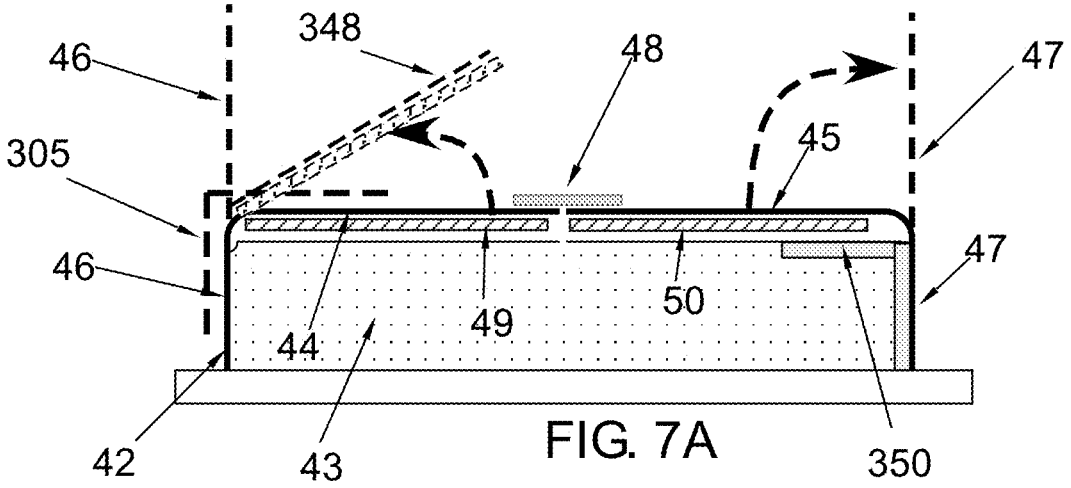
FIG. 7A illustrates a food container with restrained tensioned lids, which when freed to move, change angle, thereby for example exposing food to microwaves, or ceasing to grill the food with susceptor-generated heat.

In FIG. 7A, there is a food container 42 containing food 43 with vertical walls 46, 47 which have been effectively bent over to form tensioned horizontal 'doors' 44, 45 or lids, where tension in those substrates is such that the 'doors' would move to their 'at rest' (e.g.) vertical angle 46, 47 if they were free to do so—or would move towards their 'at rest' angle until an obstacle prevents them moving further in that direction 348—but where they are prevented from doing so by any suitable restraining or fastening means, which in this example is an area of material 48 secured to both 'doors' 44, 45. When the fastening or restraining means 48 is for example severed or sufficiently weakened, the tension in the doors 44, 45 will cause them to move to their 'at rest' angle of being vertical 46, 47.

Attached to said 'doors' 44, 45 in this particular embodiment, there might be other substrates 49, 50 of suitable material(s), according to the particular purpose or function to be performed—which might for example include paper board substrates.

The opening or closing of the 'doors' 44, 45 in this food container 44 could for example provide the same functions of thereby controllably changing the amplitude of microwave or susceptor-generated heating of the adjacent food 43 as has been explained, above—for example with reference to FIGS. 4A and 4B, providing either susceptor material or microwave-obstructing material in said 'doors' 44, 45 or in material—e.g., paper board—attached to said doors.

There is are two other, alternative novel actuators shown in FIG. 7A. The right-angled dotted lines at the top left corner of the food container 42 are used to indicate an alternative arrangement whereby the left-hand 'door' 44 of the food container 42 could be caused to open, if the container shown did not incorporate said tension-based forces.

If a substrate incorporating heat-shrinkable polymer was attached to the vertical and horizontal sections of the left-hand side of the food container in the locations indicated 305, then if said heat-shrinkable (e.g.) polymer substrate was heated and thus caused to shrink, this could be used to cause the left-hand 'door' to be opened to—for example—a vertical angle 46.

If there was a suitable distribution of susceptor material (e.g., carbon black, or a thin layer of aluminum) adjacent to said heat-shrinkable polymer substrate, then soon after the microwave oven within which said container 42 is location is switched on, said substrate would heat up and shrink, and the left-hand door would be opened to a vertical angle, for example. This action could be delayed by providing for example microwave-shielding adjacent to said area of susceptor material, or by reducing the quantity or changing other properties of said susceptor material.

If, alternatively, said food container 42 incorporated one or more antennas converting microwaves into electrical power were connected to a suitable distribution of resistive heating material which replaced said area of susceptor material adjacent to said heat-shrinkable polymer material described above, then if there was a suitable timing and power-switching means, said left-hand 'door' 44 could be caused to open as explained elsewhere in this document at any desired stage of the time that said food container 42 is in a switched-on microwave oven.

If, alternatively, the above said areas of susceptor or resistive heating material had instead been attached to the inside of said left-hand 'door' 44 and the inside face of the left-hand vertical wall 46 of said container 42, then if said 'door' 44 was for example vertical in angle, the heating of said heat-shrinkable substrate could be used to 'close' said 'door' 44 to a (e.g.) horizontal angle.

The other alternative novel actuator means 350 shown here is located at the right-hand top area of the food container shown. This 350 is simply a different embodiment of the pneumatically-powered actuator shown in FIGS. 12A, B and C—(see explanation there), where heating from adjacent susceptor or resistive heating material causes one or more cavities formed between (for example) two polymer substrates to expand—thereby (in the example shown in FIG. 7A) opening the 'door' 45 from for example its current horizontal angle to a vertical angle.

Important to note is that in this and other drawings in this document, movable substrates and the like are often shown moving from A to B in angle, location or other properties as if they might 'snap' from one angle or location to the other, the movable object could instead be moved to any desired intermediate position with the locations or angles shown—and the movement, in the case of many actuator types, could for example be slow and progressive, rather than rapid, and (taking FIG. 7A as an example), the change of angle of a substrate (particularly in the case of non-tension-release actuator types disclosed in this document) could be smooth, relatively slow and progressive, moving to any desired angle. Taking the pneumatic actuator 350 or the heat-shrinkable actuator 305 as examples, the properties (for example) of susceptor material used in said actuator types could be used to only slowly heat the materials used in these two types of actuator, so that they only slowly changed shape. Equally, if moving to a desired angle were not achieved by presenting a physical obstacle to the further movement of the movable substrate, if antenna-generated electrical power were employed as the heating means in either of these two actuator types, said heat could optionally for example only be applied for a limited period of time—thereby causing the actuator to only change the angle of the applicable substrate to a desired approximate extent.

Figure 7B:
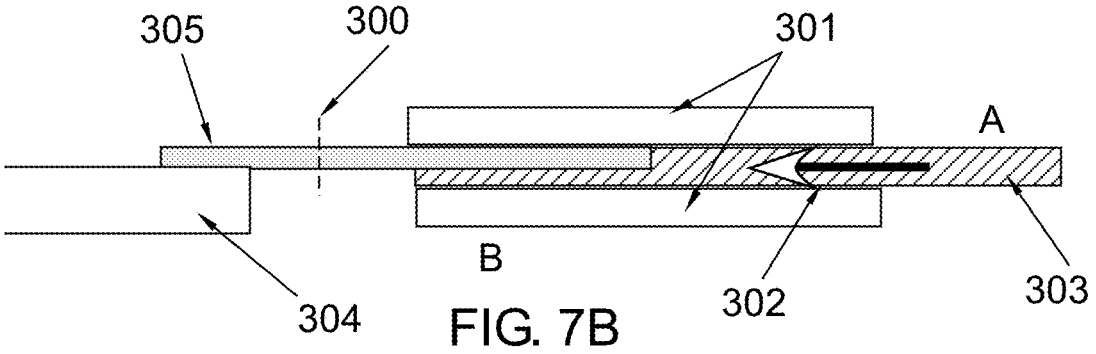

It should be emphasized that although in FIGS. 7A and 7B, the movable 'doors' are shown changing between vertical and horizontal angles, they could all, if desired, be caused to stop moving, after being released from their restraining means, at any desired angle, simply by providing any suitable obstacle along their route of movement to prevent them moving further towards their respective 'at rest' angles—using an obstacle such as is for example provided by item 323 in FIG. 4C—thereby for example for example providing a wide range of different possible amplitudes or intensities of microwaves or susceptor-generated heat reaching adjacent food in a switched-on microwave oven.

Examples of 'doors' in FIG. 7A thus being moved to any desired angle are shown for example in the case of the left-hand 'door' 44 which has been prevented from rising further than perhaps 45 degree 348 by any suitable obstacle (not shown) or restraining means acting on it to prevent further movement towards its 'at rest' angle of, say, being vertical.

Figure 7C:
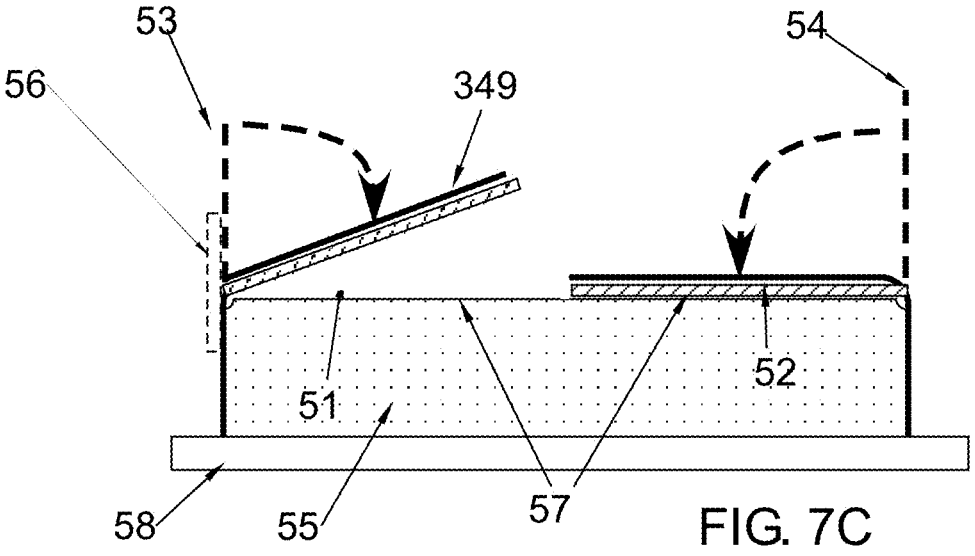
FIG. 7C illustrates a food container with tensioned lids which will descend when restraining means releases them.

Similarly, in FIG. 7C, the left-hand 'door', after being released from restraining means, has been prevented from descending to its 'at rest' angle of (for example) horizontal by any suitable obstacle (not shown), so that it will not descend further than the angle above horizontal, shown.

If said 'door' incorporated or had attached to it (e.g., a susceptor film and perhaps paperboard substrate) a distribution of susceptor material, then preventing said left-hand door from descending further towards the horizontal could for example to only expose the food contents 55 of the container to a certain level of susceptor-generated heating, while also exposing said contents to a certain level of microwave heating. Or of course, instead of an obstacle preventing said left-hand door descending to the horizontal, the angle of the 'door' shown 349 might be its 'at rest' angle. It should be noted that if desired, said obstacles preventing a tensioned substrate or other item from continuing to move towards the 'at rest' state could first prevent such movement—and then later, could be caused by actuator means to release the tensioned item.

It should be emphasized that while tension in the above said materials, and the controlled release of said tension, is used in the above examples, the same kinds of controlled movement of substrates or other items could alternatively be achieved using any of the novel actuators disclosed in this document—or any other types of actuator well-known to those skilled in the art.

Figure 12A:
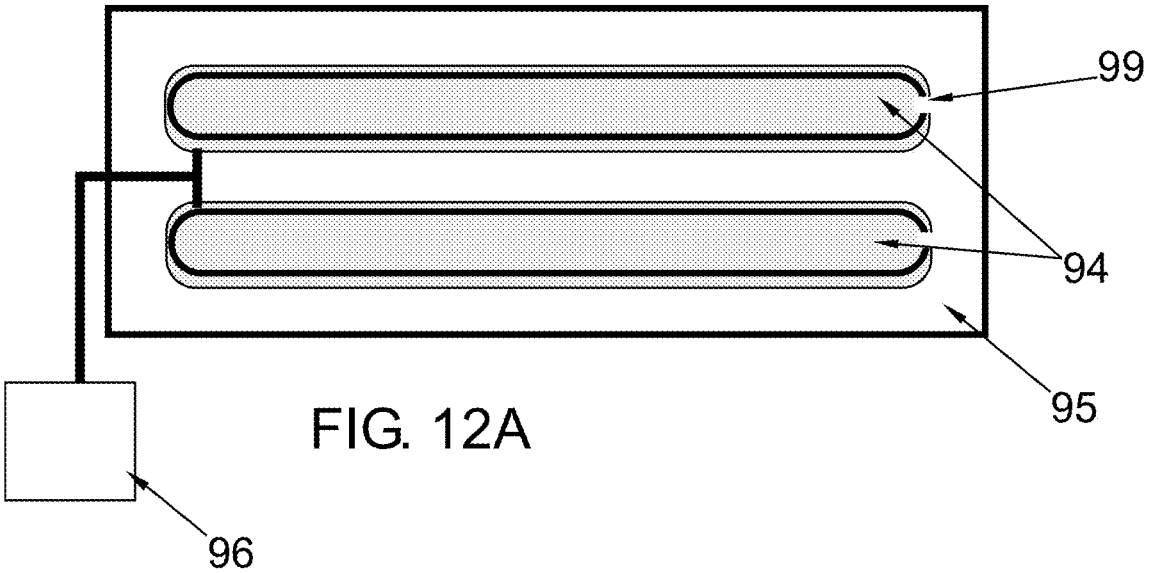
FIG. 12A illustrates two cavities with adjacent heating means in a combined substrate.

As an example of other novel actuator types disclosed in this document which could alternatively have been used to change the angle or other properties of substrates or other items shown in this drawing, a pneumatic actuator 350 is shown adjacent to the right-hand 'door' 45 of the food package shown, which employs the same novel actuator principles as are explained in reference to FIG. 12A, where air in one or more sealed cavities is heated, thereby (in this example) causing the adjacent right-hand 'door' in FIG. 7A to open. One or more sealed cavities or cells formed (for example) between two substrates could be heated by microwaves heating susceptor material adjacent to said sealed cells, or one or more antennas could apply electrical power to sealed cell-adjacent resistive heating areas to achieve the inflation of said one or more sealed cells, thereby applying force to said 'door' 45 to open.

An example of a different novel actuator means disclosed in this document, which could be used instead of the tension-release actuator approaches described above, is shown with the right-angled dotted lines in the drawing adjacent 305 adjacent to the left-hand vertical wall 46 of the container, and the left-hand 'door' 44—which represents a heat-shrinkable polymer substrate attached to said vertical wall 46 and the left-hand 'door' 44, adjacent to which substrate is a substrate or layer incorporating susceptor material, or alternatively resistive heating material connected to one or more antennas (not shown). Microwaves in the switched on microwave oven containing the container shown would heat said susceptor material, thereby heating and shrinking adjacent heat-shrinkable polymer material—which would thereby serve to open the left-hand 'door' 44. Alternatively, electrical power generated by one or more antennas (not shown) would be applied to said resistive heating material, achieving the same function.

FIG. 7B

FIG. 7B is a schematic drawing showing a different time-delay means usable to control for example the timing of the release of tensioned substrates to move towards their 'at rest' state, or to release tensioned 'doors' 44, 45 such as those shown in FIG. 7A, which could be used instead of the area of material 48 shown at the intersection of the 'doors' 44, 45 in Figure to release said 'doors' 44, 45 a controllable amount of time after the microwave oven within which this food container 42 shown is located, is switched on.

In FIG. 7B, there is a substrate or area of material incorporating heat-conducting susceptor material (e.g., aluminum on a PET substrate) 303 which is sandwiched between two substrates or areas of material 301 which are microwave-obstructing—e.g., aluminum foil.

If the heat-conducting material is for example a layer of aluminum on PET substrate, both of these different items are nevertheless represented by a single rectangle 303 to keep this schematic drawing simple and clear.

An additional element in this arrangement is a substrate incorporating heat-shrinkable polymer, which in most possible embodiments does not contain susceptor material. In this particular embodiment and example, the right-hand portion of said heat-shrinkable substrate is located between said two layers or substrates of microwave-obstructing material 301, and the left-hand portion of said heat-shrinkable material is attached to the left-hand 'door' 44 of FIG. 7A, and the 'combined substrate' 301, 303 is attached to the right-hand door 45 in FIG. 7A. Thus, the whole arrangement shown here is the restraining means 48 shown in FIG. 7A.

When the microwave oven within which all of the above said items are located is switched on, the right-hand area of the heat-conducting susceptor material substrate 303 in FIG. 7B, being exposed to microwaves, becomes hot. The area of that heat-conducting substrate sandwiched between the microwave-obstructing substrates 301 does not become hot due to microwaves.

The heat generated in the area 'A' of said heat-constructing substrate 303 is conducted 302 over a fairly predictable amount of time to the other end of that area of material marked 'B', thereby causing said heat-shrinkable substrate 300 to heat up and to shrink.

There is in this particular embodiment a pre-weakened (e.g., perforated) location 300 on said heat-shrinkable substrate 300—which is caused to sever or break due to increasing shrinking-induced tension in said substrate 300 as the heat-shrinkable substrate 305 is heated and shrinks.

The tensioned 'doors' 44 and 45 in FIG. 7A are thereupon released, and move to their 'at rest' states, angled vertically 46, 47 above the food container 42.

The arrangement shown in FIG. 7B is thus a time-delay restrain and release system, which is used in this example to cause the movable substrates 44, 45 to change their angles at (for example) a certain stage of the cooking process—and thereby, for example, to allow microwaves to reach the food in the food container 24 shown in FIG. 7A; or alternatively, to cause the 'grilling' of the food 43 in said container 42 to cease, using arrangements of suitable microwave-obstructing or susceptor materials in said 'doors' which have already been explained several times before, above. Moving microwave-obstructing material in said 'doors' would thereby change the intensity of microwave heating in adjacent food; and susceptor material in said 'doors' would change the intensity of susceptor-generated heating of adjacent food.

By changing different properties of the materials or items shown in FIG. 7B, it will be possible to lengthen or shorten the amount of time which elapses after said microwave oven is switched on, before the 'doors' 44, 45 in FIG. 7A, for example, are released to move to their respective 'at rest' angles. For example, the length of the distance between the areas 'A' and of the heat-conducting substrate 303 can be shortened or lengthened, to provide different lengths of time delay.

This time delay means, or alternative embodiments of it using the same novel design principles, can be used together with many different types of actuators, for example, which are thereby triggered to move an approximate amount of time after the microwave oven within which they are located is switched on—including many of the novel actuator means disclosed in this document.

FIG. 7C

FIG. 7C is essentially a similar tension-release arrangement to that of FIG. 7A, but with the difference that the tension-powered forces have moved the 'doors' 51, 52 downwards, towards the food from a previously vertical angle.

Apart from the resulting changes in the amplitude of microwave or susceptor-generated heating effects on the food 55 in the container 58 which have been explained many times, above, where either microwave-obstructing or susceptor material is incorporated in the 'doors' 51, 52, this arrangement could also be useful for serving to 'press' susceptor material in or attached to said 'doors' against the outer surfaces of the food—for example to 'sear' those surfaces, or give them grill marks, or the like.

It is important to point out here that although the example shown and discussed here employs the release of tension to change the angle of the doors, any of the other novel actuator means disclosed elsewhere in this document, as well as countless other types of actuator well-known to those skilled in the art, could alternatively have been used instead of said tension means to achieve similar functions of changing the angle of substrates as are shown in FIGS. 5A and 5C.

FIG. 8

Figure 8:
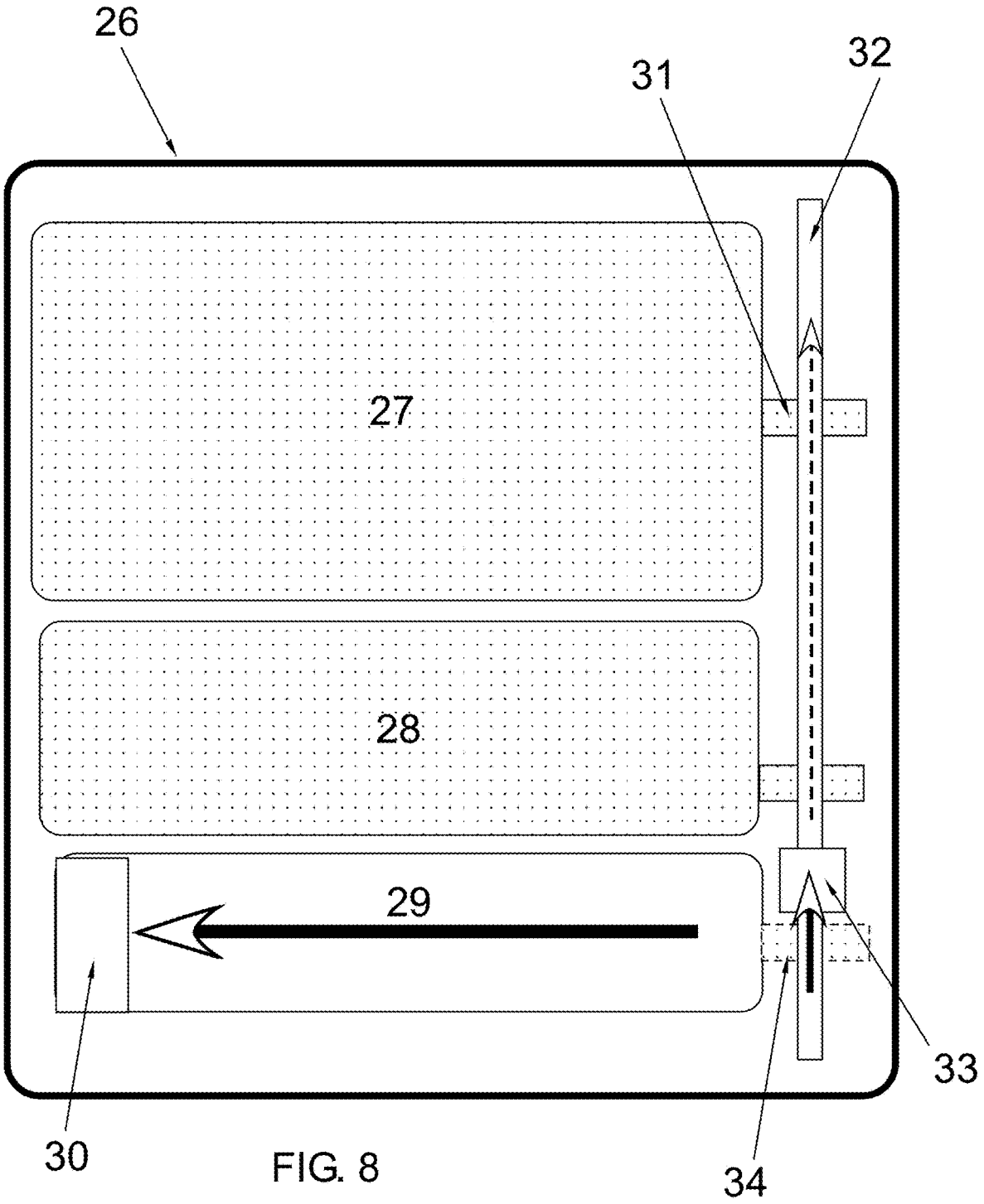
FIG. 8 is a plan view of a food container incorporating three food compartments with tensioned substrates covering them, which will be released by the travelling item 33.

FIG. 8 is a schematic plan view drawing of a food container designed for microwave cooking, using a different approach to achieving the controlled release of tensioned substrates than those already introduced and explained, above.

The food container shown 26 incorporates three separate food compartments 27, 28 & 29. Covering the apertures of the upper two containers or compartments 27, 28 shown are tensioned substrates which are restrained from scrolling-up or otherwise moving to their respective 'at rest' shapes at (in this example) the left-hand side of each food compartment by, in this example, extensions or tabs 31 of said substrates which are fastened by any suitable means to a stable surface on said food container 26.

A movable item 33 is shown on the right-hand side, which serves to sever or sufficiently weaken each said extension or tab 31 of each tensioned substrate when it reaches each one in turn, as it is moved by any suitable actuator means progressively along the track 32 or route shown.

The movable item 33 may incorporate any suitable means of severing or sufficiently weakening said restraining tabs 31. Said movable item 33 might for example incorporate susceptor material, which would be heated by microwaves in the switched-on microwave oven, and which, as the movable item 33 arrives adjacent to the restraining means or tabs of a tensioned substrate 27, 28 could be used to cause the release of the said restraining means tabs 31 due to heating (e.g., melting or burning material providing the fastening means, or de-bonding adhesive material, or simply severing the fastening means, for example), to mention just a few of the many possible methods of releasing the tensioned substrates.

The extension or tab 34 of the lowermost compartment 29 shown has already been severed, weakened, or otherwise caused by said movable item 33 to release that tensioned substrate 29, and it has consequently (for example) scrolled-up towards its 'at rest' state 30 at the left-hand side of that food container 29.

The materials and functions incorporated in and served by said three tensioned substrates, and by their change of shape, could for example be any of those already explained and discussed above, with reference to FIGS. 1A, 1B, 2A and 2B, for example, or disclosed elsewhere herein.

If the actuator means used to move the movable item 33 along the track or route 32 were electrically-powered, for example, one or more antennas converting microwaves into electrical power could be incorporated in this food container to power such an electrically-powered actuator—applied for example to the track 32 which the movable item follows, for example.

In such a case, the movable item 33 could, if desired, perform such functions as using, or making or breaking, electrical circuits provided by suitably located conductive tracks on said food container—for example to heat said extensions or tabs with heated resistive heating material incorporated in the movable item, and thereby for example de-bonding adhesive used to as a fastening means to restrain said tensioned substrates.

The design which is shown in FIG. 8 can provide the functions of cooking food located in said different food compartments for different amounts of time, and in different ways. which are explained above in this document in reference to different designs of food packages, during the time that the food container 26 is located in a switched-on microwave oven.

The main difference with the food container designs introduced above in this document is the movable item 33. The actuator means moving said movable could be something as simple as an elastic band with a speed regulation means, or a spring-driven clockwork-like mechanism, or it could of course be one of any number of different kinds of electrically-powered or other actuator means well-known to those skilled in the art.

Although this design approach may appear very simple, it can however provide a number of very innovative and important cooking capabilities far beyond what current day food packages containing 'microwave meals' can provide. Although the arrangement presented here uses a rectangular shape with a straight track or route for the moving item, it could of course be of any shape or configuration, including for example configured in a circular shape, with a circular track or route for the moving item, where the different food compartments are arranged a little like segments in an orange.

If the movable item 33 was driven by an elastic band or a spring, for example, with a speed regulator, the movable item could be automatically released from restraining means by—for example—a substrate serving as the restraining means preventing the movable item from moving until it is inside a switched-on microwave oven, using for example any of the arrangements disclosed in this document for changing the shape or other properties of substrates or other items due to microwaves heating an item in such substrates—where for example a substrate curling up due to microwaves heating it would serve as the means of releasing the means which up to that time had prevented said movable item 33 from being released.

As a different embodiment of the same inventive approach shown here, there could alternatively be no 'track' or 'route'—but instead, a circular food container could be used, for example, with a number of food compartments arranged a little like the segments of an orange—and in the middle of the upper face of the food container, there could simply be a rotating object incorporating a means of releasing (e.g., cutting, heating, etc.) the (for example) tensioned substrates tabs or extensions adjacent to the rotating (e.g., elastic or spring-powered) object which is automatically released to rotate slowly—like a mechanical kitchen timer—as soon as the microwave oven within which this food package is located is switched on, releasing the different tensioned substrates one-by-one over a period of time, during the time that the microwave oven within which the apparatus shown is located remains switched-on.

FIG. 9

Figure 9:
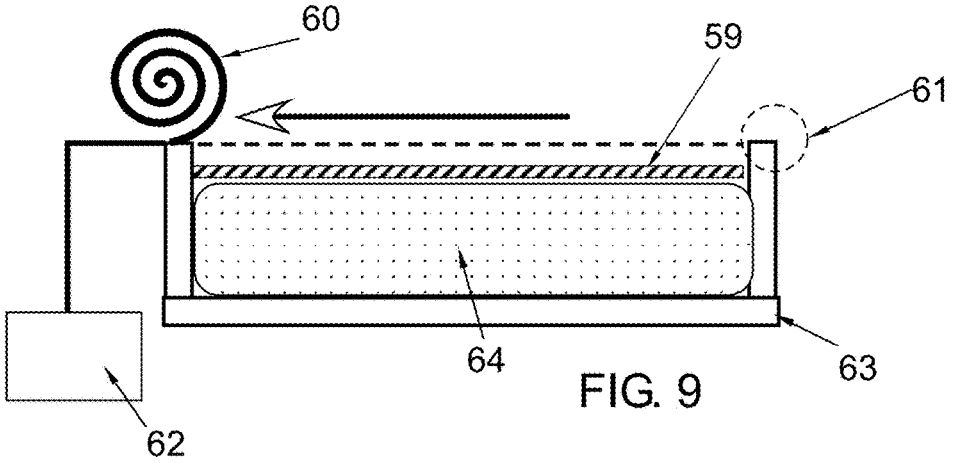
FIG. 9 illustrates a food container with a microwave-blocking substrate which, when it scrolls-up, will expose a susceptor-bearing substrate beneath it to microwaves, thereby 'grilling' adjacent food.

FIG. 9 shows a schematic drawing of a food container containing food 64 with a substrate located adjacent to the top surface of the food 64. Said substrate 59, incorporating a distribution of susceptor material, fills (in this particular example) the area of the aperture of the container An additional substrate 60, incorporating a distribution of microwave-obstructing material over its area, is provided above (in terms of this drawing) said susceptor material-bearing substrate 59, and was, previous to the state shown in FIG. 9, covering the aperture of the food container 64. But said microwave-obstructing substrate 60 has now, as shown in this drawing, been caused to scroll-up to the left-hand side of said aperture, due for example to any of the actuator means disclosed in this document—thereby (in a switched-on microwave oven) exposing the distribution of susceptor material in the lower substrate 59 to microwaves, thereby heating up said susceptor material which in turn heats, cooks or 'grills' at least some portion of the adjacent food 64.

Thus, FIG. 9 illustrates how the controlled movement of the microwave-obstructing substrate 61 can be used to control the heating effect of microwave-exposed susceptor material 59 located adjacent to food.

It is important to note here than the actuator means used to 'scroll up' (or alternatively, to change the angle, location or other properties of the microwave-obstructing substrate, or to 'un-scroll') can optionally be moved to scroll-up, or to un-scroll, to any position between fully exposing the susceptor-bearing substrate 59 to microwaves, and not exposing it to microwaves at all—thereby providing the means of controlling the heat output of the susceptor material on the susceptor-bearing substrate 59.

If for example the (optional) antenna(s) 62 shown were caused by suitable switching and timing means to apply electrical power to said microwave-obstructing substrate 60, where said substrate incorporated means described in this document employing two substrates or layers of vastly different coefficient of thermal expansion, then said electrical power switching means could be used to cause said substrate 60 to only move a certain portion of the distance between fully scrolled-up and un-scrolled—thereby controlling the intensity of microwaves reaching said susceptor-bearing substrate 59, and thereby flexibly controlling the intensity of microwaves reaching adjacent food 64.

The choice of a scrolling-up substrate 60 incorporating a distribution of microwave-obstructing material is merely for the purpose of providing one possible actuator means: any of the novel actuator means which serve to change the shape, angle, location or other properties of a substrate or other item serving the same function as this substrate 60 could alternatively have been used—as could very many other existing different actuators, well-known to those skilled in the art.

The food container 63 is advantageously made of or incorporates microwave-blocking material (e.g., aluminum foil), so as for example to prevent microwaves in the microwave oven reaching the susceptor material-bearing substrate 59 when the microwave-blocking substrate 60 is still filling the aperture of the food container 63.

At the right-hand side of the aperture of the food container 63 is shown one possible location 61 where, if the substrate 60 was a tensioned substrate, a restraining and release means such as is disclosed elsewhere in this document could be provided.

FIG. 10A

FIG. 10A shows how a heat-shrinkable layer or substrate can be heated and caused to shrink, and thereby caused to change the angle of a hinged or adjacent substrate 315. The substrate shown has a layer or substrate of heat-shrinkable polymer on top. The next layer down is either a susceptor material-bearing substrate or layer, or substrate or layer incorporating resistive heating material. The rest of the substrate might be for example paper board, or polymer material. Preferably, the top heat-shrinkable layer or substrate is not attached to the rest of the substrate between 'A' and 'B'. When the susceptor or resistive heating material 314 is heated, it causes the adjacent substrate or layer 313 of heat-shrinkable polymer to shrink—thereby pulling the adjacent substrate 315, physically connected to it, to be pulled upwards in angle.

FIG. 10B

The purpose of FIG. 10B is to provide examples of the very many possible uses of heating an area of heat-shrinkable polymer material to serve as an actuator means in a switched-on microwave oven.

A substrate of heat-shrinkable polymer material 329 is anchored to a non-movable item 338 in a location which in reality may be beyond the left-hand edge of this drawing. Said heat-shrinkable polymer area of substrate is attached to a substrate or area of material 340 which is, in this particular example, not heat-shrinkable.

FIG. 10C

When said heat-shrinkable polymer area 339 of material shrinks due to heating (for example, due to microwaves heating susceptor material in or adjacent to the heat-shrinkable material) it moves to the left (in terms of his drawing) towards the anchor point 338, pulling the right-hand substrate or sector of substrate which does not shrink 340 similarly to the left.

If for example the item 341 below said two substrates is an antenna with a microwave-blocking substrate provided underneath it, and the heat-shrinkable polymer material is microwave-transparent, then the antenna would be generating electrical power, and could be applying it, for example, to a resistive heater in the food container within which this apparatus is located.

If the right-hand substrate material 340 is a microwave-blocking material, the heat-induced shrinking action of said heat-shrinkable polymer would in a switched-on microwave oven stop microwaves from reaching said antenna 341, thereby stopping it applying electrical power to any device or item in a food container to which it is connected. And of course, the same approach could similarly be used to expose the antenna 341 to microwaves, if the microwave-blocking and microwave-transparent sectors 340 & 339 were reversed in location.

If by contrast, the lower item 341 represents the aperture of a food container, and if the left-hand side heat-shrinkable material 339 is microwave-transparent, and the right-hand substrate or area of substrate 340 incorporates susceptor material, then when the susceptor material-bearing sector 340 of the substrate is pulled to the left by the heating-induced shrinkage of the heat-shrinkable polymer material 339, then food in said food container located adjacent to said aperture of a food container would be heated or 'grilled' by said microwave-exposed susceptor material.

FIG. 11A

Figure 11A:
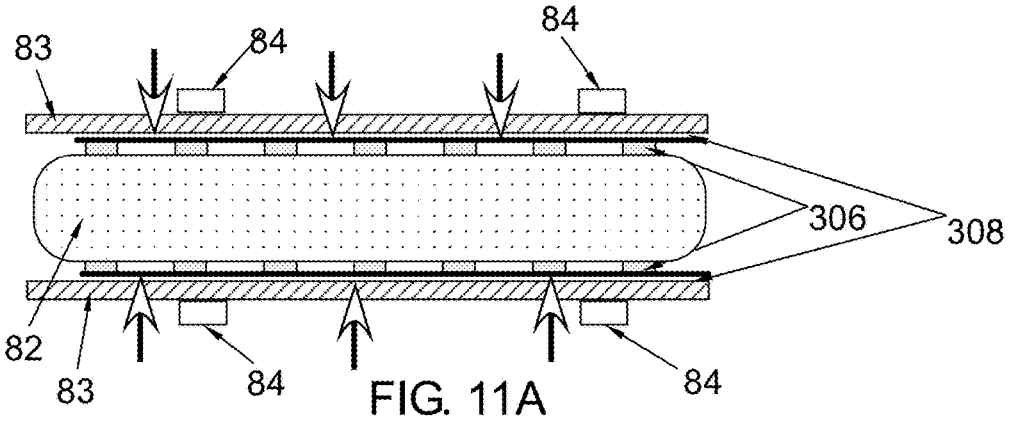
FIG. 11A illustrates heat-shrinkable polymer used to press susceptor material towards or against outer food surfaces.

The schematic drawing shown in FIG. 11A shows an arrangement to be used inside a switched-on microwave oven, where a food item 82 is located within a flexible sleeve of material 83 incorporating a distribution of susceptor material in said sleeve, or within the area enclosed by said sleeve 83.

In many cases of heating or cooking the outer areas of food using microwave-exposed susceptor material in a microwave oven, good physical contact (or alternatively in some cases, close proximity, but with an air gap) between susceptor material and the outer surfaces of food is desirable for optimal cooking, heating, crisping, browning or searing results. But in many cases, food packaging arrangements using susceptor materials cause the latter to be a less than optimum distance from the outer surfaces of food. These disclosures are designed to use the heating and shrinking of heat-shrinkable polymer material to press susceptor material against, or in the direction of, the outer surfaces of food, to assist in providing optimum heating effects of susceptor material on adjacent outer surfaces of food.

In FIG. 11A, heat-shrinkable polymer material is heated due to microwaves heating microwave-exposed susceptor material incorporated in or provided adjacent to said heat-shrinkable material, and the resulting shrinking action of said heat-shrinkable polymer serves to press or 'squeeze' susceptor material incorporated in, or located within the area enclosed by, said sleeve 83 against, or in the direction of, the outer surfaces of one or more food items located within said sleeve 83.

Said heat-shrinkable material can be provided either outside, or incorporated in, or located within the area enclosed by the sleeve 83, or alternatively can be incorporated in the bands of material 84 shown enclosing the sleeve 83.

Susceptor material—e.g., susceptor film—used to heat or cook food item(s) located within the sleeve (as opposed to susceptor material used to heat said heat-shrinkable polymer material) can be located as desired, either incorporated in said sleeve material, or within the area enclosed by the sleeve, but would preferably in many arrangements be immediately adjacent to the outer surfaces of food, and must in any case be provided closer to the food item(s) than said heat-shrinkable polymer material, so that the latter can, when caused to shrink by heating, press said susceptor material against or in the direction of the outer surfaces of said food item(s).

In these different embodiments presented in FIGS. 11A, B and C, materials often used together with susceptor film for example, such as paper board, can be incorporated as required, but are not shown for example in FIG. 11A, so as to keep the drawing sufficiently clear, because there are different possible locations for such materials, and in order to focus on the inventive ideas disclosed here.

A substrate incorporating susceptor material 308—for example, an area of susceptor film—is shown within the flexible sleeve 83, but this is only provided as one example of one of a number of different possible locations for susceptor material used to heat the food item(s). With the exception of the (optional) heat-shrinkable bands shown 84 outside said flexible sleeve 83, heat-shrinkable material in other possible locations outside, incorporated in or within said sleeve are not shown, because there are too many possible places to provide this material, and showing them all would make this drawing unclear and confusing.

In many cases, pressing susceptor material directly against the outer surfaces of food can produce the best cooking results—but in some cases where for example a crisping or browning effect on outer food surfaces is a priority, to maximize infra-red emissions from susceptor material, a poor contact between food and susceptor material, or an air gap between them, can enhance the effectiveness of the crisping or browning of adjacent food.

Thus, one purpose of the inventions illustrated and described here is to provide a means of moving or pressing heated material against or closer towards the outer surfaces of food; another objective is to provide—where required—an optional 'spacer' means of establishing the desired distance between microwave-exposed susceptor material and the outer surfaces of food where that is desired to help provide enhanced efficiency of achieving the desired heating, cooking, crisping, browning or 'searing' operation in a switched-on microwave oven.

A optional layer of material, or a rigid or semi-rigid shaped item 306, optionally with holes in it, can if desired be incorporated in this arrangement to prevent susceptor material from being pressed or 'squeezed' closer than is desired to the food item(s). This 'spacer' item can if required be made of or incorporate a rigid or semi-rigid material to prevent the food item(s) from being 'squeezed' or pressed unduly as a result of the force or pressure exerted by said heat-induced shrinking of said polymer material.

Alternatively, this 'spacer' layer of material or shaped item 306, can be excluded from this arrangement, so that for example the heated susceptor material is pressed directly against the outer surfaces of the food. The thickness of the 'spacer' material or shaped item shown in FIG. 11A is not (as is the case with all drawings in this document) 'to scale' in these drawings.

The broad downwards-pointing and upwards-pointing arrows in FIG. 11A indicate the direction of force being applied by the heat-induced shrinking of said heat-shrinkable polymer material.

Thus, one example of many possible arrangements using the materials described above would be that bands or widths of material 84 which incorporate or have provided adjacent to them susceptor material, are provided outside the sleeve 83 shown. Additionally, a substrate of susceptor film, optionally for example accompanied by a paper board substrate provided adjacent to said susceptor film, is provided on the inner face or within the sleeve of the (e.g., paper board) sleeve shown.

When said heat-shrinkable bands 84 are heated due to microwaves heating susceptor material incorporated in or provided adjacent to said bands or widths of material, said bands shrink, thereby applying force to 'squeeze' the flexible (e.g., paper board) sleeve 83, thereby serving to press said susceptor film against or towards the food item 82 shown.

The heat-shrinkable material might for example alternatively be incorporated in, or attached to the outer surface of, the sleeve material shown. Or it could alternatively be provided inside the sleeve area, with the susceptor material being closer to the outer surfaces of the food item 82 than said heat-shrinkable material. If said heat-shrinkable material is provided within the area of the enclosing sleeve, 83, then the sleeve need not necessarily be flexible.

Optionally, other materials such as paper board substrate(s) could be provided within the sleeve shown, which could serve (for example) to help distribute the squeezing or pressing pressure of the shrinking heat-shrinkable polymer material, and/or to absorb liquids from the heated food item.

Optionally, there could a tear strip or the like to enable the consumer to tear or break the heat-shrinkable polymer material or the sleeve, or said bands 84, after the food item 82 is cooked.

FIG. 11B

Figure 11B:
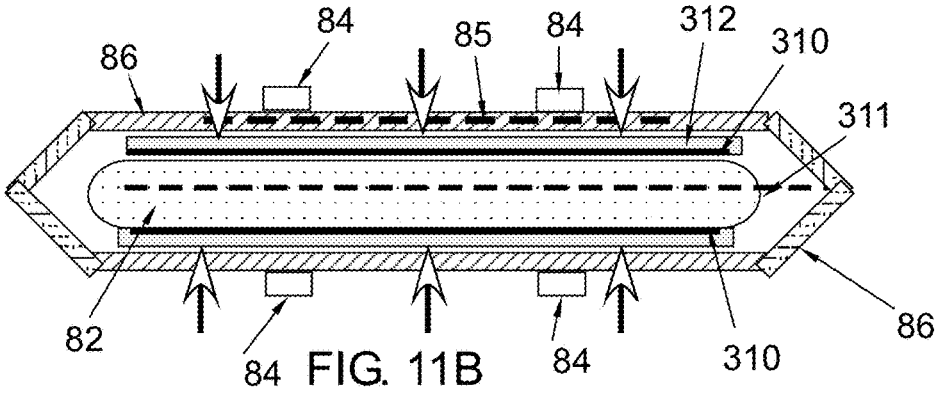
FIG. 11B illustrates a microwave-shielded sleeve with heat-shrink polymer used to press resistive heating material towards or against food surfaces.

FIG. 11B employs the same inventive principle of heating heat-shrinkable polymer material to exert pressure on heated material to be pressed against, or to be pressed towards, the outer surfaces of food item(s) as are shown in FIG. 11A, but with the difference that the food item 82 within the sleeve 86 shown is shielded from microwaves in a switched-on microwave oven.

FIG. 11B shows a food item 82 located inside a food package or food container 86 which incorporates microwave-shielding material (e.g., aluminum foil), preferably incorporated in the food package 86, to prevent microwaves reaching the food item 82 shown.

One or more antennas 85 are provided (for example, incorporated in the flexible sleeve 86) outside the microwave-shielded zone or area, or alternatively separate from and outside the food package shown, with transmission lines leading from said antenna(s) to resistive heaters provided in or adjacent to the packaging 86, or within the area enclosed by the food packaging 86.

Areas of, or substrates bearing, resistive heating material 310 connected to one or more said antenna(s) may be located at any suitable location which is closer to the food product(s) 82 than the heat-shrinkable polymer material. Two resistive heaters 310 with adjacent (e.g.) paper board substrates 312 are shown in FIG. 11B, as one possible location for them, immediately adjacent to and inside said food package 86, above and below (in terms of the drawing) the food product 82.

A further (optional) resistive heating substrate 311 is shown for the sake of example, located within the food item 82, to heat it from within. As is the case with all resistive heaters shown here, the transmission lines from antenna(s) to resistive heaters are not shown, to avoid over-complicating the drawing.

Such a resistive heating substrate or item 311 might for example be used to heat items within a toasted sandwich—with other resistive heaters 310, for example, toasting the outside of that sandwich.

In one possible optional variation of the arrangements shown in FIG. 11B, the microwave-shielding material provided to the food item(s) within the packaging could be removed, but one or more resistive heaters and said antenna(s) could be retained in the design, so that the food item(s) would be heated or cooked by microwaves, but that in addition, some area(s) of one or more food items would also be heated or cooked by one or more electrically-powered resistive heaters—located for example within one or more said food products, such as for example, the contents of a toasted sandwich.

Thus for example, in one possible configuration where microwave shielding is not provided to the food product at all, a toasted sandwich container could incorporate a distribution of susceptor material on substrates adjacent to the exterior two faces of a sandwich, to toast those two faces of bread, and the inner faces of the two faces of two slices of bread making up the sandwich, or the contents of the sandwich, could be heated, toasted or cooked by one or more substrates incorporating resistive heating material.

The broad upwards and downwards-pointing arrows indicate the directions of force being applied by the heat-induced shrinking of heat-shrinkable polymer material to press electrically-heated resistive heating material against or towards the outer surfaces of the food item(s) shown.

The microwave shielding of food within the packaging provided might for example be used for food products 82—for example, a hamburger—which are best not cooked by microwaves, and which will instead, by the above-described means, and as illustrated in FIG. 11B, in this type of arrangement be cooked by heat emitted by antenna-powered resistive heating material.

In this type of arrangement where electrically-powered resistive heating material is used as the heating means to cook food which is shielded from microwaves, optionally, if said heat-shrinkable polymer material is shielded from microwaves, then resistive heating means will be provided in or adjacent to said heat-shrinkable polymer material.

It should be understood with reference to the arrangements shown in FIGS. 11A and 11B that although a sleeve of material 83, 86 (open as in FIG. 11A, or closed as in FIG. 11B) is presented as the packaging means, this is to provide an example of one means whereby the heat-induced shrinking of heat-shrinkable material may be used to press—directly or indirectly—heated material against or towards the outer surfaces of food item(s). However, the same principles as are explained above and in these drawings can be applied to any practical other shape or arrangement of packaging material, provided that the shrinking of said heat-shrinkable material will serve to exert pressure on heated material to be pressed or moved against the food items.

It should be emphasized that although in the explanation above, and in FIGS. 11A and B, packaging material (e.g., paper board) is shown as part of the arrangement, the same principles of heating and shrinking heat-shrinkable polymer material to press susceptor or resistive heating against or in the direction of the outer surfaces of food could be used without food packaging. A circular sleeve of material incorporating both heat-shrinkable polymer and susceptor material could for example enclose a bread roll, without using any additional (e.g., paperboard) packaging—which when heated by the means described above would simply shrink to some extent, to move said (e.g.) susceptor material to be closer to the outer surfaces of said bread roll, thereby heating or cooking it more successfully.

FIG. 11C

Figure 11C:
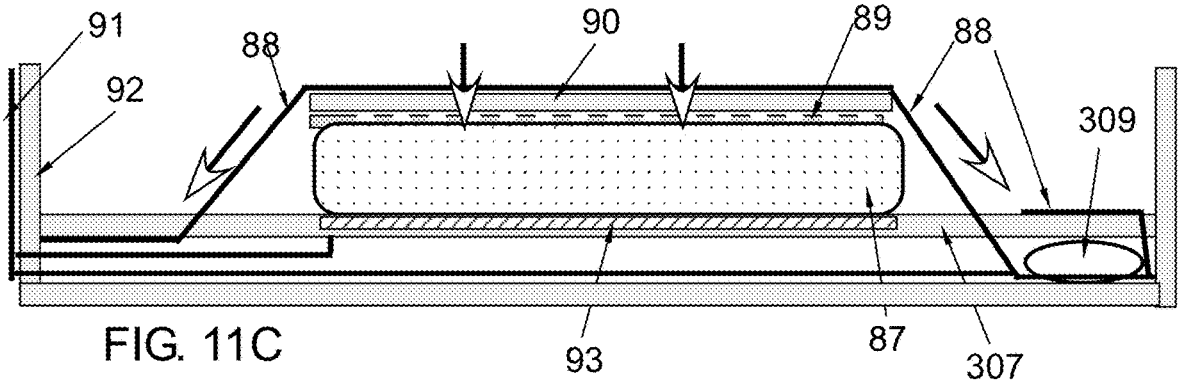
FIG. 11C illustrates a tensioned substrate pressing heated material against a food surface.

FIG. 11C shows another embodiment of the same inventive principles as are described above, and illustrated in FIGS. 11A and B.

In this drawing, a food item 87 (for example, a slice of tuna) is shown, where a substrate 88 is under tension and is applying force to press heated material (susceptor or resistive heating material) 89 against the upper face of a (e.g.) slice of tuna, to, for example, to sear and cook it.

The broad arrows indicate force being applied to press the heated material 89 towards or against the outer surfaces of the food 87.

Above said heating material 89, as an optional element, is shown a substrate of some preferably semi-rigid or rigid material—for example, paper board.

One or more antennas 91, an optional element in this example, are shown incorporated in the packaging. If used, one or more of said antennas 91 would be electrically connected to any (optional) resistive heating elements 93 used. The resistive heating material area 93 provided under the food product 87 is shown as an optional element, to heat or cook the (e.g.) tuna from the underside, with electrical power to said heating means provided by said antenna(s) 91.

The substrate 88 exerting downwards pressure on the (e.g.) tuna slice could incorporate heat-shrinkable polymer material in at least some portion of its area, which could be heated by susceptor material incorporated in or provided adjacent to said heat-shrinkable polymer, thereby creating the tension in the substrate 88 to exert downwards force on the (e.g.) heated material 89 heating the upper surfaces of the (e.g.) slice of tuna 87. Or alternatively, said tensioned substrate 88 could instead simply be or incorporate an area of tensioned elastic material. The advantage of applying or increasing tension in a substrate performing the function described of pressing heated material against outer surfaces of food only when a microwave oven containing said arrangements is switched on, is that otherwise—for example, using elastic material to exert that pressure—over a much longer period of time could serve to squeeze or flatten or damage the shape or appearance of the food product(s).

A further, optional, inventive idea is shown in FIG. 11C—which is further pursued later in this document: a sealed cavity 309 at the bottom right of FIG. 11C, which is formed for example by bonding two substrates together is inflated due to heating of susceptor or resistive heating material in or adjacent to said sealed cavity, where said inflation of the sealed cell or cavity (or a plurality of such) serving to create, or to increase, the tension on the substrate 88, which thereby press heated material 89 against the upper surface of the (e.g.) slice of tuna.

This sealed cavity could for example be formed between the substrate 88 and another area of substrate which is bonded to that substrate 88 in the location where the substrate 88 is shown penetrating down through the packaging substrate 307, running under the inflated sealed cavity 306, and is fastened to the upper side of the packaging substrate 307 above said inflated sealed cavity 306.

A single 'bubble', or inflated sealed cavity, is shown here—but a plurality of such sealed cells, heated by adjacent susceptor material exposed to microwaves, or by adjacent resistive heating material connected to one or more antennas 91 could instead be used. The single inflated sealed cell 309 and the adjacent substrate 88 are not drawn well here, but are provided simply to illustrate the inventive idea here, which could be implemented in many different ways. For example, the substrate 88 could, before the inflation of said sealed cavity have been running along the underside of the substrate above it, to for example penetrate upwards through that cavity to its fastening location to the upper side of that substrate. But when said sealed cavity was caused to inflate, this would push the substrate 88 downwards, thereby increasing the tension on the substrate 88, and thereby creating or increasing the downwards pressure exerted by that substrate 88 on the susceptor or resistive heating means heating the upper surfaces of the (e.g.) slice of tuna.

This is just one of many ways by which this innovative idea of using the inflation of one or more sealed cavities can be used to create or increase tension in a substrate, so as to press susceptor or heated material against or towards the outer surfaces of food, in a switched-on microwave oven.

FIG. 12A

FIG. 12A is a schematic plan view drawing, showing (in this particular embodiment) two cavities 94 formed between two substrates 95, where susceptor or resistive heating material provided adjacent to said cavities is heated by microwaves (in the case of susceptor material) in a microwave oven, or alternatively heated by electrical power applied by one or more antennas 96 connected to said resistive heating means, with said heating effect in either case causing the air inside said cavities 94 to expand, and the 'combined substrate' 95 to straighten out in shape, if it was at the time of said expansion of air in said cavities 94 curled-up, or non-straight in shape.

If the cavity-heating heat source is resistive heating material adjacent to said cavities, then—as is the case with resistive heaters used in any of the inventions described in this document) said resistive heating areas may need to be shielded (e.g., by aluminum foil) against microwaves, to prevent undesired microwave heating of the resistive heating material.

Although two cavities are shown in this drawing and cited above, there may be any number of cavities used, including only one, if so desired.

FIG. 12B

Figure 12B:
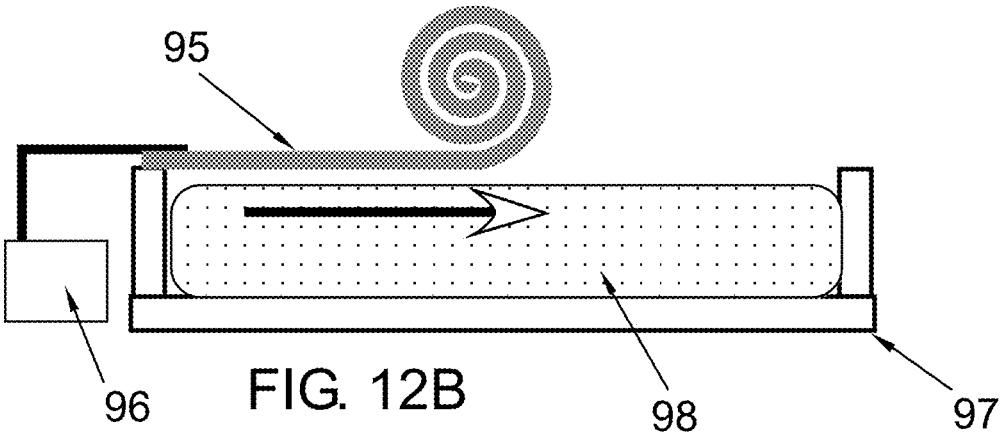
FIG. 12B illustrates the heat-inflated cavities in a substrate used as an actuator means.

FIG. 12B shows a cross-sectional view of a food container 97 containing food 98, with said cavity-containing substrate 95 extending across the aperture of said food container in a switched-on microwave oven, due to said susceptor or resistive heating material areas adjacent to said cavities in said substrate 95 being heated, causing the substrate 95 to be forced to straighten out in shape, as explained above.

Thus, it can be appreciated that if, for example, the substrate 95 incorporated a distribution of susceptor material over (for example) its lower face facing the food 98, this 'straightening-out' action could be used to cause the food 98 in the container to start to be grilled by heat from that susceptor material.

Similarly, if the substrate incorporated microwave-blocking material over its area, this substrate, once extended across the mouth of the container 97, could be used to stop the food 98 in the food container 97 from continuing to be cooked by microwaves in this switched-on microwave oven.

This arrangement is thus a pneumatic actuator, which can be used for almost innumerable other purposes in a food container in a switched on microwave oven—including for example, if attached to a movable (e.g., rigid) substrate, to change the angle of that substrate, and thus for example to open or close 'doors' in a food package; or to move items from one location to another within a food package; or to extend flexible antennas, or to be used in combination with other types of actuator, including any of the novel actuator means disclosed in this document, so as to provide a bi-directional actuator means.

FIG. 12C

Figure 12C:
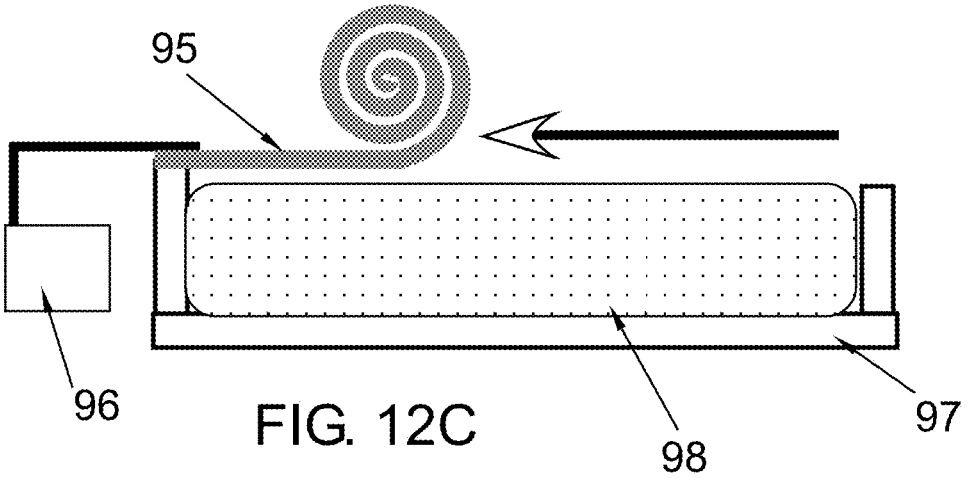
FIG. 12C illustrates a tensioned item in a cavity-containing substrate acting to scroll it up.

In FIG. 12C, the cavity-containing substrate 95 is moving in the opposite direction from that shown in FIG. 12B, as it 'scrolls-up' towards the left-hand side of the food container 97.

If electrical power from said antenna(s) is no longer applied to (e.g., microwave-shielded) resistive heating areas adjacent to cavities in the substrate 95, then the 'scrolling-up' force exerted by a tensioned item provided in said substrate 95 with an 'at rest' state of being curled-up at the left-hand side of the food container 97 becomes predominant, and the substrate 95 accordingly scrolls up.

The above described novel design principles can optionally be used as a very versatile actuator means to perform many functions in a food container located in a switched-on microwave oven, including many of the actuator-related functions described in this document.

It should be noted that optionally, a small vent can be provided in said sealed cavities, to for example allow air to be expelled from said cavities if a counter-directional actuator such as a tensioned item is acting to 'scroll-up' said cavity-bearing substrate 95.

FIG. 13A

Figure 13A:
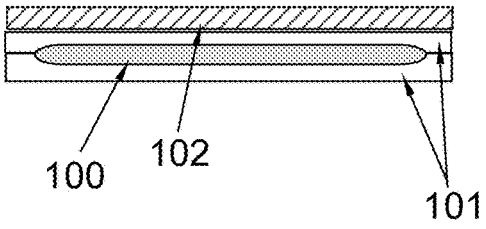
FIG. 13A illustrates a sealed cavity in a substrate.

FIG. 13A shows a sealed cavity 100 located between two substrates 101 with, in this particular example, a layer or substrate of material 102 above them. Using the same arrangements as have already been illustrated in drawings and explained, above, in reference to FIG. 12A, an area of susceptor material or resistant heating material is provided adjacent to said cavity 100 (not shown in the drawing) to provide the heating means to heat said cavity. The uppermost layer or substrate 102 may, optionally, be removed from this design approach.

FIG. 13B

Figure 13B:
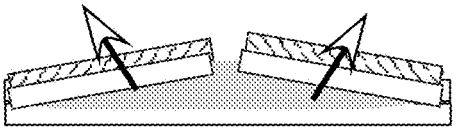
FIG. 13B illustrates a heated sealed cavity breaking an adjacent substrate.
Figure 13C:
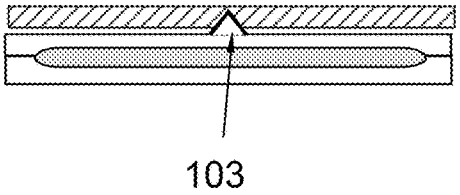
FIG. 13C illustrates a pre-weakened location adjacent to a sealed cavity.

The susceptor or resistive heating material is heated up by methods described in reference to FIG. 12A and elsewhere in this document, causing the (e.g.) air within the cavity to expand, thereby breaking the substrate above. The lower of the two substrates 101 may be thicker in dimensions, or made of stronger material than the upper of the two substrates 101, and/or the upper of the two substrates 102 may be weakened at at least one point over its area, so that the expansion of the cavity 102 will cause the breaking of the upper two substrates as shown in FIG. 13B.

FIG. 13C

A indentation 103 or weakened location or area in the upper substrate shown, which may form a point in its area, or a line running across its area, may be provided to facilitate the breaking of the upper substrates, optionally along some particular line or in a particular direction.

FIG. 13D

This plan view shows how the approach described above could be used to cause a substrate 104 to be broken, weakened or to tear along a predetermined line 105. This may, optionally, be facilitated by the substrate 104 being under tension. The tear or break line 105 shown provides an example of the direction and route that such a tearing or breaking might take, following the location of the heat-expanded cavities.

The rectangular area of substrate 104 shown here could for example be a substrate covering a food container's aperture. If the substrate shown were for example tensioned, or subject to other types of actuator means exerting force for it to change shape, for example—using any of the novel arrangements explained in this document to change the shape of a substrate, for example—this tearing or breaking of the substrate 104 could be used to free the substrate which is to be changed in shape or other properties from adjacent portions of the substrate 104 which would otherwise prevent that change of shape or other properties from taking place.

Such an arrangement as is shown in FIGS. 13A, 13B, 13C and 13D could thus, for example, be used to break or sufficiently weaken a substrate covering the aperture of a food container which prior to be being weakened or broken by the above said means would provide a sealed enclosing means for the food within said food container.

Although a substrate 102 or layer is shown in these drawings located above the two substrates 101, that is purely an optional element of the inventive idea proposed here. The arrangement could thus simply be the two substrates 101, with nothing above them, in terms of this drawing.

Figure 13D:
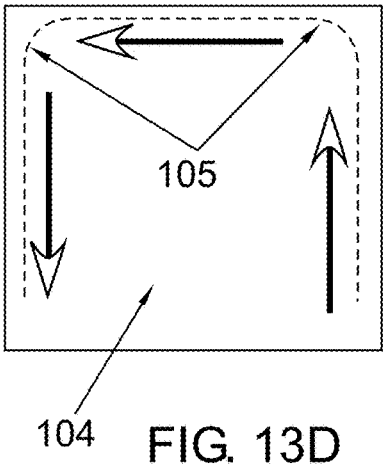
FIG. 13D is a plan view of the top substrate of a food container being weakened or broken.

FIG. 13D can also be used to explain and disclose two other, different, inventions serving a similar purpose.

1. The dotted line 105 could instead indicate the location of a line or route of resistive heating material—e.g., carbon—connected to one or more antennas incorporated in a food container.

When electrical power generated from said antenna(s) converting microwaves into electrical power is applied to any line or area of resistive heating material on a substrate—such, for example, as the dotted line 105 shown in FIG. 13D—the resistive heating material is heated up, and thereby weakens, melts or severs that substrate—thereby for example allowing the substrate to be freed of areas of the substrate 104 in FIG. 13D which are located between the U-shaped 'break line' 105 shown in FIG. 13D and the nearby sides or edges of the substrate 104, thereby for example allowing the substrate 104 to be changed in its shape or other properties by for example any of the many different actuator means able to change the shape or other properties of a substrate which are disclosed and described in this document.

2. The dotted line 105 in FIG. 13D could alternatively represent a line of susceptor material which, due to exposure to microwaves in the microwave oven, heats up and effects the same severing or weakening of said substrate along the line of susceptor material 105 shown, with the same other functions as are described above.

FIG. 14

FIG. 14A represents a schematic cross-sectional view of two substrates 106, 107 or areas of material to be used in a switched-on microwave oven, where the two substrates 106, 107 are in this particular example located one above the other, with a suitable dielectric material, or alternatively a sufficient air gap, between them.

One or more antennas 108 are located on the right-hand side of the upper substrate 106 shown, connected by transmission lines 110 to an area of resistive heating material 109 on the left-hand side of that substrate 106.

Over the area of the lower substrate 107 shown, there is provided a distribution of susceptor material (e.g., a thin layer of aluminum on a PET substrate).

By means of such an arrangement, in a switched-on microwave oven, both the area of resistive heating material 109 and the susceptor material on the substrate 107 will generate heat, with the result that the combined heat generated by both types of heat-generating means affecting a food item located immediately underneath (for example—in terms of FIG. 14) the left-hand area of the two substrates 106 and 107 will be greater than if there had only been the susceptor material provided in that left-hand area, and the resistive heating material 109 had not been provided or present in this arrangement.

This type of arrangement, where both susceptor material and electrically-powered resistive heating material are used in combination with each other to heat food, provides the means of achieving higher heating temperatures than would be possible using susceptor material alone to heat adjacent food.

Figure 14:
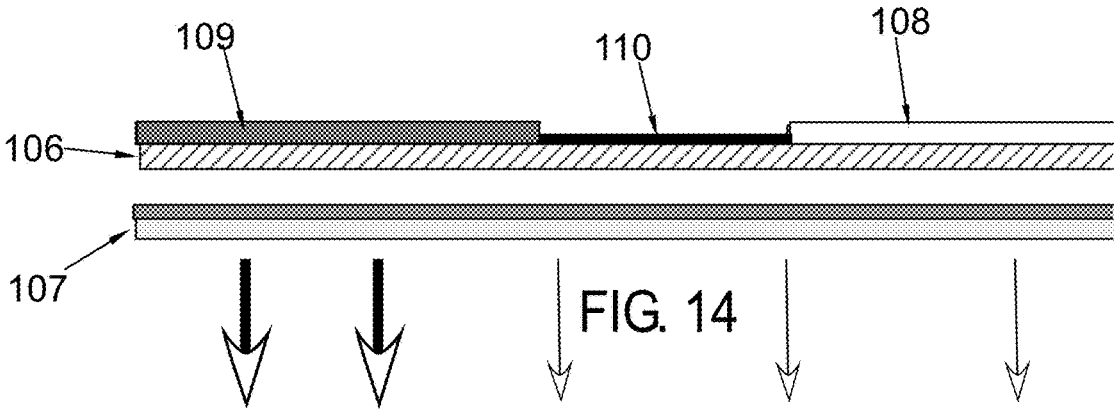
FIG. 14 shows antenna(s) powering resistive heating material adjacent to susceptor material.

The arrangement shown in FIG. 14 is only provided as one possible example of how the two said different types of heating means could combine their heating effects to heat or cook adjacent or nearby food. The susceptor material on the lower substrate could alternatively have been located above the resistive heating material in the arrangement shown in FIG. 14, for example.

Or the susceptor material could, for example, be provided on the underside of the upper substrate 106 bearing the resistive heating material, for example, provided that there is adequate and suitable dielectric material between resistive heating material and susceptor material.

The susceptor material shown extending across the entire area of the lower substrate might instead, for example, only cover the left-hand area directly underneath the resistive heating area, for example—or it might instead cover only some other area of that substrate 107 than that shown in FIG. 14.

It should be borne in mind that some areas or compartments of a pre-prepared 'TV dinner' (which the arrangement shown might be used together with) may not require heating or cooking—for example, where there is a salad compartment or area of the 'dinner' or meal provided—and thus, there might be no need for a heating means in that right-hand area of the drawing.

In that context, one or more antennas providing electrical power to resistive heating means to cook food in a TV dinner for example might alternatively, instead of being provided for example in the location 108 shown, be provided as an element or item separate from the food package within which the arrangement shown in FIG. 14 might be located—with transmission lines connecting said antenna(s) to the resistive heating material areas in a food container.

Optionally, a switch means (e.g., a capacitive switching means) could be provided to switch on or off, or to modulate the power of, the electrical power transmitted by the transmission lines from the antenna(s) 108 to the resistive heating material 109.

FIG. 15

Figure 15:
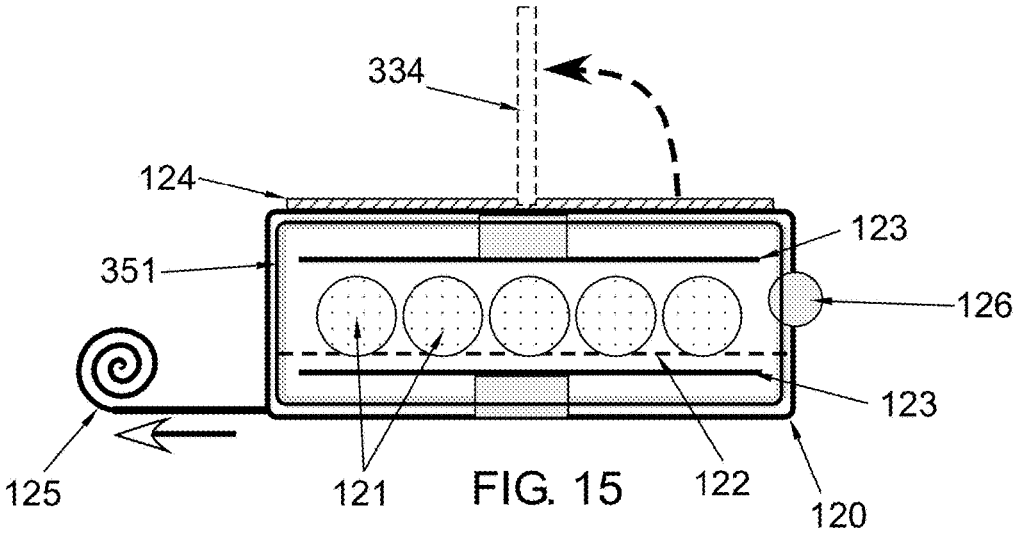
FIG. 15 shows a microwave-shielded food container, with antenna(s) powering heating means.

FIG. 15 is a schematic drawing showing a food container 120 which in this embodiment is shielded against microwaves from all directions (for example, by aluminum foil 351 being incorporated in all faces of the container 120 shown), and which is located in a switched-on microwave oven. There are various food items 121 shown located within said container, resting on a support 122.

This food container 120 is designed to enable people to enjoy food which is cooked by conventional, non-microwave heating means—but where the consumer can benefit from the convenience of cooking the food 121 in the food container 120 in a microwave oven.

Above and below the food items 121 within the microwave-shielded container 120 are two (in this particular example) areas of resistive heating material 123, which are connected (transmission lines not shown) to one or more antennas 124 located outside said microwave shielded area—shown in this particular example as being located in the top face of the food container 120, but which could be located on or adjacent to any of the faces, for example, of the food container 120—or for example in a separate container exterior to the food container 20, with transmission lines connecting said antenna(s) to resistive heaters provided inside the microwave-shielded area of the food container 120.

This drawing, like all drawings in this document, is not to scale. There might, for example, be a gap of several centimeters between the (e.g.) aluminum substrate 351 in the upper face of the food container and the antenna(s), to prevent the (e.g.) aluminum foil (351) providing microwave shielding to the food contents of the container from undermining the electrical power-generating function of the antennas. Suitable dielectric material may optionally be provided between said antenna(s) and said microwave-shielding (e.g., aluminum foil) substrate 351, for the same purpose of assisting in the efficient electrical power-generating function of said antenna(s).

Optionally, said antenna(s) may be provided in a enclosure allowing the antenna(s) to change their angle with respect to the adjacent said microwave-shielding material 351, for the same purpose as stated above. An example of this is shown above the upper face of the food container, where an antenna-containing enclosure 334 is shown 'folding' outwards from the upper face of the food container 120 to reach a vertical angle. Any of the novel shape-changing actuators introduced in this document could for example be used to cause said change of angle automatically, when the microwave oven containing the food container 120 shown is switched on. The structure of a substrate described in Example 4 with reference to FIG. 6, could be used for this purpose—where a heat-shrinkable polymer substrate attached to said antenna(s) enclosure 334 and the horizontal upper face of the food container 120 could be caused by microwaves to heat up and shrink, as soon as the microwave oven is switched on—thereby causing said antenna enclosure to become vertical.

Similar arrangements could for example be provided on other faces of the food container 120 shown—and in all other disclosures and drawings provided herein, where antenna(s) are provided in close proximity to metallic microwave-shielding material which would otherwise undermine the electrical power-generating performance of antenna(s).

This schematic drawing is only provided to illustrate the inventive principles here—and is only one of many different possible embodiments of the inventive ideas being introduced here.

An (optional) hinge 126 is shown, to allow the container to be opened, using that hinge. A possible division line of the container shown into top and bottom halves, for example, to open the container using the hinge, is not shown in the drawing.

Optionally—for example, if more of a 'roasting' effect on the food is desired, or to reduce heat loss from the food into the microwave oven cavity—heat insulating material may be provided in said food container 120—for example incorporated in, or located adjacent to, the side, bottom and top faces of the container.

An optional extendable 'un-scrolling' flexible antenna 125 or antenna array is shown extending from the food container 120—to be used if for example if additional antenna area is required for electrical supply purposes. This un-scrolling antenna could for example employ any of the various novel un-scrolling substrate actuator inventions introduced elsewhere in this document.

Alternatively—as is the case with all devices in this document which use antenna(s) to supply electrical power to resistive heating areas—one or more antennas could optionally be used, separate from and outside the food container shown, with transmission lines connected to resistive heating areas of material in the food container.

After the microwave oven is switched on, microwaves inside the microwave oven will be converted by the antenna(s) 124 shown into electrical power, which will be applied to the two resistive heaters 123 shown in this particular example, located within the microwave-shielded interior area of the food container 120—thereby heating or cooking adjacent or nearby food located within said container.

As is the case with all containers shown in Figures or drawings in this patent application, optionally, the food container 120 may occupy some portion of a larger container, and may for example be a compartment of said larger food container, where other food items may for example be provided outside said microwave-shielded area of the food container 120 shown, and may for example be cooked by microwaves.

Optionally, outside the microwave-shielded area of the container 120 shown, susceptor material may be provided, preferably adjacent to said microwave shielding means, which is heated up by microwaves, and the heat thereby generated is conducted through said microwave-shielding material (e.g., aluminum foil) to for example heat food located inside said microwave-shielded enclosure 351 of the food container 120, which may preferably be located in contact with said microwave-shielding material (e.g., aluminum foil) 351.

FIG. 16A

Figure 16A:
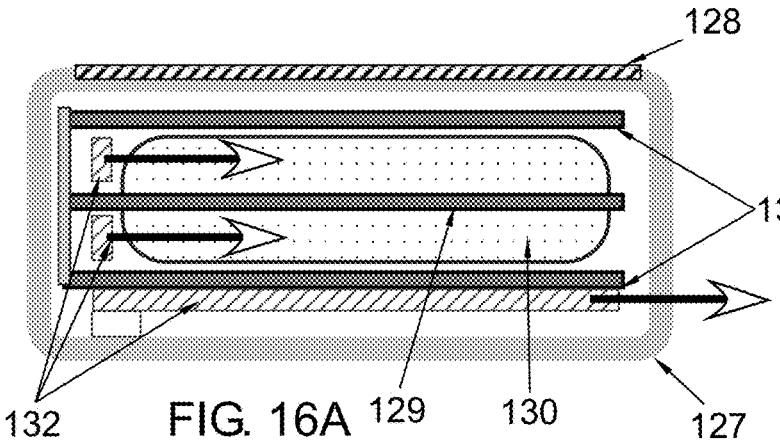
FIG. 16A shows a microwave-shielded food container, with antenna(s) powering resistive heaters heating the inside and outside of a food product. means.

FIG. 16A shows a schematic cross-sectional drawing of a microwave-shielded food container 127 similar essentially to the food container of FIG. 15—except that in FIG. 16A antenna(s) provide electrical power to a resistive heating substrate or area of material 129 'inserted' or located within the food product, in addition to those resistive heaters 131 provided outside and adjacent to the food item in this example. The (e.g., aluminum foil) microwave shielding material is not shown in FIG. 17, but it could for example be the same as shown in FIG. 16A.

Microwave-exposed susceptor material can be useful for heating the exterior surfaces of food items—but cannot be used where microwaves do not penetrate in sufficient strength—for example in the inner areas of thicker food items. Electrically-heated resistive heaters provide a solution to this problem.

In the case of the beef for a hamburger, this could be achieved, for example, by slicing the beef into two or more horizontal slices, and placing a resistive heating plate or substrate, for example, between each of those slices—in addition to providing resistive heaters adjacent to both external sides of the burger, for example. Although in FIG. 16A, the antenna-powered resistive heater substrates may appear to be rigid and thick, they could alternatively be flexible and thin, according to the particular application.

There is also shown in FIG. 16A an (optional) bracket or structure 132, made of any suitable rigid material, which can be used to slide the food product off the resistive heating substrates or areas of material 129, 131.

This bracket or structure could for example be incorporated in or mechanically linked to a 'door' or opening (not shown) of this food container, so that when for example the 'door' is opened by the consumer after it is cooked, that action pushes the (e.g.) burger away from or off the resistive heating plates or substrates (which may optionally be flexible), to be presented to the consumer.

Although in the particular example shown in FIG. 16A, there is only one food item shown—for example, the beef for a hamburger—being cooked within the food container 127, this is only provided as an example to illustrate the inventive principles being disclosed here. Any practical number of different food items or portions of food could be provided within a microwave-shielded food container such as that shown in FIG. 16—and any practical number of resistive heating means could be provided within said food items to 'cook them from inside'.

As a separate point, an entire hamburger, including for example bread buns, and onions, tomatoes and lettuce, and bacon, for example, could optionally also be provided in a container using the same design principles as that shown in FIG. 16A together with the beef for the burger, instead of only the beef for such a hamburger. In such a case, it might be that, for example, additional resistive heaters heating at a lower temperature would be provided adjacent to bread buns, to warm them. If required, spacing or heat-insulating material or means could be provided between items heated by resistive heaters and other items (e.g., lettuce, tomatoes) where heating is not desired.

Optionally, if there are some food items in a food container such as that shown in FIG. 16A or FIG. 15 which are to be shielded against microwaves, and one or more other items or portions of food that are not to be shielded from microwaves, then the interior space shown in FIG. 16A (or FIG. 15) could, optionally, be appropriately divided into one or more microwave-shielded areas, and one or more areas which are exposed to microwaves, using for example aluminum foil to provide the microwave-shielding function.

If for example the design principles described above and shown in FIG. 16A were to be used for a toasted sandwich, it might be desired that a distribution of susceptor material in one or more substrates (e.g., a thin layer of aluminum on PET substrate) was provided adjacent to the external surfaces of that sandwich—for example, in the food wrapper substrate—to toast those bread surfaces—but that one or more resistive heaters connected to antenna(s) incorporated in the food package or provided outside it are provided inside the toasted sandwich, for example to toast the inside faces of the bread slices, and/or the contents of the sandwich.

In such a case, the microwave shielding described as being incorporated in the food container 127 in FIG. 16A could alternatively be removed from the food package—so that the food contents of that food container would then be exposed to microwaves in the microwave oven—but that one or more resistive heaters would also be used to heat or cook some of the food contents, optionally from the inside as shown here. Optionally, susceptor or resistive heating material-bearing substrates provided adjacent to bread or other types of food could incorporate ventilation holes—for example, across their area—to allow steam to escape.

Figure 16B:
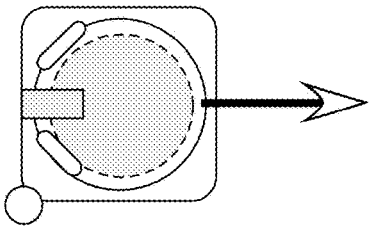
FIG. 16B shows a plan view of the food container of FIG. 16A.

FIG. 16B FIG. 16B shows a plan view of the food container shown in FIG. 16A.

FIG. 17

Figure 17:
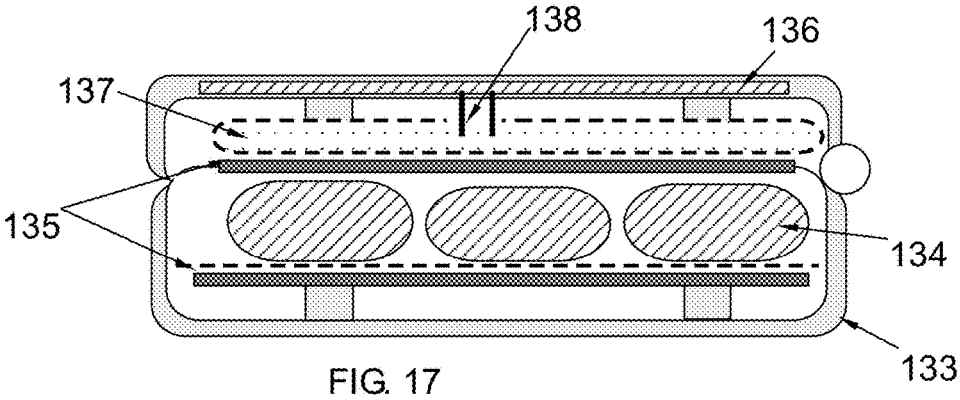
FIG. 17 shows a microwave-shielded food container, with smoke-producing means.

FIG. 17 is a schematic drawing of a food container 133 providing in most embodiments microwave-shielding (not shown) for the food contents 134 shown within the container 133, using for example aluminum foil in or adjacent to all sides, and top and bottom faces of the enclosure shown here to provide said microwave shielding function.

Two resistive heating elements or substrates 135 are shown in this particular example, which are electrically powered by antenna(s) 136 shown in this example integrated in the top face of the food container 133. (As with all drawings in this patent application, the transmission lines between antenna(s) and resistive heaters are not shown, to keep the drawing simple and clear).

Optionally, the container shown could incorporate heat insulation material in or adjacent to all sides, top and bottom faces of the microwave-shielded interior area of the food container 133 shown, to retain heat inside said interior area. Thus, if desired, the food container shown 133 could serve to 'roast' food located within it.

The key different feature about this food container 133, compared with those shown in FIG. 16A and FIG. 15, is that this food container incorporates at least one area, or ventilated vessel or container, containing material (e.g., charcoal or herbs) which when heated to a sufficient temperature by adjacent resistive heating (or susceptor) means, or when ignited or caused to combust, generates smoke or odor, to imbue food cooked within the microwave-shielded interior space of the container 133 shown with the flavor(s) or odor(s) of the material(s) which are caused to generate smoke or odor within that space.

Optionally, a 'spark' or 'arcing generator' facility 138 or capability can be provided in or adjacent to the smoke-generating material 137, which could for example be two electro-conductive items 138 or areas of material a small distance apart, connected for example to one or more antenna(s) 136 incorporated in said food container 133, where the arcing or 'sparks' generated between (for example) two adjacent but separate electro-conductive pins 138 connected to an antenna 138 are used to assist in 'inflaming' or igniting combustible material in said smoke-producing container 137.

Optionally, accelerants or such materials as saltpeter could be added to the material in the smoke-producing area(s), ventilated vessel(s) or container (s) provided in said food container 133, to assist in initiating or continuing the inflaming, combustion or smoke-producing process.

As an alternative to (for example) above-cited two pins running from the antenna(s) 138 to said smoke-producing material to produce the above-said arcing effect to help inflame the combustible smoke-producing material, a means of allowing microwaves to enter the food container shown— via for example a small hole in the microwave-shielding material shielding the interior of the container 133 shown—could optionally be provided, with for example two or more suitable electro-conductive items a small distance apart near said hole, receiving such microwaves, and thereby generating an arcing or a sparking effect.

Although two resistive heaters are shown used within the microwave-shielded area of the food container 133 shown in FIG. 17, clearly any practical number of resistive heaters could be provided therein, depending upon the particular heat-generating requirements. Similarly (as is the case with all drawings and descriptions of such in this document where antennas are used) although antenna(s) are only shown on the uppermost face of the food package, additional antennas could be provided elsewhere in or on this food container—or could be provided physically away from the food package, with transmission lines connecting said antenna(s) to one or more resistive heaters incorporated in said food container.

As is the case with all food containers shown and described in this patent application, the food container shown 133 could, optionally, be a food compartment incorporated within a larger food container—for example, where food items provided in another locations within said larger food container are not being shielded from microwaves, and which may for example be cooked by microwaves.

Optionally, a smoke or odor-producing ventilated container such as that shown 137 in FIG. 17 could be incorporated in any food container in a switched-on microwave oven where the food contents are, by contrast, exposed to microwaves—in which case susceptor material provided in or adjacent to said container could be used heat the smoke or odor-producing material in the smoke or odor-producing container or vessel.

It should be noted that although the container containing the smoke or odor-producing material 137 is shown as being located away from the food items 134, such a container 137 could be located anywhere inside the food container 127—including being located immediately adjacent to the food items 134, if desired. Or of course, there could alternatively be more than one such ventilated smoke or odor-producing container or area 137 provided in the food container 127 shown.

Thus, if for example the food product being cooked was the beef for a hamburger, the resistive heating means (one or more such resistive heating means) immediately adjacent to the (e.g.) beef, could optionally also be heating (e.g.) charcoal.

FIG. 18A

Figure 18A:
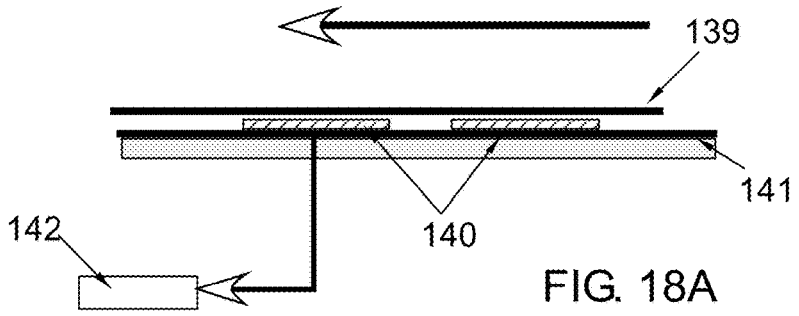
FIG. 18A shows an antenna with a movable microwave-shielding substrate above it.

FIG. 18A is a schematic cross-sectional drawing showing a different, and novel and important, other use of the controlled change of shape, location, angle or other properties of a microwave-obstructing substrate or other object or item than has been disclosed earlier in this document.

FIG. 18A shows an antenna 142 connected to a device, area of material or item 142 which is located in a food container in a microwave oven. That device in question might for example be an actuator means controlling a microwave-obstructing substrate located adjacent to food, or an area of resistive heating material adjacent to food.

Above the antenna 140, there is a movable substrate incorporating a distribution of microwave-obstructing material—for example, incorporating aluminum foil. Underneath the antenna is a non-movable area of microwave-blocking material 141.

Thus, in FIG. 18A, in a switched-on microwave oven, the microwave-obstructing substrate 139 is causing the antenna 140 to receive little or no microwave radiation, and as a result, the antenna 140 is generating little or no electrical power (depending upon whether or not any microwaves at all have reached the antenna—for example, via any small gap between the movable microwave-obstructing substrate 39 and the non-movable microwave-blocking substrate 141 or item below the antenna).

When any suitable actuator means—for example, any of the novel actuator means disclosed in this document—causes the microwave-blocking substrate 139 to be moved to a location where there is no longer any microwave-obstructing material located above (in terms of this drawing) the antenna 140, the antenna will then be fully exposed to microwaves in the switched-on microwave oven, and will convert microwaves into electrical power which is applied to the device, item or material to which said antenna 140 is connected 142. Thus, the apparatus shown in FIG. 18A is a switch means—to switch on, or off, the power-generating function of the antenna 140 shown.

As with all drawings or Figures presented in this patent application, this drawing is not to scale, but is instead only intended to illustrate the inventive principles being introduced here. Similarly, this schematic drawing does not show, for example, two transmission lines leading from the antenna 140 to the remote device 142—in order to make the simple and drawing clear, focusing on the inventive ideas being disclosed.

FIG. 18B

Figure 18B:
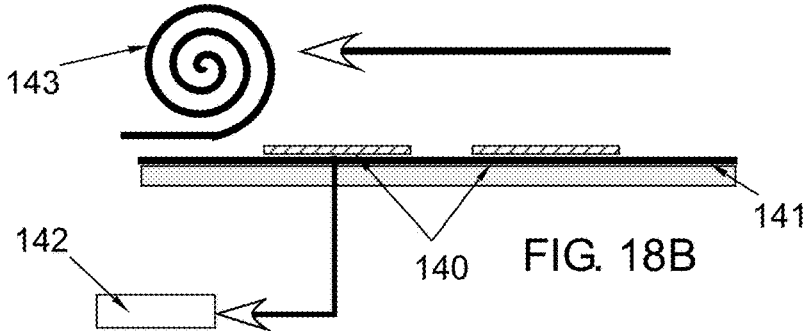
FIG. 18B shows a movable substrate having exposed an antenna to microwaves.

FIG. 18B shows essentially the same apparatus as that shown in FIG. 18—except that the microwave-obstructing substrate 143 has been caused by any suitable actuator means (examples of which are provided above, in this document) to scroll-up to the left of the antenna 140, thereby exposing the antenna 140 to microwaves in the switched-on microwave oven, thereby causing said antenna to generate electrical power which is applied to the device 142 to which it is connected, and which is located in a food container in said microwave oven.

Although a microwave-obstructing substrate 'scrolling up' is shown in FIG. 18B as the means of exposing the antenna 140 to microwaves (an actuator design which is explained, above, in this document with many different disclosed means of achieving such a change of shape), equally, any other controllable change of shape, location, angle, dimensions or other properties in any practical direction of a microwave-obstructing substrate (or other practical and movable object incorporating a suitable distribution of microwave-obstructing material) could alternatively have been used, where said change is caused by any suitable actuator means, including for example by any of the novel actuator means disclosed in this document, and where the effect of said change of properties of a microwave-obstructing substrate or other microwave-obstructing item would be similar to the change in the amplitude of microwaves reaching the antenna 140 shown in FIG. 18B.

Clearly, alternatively, a microwave-obstructing substrate (or other suitable microwave-obstructing item) could alternatively have been configured using any suitable actuator means to have been moved in the opposite direction to that shown in FIGS. 18A and 18B—from a location or situation where said microwave-obstructing movable substrate or other item was not obstructing microwaves from reaching said antenna 140, to a location or situation where microwaves were being obstructed from reaching said antenna 140, entirely or to some extent.

FIG. 19

Figure 19:
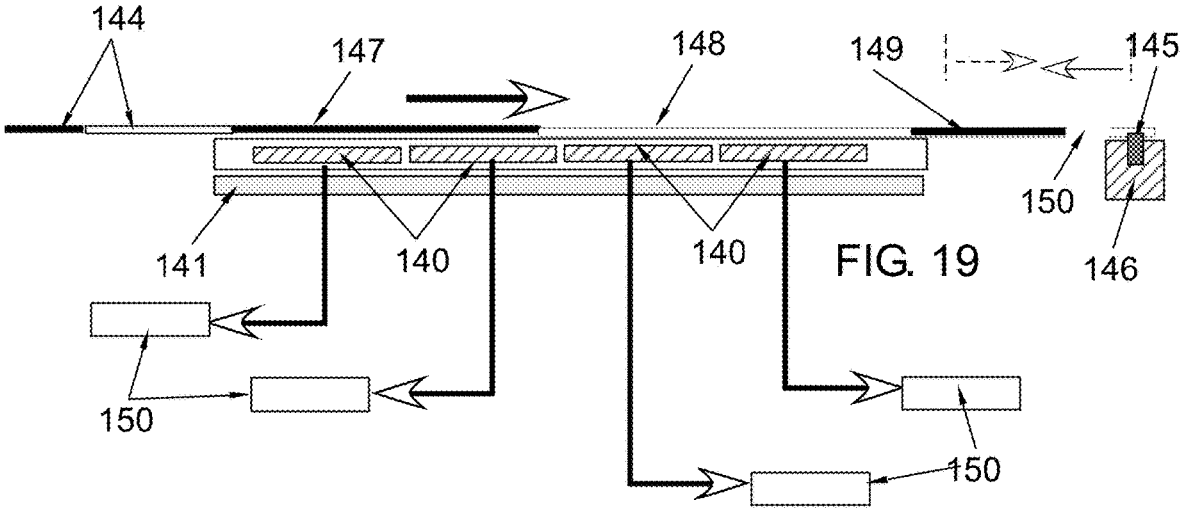
FIG. 19 shows four antennas with an adjacent movable substrate which by moving horizontally, exposes different antennas to microwaves at different times, thereby controlling the electrical power applied to different devices.

FIG. 19 shows an extension of the above novel electrical power-switching and control means to show a plurality of antennas electrically connected to a plurality of different devices or areas of material 151 provided in a food container which is located in a switched-on microwave oven.

FIG. 19 shows an array of four antennas 140, each represented for the sake of clarity in the drawing by a single rectangle, and each electrically connected to different devices or areas of material within a food container which is located in a microwave oven. Below said antennas 140, there is an area of non-movable microwave-blocking material.

Just above said antennas 140 is shown a movable substrate 144 incorporating within its area some areas of microwave-obstructing 147, 149 material (shown in black), and some microwave-transparent areas of the substrate 144, 148 (shown in white). Said microwave-obstructing portions of the movable substrate might for example incorporate an area of aluminum foil.

Beyond the right-hand edge of this drawing, the substrate shown 144 is anchored to some non-movable item—for example, some part of the food container within which the apparatus shown in FIG. 19 is located.

Like all drawings presented in this document, FIG. 19 is not to scale: the distances of the different antennas 140 from each other shown in this schematic drawing, for example, is not intended to represent a 'to scale' real-life situation: they are represented as being located very close to each other simply to get sufficient antennas into the drawing to represent the inventive ideas disclosed here.

In FIG. 19, instead of the 'scrolling-up' microwave-obstructing substrate 143 shown in FIG. 18B, the substrate 144 shown here is being caused by any suitable actuator means to be progressively moved in a horizontal axis (in terms of this drawing)—probably very slowly in this particular example—to the right (in terms of this drawing) across the antennas 140 shown, with this movement of the substrate starting almost immediately after the microwave oven within which this apparatus is located is switched on.

As is the case with FIGS. 18A and 18B, there is a permanent (i.e., non-movable) microwave-blocking substrate 141 or other area of material provided underneath (in terms of this drawing) the antennas shown, to prevent microwaves reaching said antennas from angles which cannot be obstructed by microwave-obstructing portions of the movable substrate 144.

The 'microwave windows' represented by white portions of the substrate 144 shown might for example simply be holes in the substrate 144, or they might be areas of the (e.g.) polymer substrate 144 which do not incorporate microwave-obstructing material.

Thus, it can be understood that as the substrate 144 is drawn or moved progressively to the right-hand side (in this particular example), different antennas among the four antennas 140 shown in FIG. 19 will at different times during the time that the microwave oven remains switched on and be generating electrical power which is applied to whatever particular devices or material in the food container that they are, respectively, electrically connected to. Antennas having microwave-obstructing sections of the substrate will be shielded from microwaves, and will not generate or apply electrical power to the devices or items to which they are attached.

By this means, an apparatus such as that shown in FIG. 19 can be used to apply electrical power generated by multiple different antennas to different devices or areas of material provided in different locations in the food package within which the apparatus shown is located, at different times or stages during the time that the microwave oven within said food package and the apparatus shown in FIG. 19 is located remains switched on—and to not to apply electrical power to said devices or areas of material, at other times.

Thus, the moving substrate is, in this arrangement, effectively functioning as a program controlling the operations conducted within the food container from the moment that the microwave oven is switched on.

Thus for example, at a certain stage of the time during which said microwave oven remains switched on, electrical power from a certain antenna 140 shown here may be applied to a resistive heating means adjacent to food in a certain location in said food container, thereby heating it up, and starting the cooking of food adjacent to that resistive heating means.

As the movable substrate 141 is progressively slowly moved in a rightwards direction (in this particular example) by any suitable actuator means, a microwave-obstructing portion of the substrate 144 will in due course be moved to be located above the antenna providing the electrical energy to heat said resistive heating means—and that electrical power will then be cut off, causing the heating of said adjacent food item(s) by said resistive heating means to end.

Similarly, one of the other antennas 140 shown in FIG. 19 may at some point during the time that the microwave oven is switched on have a 'microwave window' moved above it, causing it to generate and apply electrical power to one of the actuator types introduced in this document—for example, to resistive heating material in a substrate-restraining means, thereby heating up said substrate-restraining means, causing a tensioned microwave-obstructing substrate (e.g., as described above in this document) to be released to move towards its 'at rest' location or state, and thereby causing food adjacent to said substrate to be exposed to microwaves, which start cooking said food.

Thus, from these examples, and from the ideas demonstrated in FIG. 19, it can be understood that an apparatus using the inventive principles exampled in FIG. 19 provides a means whereby a food package can perform a large number of food cooking and other operations simultaneously or successively, thereby providing a very sophisticated means of handling and cooking relatively sophisticated dishes of cooked food totally automatically.

All of the inventions disclosed in this patent application can be configured to be switched on, or switched off, or modulated in their performance or function, totally automatically, by the means presented here.

One of the great advantages of an apparatus such as those shown in FIGS. 19, and 18A and 18B, is that this provides a very low-cost programmable power-switching means which avoids such problems as arcing as would be encountered by a conventional switching means in a switched-on microwave oven In terms of an example of a very low-cost actuator means which could be used in this particular example shown in FIG. 19, it could be an area of heat-shrinkable polymer occupying a portion of the right-hand side of the substrate 144 shown, which is anchored 145 to some non-movable item in the food container within which this apparatus is located.

As soon as the microwave oven is switched on, the heat-shrinkable portion of the substrate 144 will start to heat up and shrink—thereby pulling the substrate 144 to the right. The slow rate of shrinking required in this particular application can be achieved by manipulation of the properties of the materials involved—for example, by providing only a small amount of susceptor material in or adjacent to said heat-shrinkable portion of the substrate 144; or by providing microwave shielding in or adjacent to said portion of the substrate, which would allow only a small portion of microwaves to reach the heat-shrinkable polymer; or by manipulation of the properties of the heat-shrinkable polymer, for example: there are many other ways, well-known to those skilled in the art, whereby the rate of shrinkage by heat-shrinkable polymer in a switched-on microwave oven can be made to be very slow, if desired.

An additional advantage of this type of approach is that it is self-calibrating to accommodate microwave ovens of different power output levels. If the oven is more powerful, the cooking of food will generally be faster—and the shrinking rate of said heat-shrinkable polymer actuator would similarly be more rapid, thereby compensating for the more powerful oven. With a low power oven, the polymer shrinking rate of the substrate, and the rate of cooking food, would be correspondingly slower.

The gap in the substrate 144 shown 150 in the area between the right hand-most antenna and the anchoring point 145 represents the fact that in reality, the location of the anchoring point 148 might otherwise not be visible in this drawing.

In the above explanation and examples, the movable substrate 144 is described as blocking or not blocking microwaves to one or more of the antennas 140 shown. However, alternatively said microwave-obstructing material used in said substrate 144 could serve to obstruct only a portion of microwaves reaching it, thereby allowing a portion of microwaves to pass through the substrate 144 and reach one or more said antennas 144—thereby in turn causing said one or more antennas to generate and apply a lower amplitude of electrical power to one or more devices or areas of material to which it or they are electrically connected.

Similarly, said 'microwave-transparent' portions of the substrate 144 might be less than 100% microwave-transparent, if so desired, thereby providing a means of—for example—modulating the amplitude of electrical power applied by an antenna to a resistive heating means cooking food, and thereby providing a means of lowering, or raising, the cooking temperature of food.

In conclusion, an apparatus using the inventive principles shown in FIG. 19 provides not only a very flexible electrical power-switching and control means—but also provides a timing means to control what amount of time after the microwave oven is switched on, different operations should take place inside the food container—and to switch on or switch off or modulate the amplitude of—electrical power to those devices or materials, during the time that the food package is in a switched-on microwave oven.

FIG. 20A

Figure 20A:
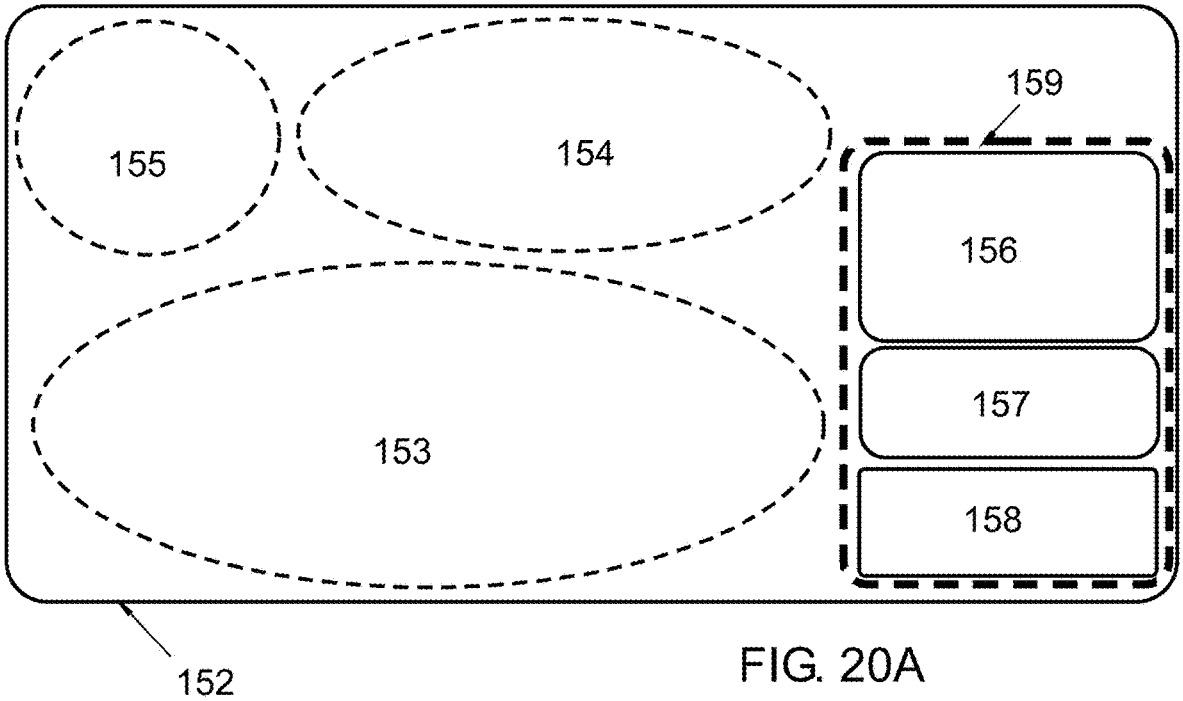
FIG. 20A is a plan view of the layout of the upper level of a food container.

FIG. 20A shows a plan view of one possible layout of different food items on the upper level of a two-level food container or package, to serve as an example to illustrate various uses of the disclosures described in this document.

There are areas or compartments containing a portion of salmon 153, potatoes 154 and peas 155, and there is a sauce ingredients area 159 with sealed compartments containing the ingredients to make, in this particular example, a freshly-made Béarnaise sauce—white wine 156, shallots 157 and fresh herbs 158.

FIG. 20B

Figure 20B:
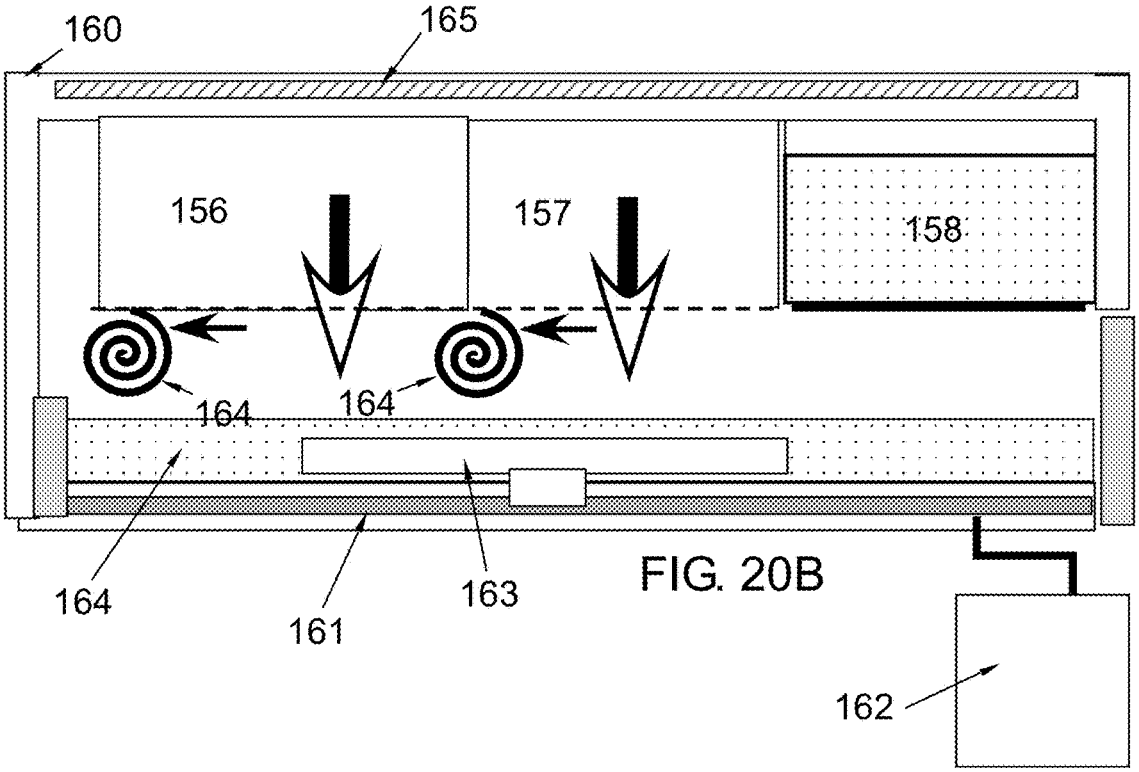
FIG. 20B is a cross-sectional view of a two-level food container, showing different food ingredients being caused by actuators to drop down into a cooking area in the lower level of the container.

FIG. 20B is a schematic cross-sectional view of one possible arrangement of the sauce-making area 159 shown in FIG. 20A, to serve as example of how actuator means—such for example as those novel actuator means introduced in this patent application, in addition to many other existing actuator types well-known to those skilled in the art which could alternatively be used—can be used in a microwave oven to make relatively sophisticated dishes, emulating in many cases the cooking methods used in traditional cooking to produce dishes of higher quality, far closer emulating those produced by a cook using a traditional cooking stove, than can be achieved using existing pre-packaged 'microwave meals'.

In this cross-sectional view of the upper level of the sauce-making area of the food container shown in FIG. 20A, we see in FIG. 20B the containers of white wine, shallots and herbs shown in FIG. 20A.

The white wine 156 and shallots 157 have already been caused to fall from the upper level shown into the lower level 164, due to substrates previously sealing those items in their sealed containers 156, 157 being (in this example) caused to break their seals and to curl up 164 to one side of each of those food compartments.

The lower level of the food container 160 is a cooking area, in which (in this example) the Béarnaise sauce to accompany the salmon 153 in FIG. 20A will be made. While the sauce is being made, the salmon, potatoes and peas on the upper level shown in FIG. 20A will be being cooked using appropriate cooking methods.

At the bottom of the lower level of the food container 160, there is a resistive heating area of material 161, which is powered by, for example, the antenna(s) 165 or (if used) 162 incorporated in any suitable location(s) in the food package or container 152, with said resistive heating means 161 serving to heat and cook the ingredients used to make the sauce.

In this particular example, it might well be that all of the food items and ingredients shown in FIGS. 20A and 20B are shielded against microwaves in the microwave oven—for example, by aluminum foil incorporated in all faces of this food container 160, with said antennas 165, 162 being located outside that microwave-shielding zone of the food package 160.

There is an (optional) stirring means 163 shown, serving to mix the sauce ingredients while they are being cooked, using an actuator means which may be electrically powered by any of said antenna(s) 65, 162.

Container to Dispense Liquids into any Suitable Type of Food Container

As a disclosure applicable to any kind of suitable pre-packaged 'microwave meal' food container to be used in a microwave oven, a container to contain a liquid can be incorporated in any suitable food container designed to be exposed to microwaves in a microwave oven.

Such a container could for example contain water, cooking oil, sauce or other liquids which are used in the preparation or cooking of food—where a means of controllably releasing liquid from said container is provided.

In the case of the container containing cooking oil, for example, the oil could be controllably released by for example means disclosed in reference to FIG. 20B, where a shape-changing substrate is heated by adjacent resistive heating means, powered by one or more antennas, to curl-up 164 or otherwise change shape or other properties, so as to release said liquid.

Cooking oil could thus, for example, be released into a cooking area or container with—for example—resistive heating means under said container, attached to antenna(s), thereby providing a means of frying food provided in, or added to, said container.

The controllable means of releasing such liquid from said container could for example any of the novel types of actuators disclosed in this document, including the 'scrolling up' 164 substrate shown in FIG. 20B—but could also be any other kind of actuator available on the market and well-known to those skilled in the art.

Some types of 'ready meals', for example, request the user of the ready meal to interrupt the microwave cooking of a 'ready meal' at a certain stage, and to add a small amount of water to the food within the ready meal container: such operations can, using the above said means, be automated, using for example control means to release the liquid from said container as are described in this document. The water in this example could for example be sealed within said container until an actuator means serves to break that seal, and to release the liquid, as for example is described and illustrated with reference to the white wine 156 in FIG. 20B.

One different embodiment of the above said inventive idea is that said container of liquid could be made of or incorporate susceptor material-bearing heat-shrinkable polymer which will, when heated to a suitable temperature by any of the means described in this document, heat up and shrink—thereby expelling liquid within said container, and depositing that liquid onto or into, for example, a dish, item or portion of food. Thus, for example, a piquant sauce might be added to shrimps which are being cooked within a 'ready meals' package in a microwave oven by such means. Alternatively, heat-shrinkable polymer adjacent to a container of liquid might be heated and shrunk, to 'squeeze' a flexible container of liquid, so that liquid is expelled from within.

FIG. 21A

Disclosed elsewhere in this document are arrangements whereby a food container located within a switched-on microwave oven can be shielded from microwaves, and electrical power generated by one or more antennas provided outside that microwave-shielded area can be applied to one or more areas of resistive heating material within said microwave-shielded area to heat or cook adjacent food within said microwave-shielded area of said food container—for example, to thereby cook said food without the possible negative effects on the appearance, texture or taste of such food that might occur due to said food being heated by microwaves, due in many cases to the lack of a significant (or perhaps, any) Maillard reaction taking place in food cooked solely by microwaves—and to instead, via resistive heaters, obtain the appearance, texture and taste advantages of cooking the food by non-microwave means.

Two different main disclosures are made below, to provide alternative means to that described above of cooking food using non-microwave cooking methods within a microwave oven, so as, for example, to enable good Maillard reactions to take place within the food due to cooking by non-microwave means—but without the use of antennas to power resistive heaters within a microwave-shielded food package.

An objective of the following disclosures is to provide efficient ways of using susceptor material to heat or cook food in a microwave oven—but where the food to be cooked is shielded from microwaves. That means that susceptor material used to heat or cook the food located within the microwave-shielded area must itself be outside the microwave-shielded area—and thus, the heat generated by the susceptor material in a switched-on microwave oven must pass through the microwave-shielding material.

The problem in so doing is that microwaves in a switched-on microwave oven generate an electrical field in susceptor material—and a microwave-shielding material is likely to be metallic, which if placed immediately adjacent to a susceptor material such as the thin layer of aluminum often used in the food industry as a susceptor material to heat, brown or crisp food surfaces would short out an electrical field penetrating said susceptor material, and incident microwave radiation would be reflected, instead of being conducted through the (e.g.) aluminum foil microwave-shielding material, to reach the food within a microwave-shielding container for the food.

Figure 21A:
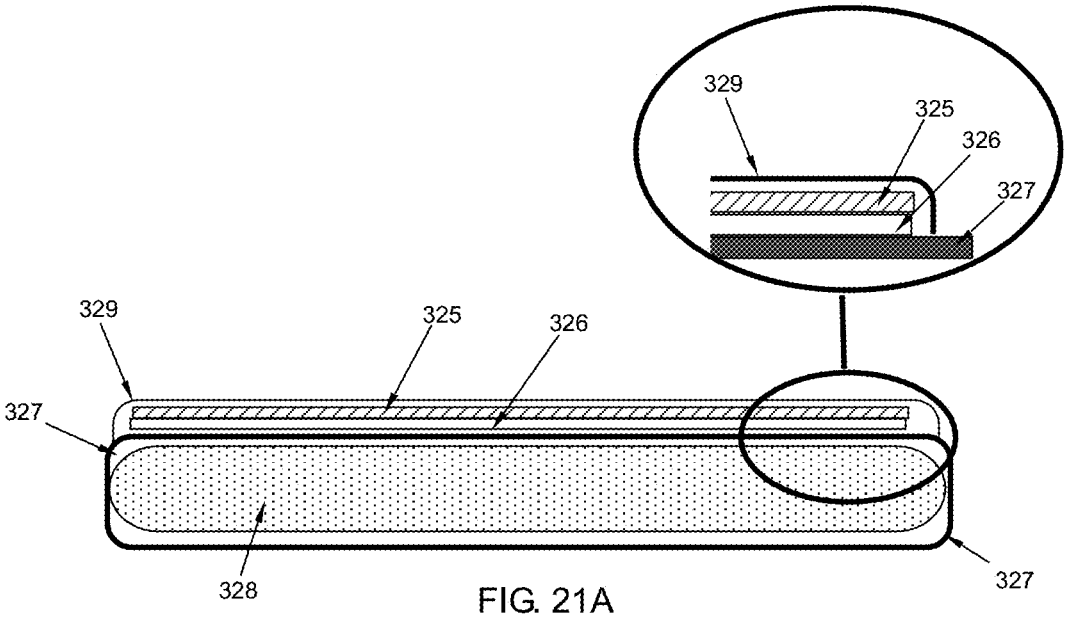
FIG. 21A is a cross-sectional view of a microwave-shielded food container 327 containing food, where heat from susceptor material 325, electrically insulated 326 from the microwave-shielding material 327, is conducted through an (e.g. aluminum) substrate to heat within said container.

One possible approach, shown in FIG. 21A, is to provide an area of electrically insulating material between said susceptor material and the (e.g., aluminum foil) microwave-shielding material surrounding the food product(s).

In FIG. 21A, an area of susceptor material 325 is provided adjacent to an area of electrically insulating (dielectric) material 326, the properties of which are ideally the minimum amount of electrical insulation sufficient to ensure that the electromagnetic field penetrating the susceptor material 325 will not be shorted out by the (e.g., aluminum foil) layer, substrate or area of material 326 which is shielding the food product(s) from microwaves in the switched-on microwave oven.

The properties advantageously required of the microwave-blocking material 327 is that in addition to blocking microwaves, it is also a ideally a very good thermal conductor—two requirements met, for example, by aluminum foil.

The properties advantageously required of the electrically insulating material sandwiched between the microwave-blocking, high thermal conductivity material 327 and the susceptor material 325 is firstly that it provides sufficient electrical insulating properties so that the microwave-blocking, thermally-conductive material 327 will not short out the electric field penetrating said susceptor material due to microwaves; and secondly, that, to the extent possible in the light of cost, non-toxicity and many other considerations, it will minimize heat loss between microwave-heated susceptor material and said microwave-shielding material—e.g., aluminum foil.

Adjacent to said electrically-insulating layer, substrate or area of material 326 is a thermally-conductive microwave-obstructing substrate, layer, or area of material 327 which will advantageously be as highly thermally conductive as is feasible, taking into account cost and other considerations. One example of such a material is aluminum foil.

Material advantageously possessing the above said high thermal conductivity properties will be used to surround or enclose food, thereby providing a microwave-shielded container or enclosure 327 for said food—as shown in FIG. 21.

Optionally, the above said two layers or substrates 325, 326 of material shown outside said microwave-shielded container 327 can be enclosed 329 by any suitable material, which may for example be a polymer material, and may provide a heat-insulating function, so as for example to minimize the loss of heat into the microwave oven cavity, or to help reflect heat generated by said susceptor material towards the (e.g., aluminum foil) substrate or area of material 327. Optionally, a vacuum could be created in the packaging or enclosure 329 shown, to reduce the amount of heat loss into the oven cavity.

One or more food items 328 may advantageously be provided in physical contact with the inner face of said (e.g., aluminum foil) microwave-shielding container 327, so as to obtain a good heat transfer between (e.g.) said aluminum foil 327 and said one or more food items 328 within said microwave-shielded container or food package. Advantageously, means could optionally be provided to press said one or more food items 328 against said (e.g.) aluminum foil 327, to achieve good thermal transfer of heat conducted through said (e.g.) aluminum foil to said one or more food items 328. The arrangements described above, and shown adjacent to the upper, horizontal face of the microwave-shielding enclosure or container 327 in FIG. 21A may advantageously, if desired, be duplicated at the bottom and side faces of that container or package.

Using such arrangements as are described above, a portion of the heat generated due to microwaves in a switched-on microwave oven reaching said susceptor material 325 (e.g., a thin layer of aluminum on PET substrate) will be conducted through said (e.g.) aluminum foil 327 to heat food located within the microwave-shielding container or package 327 shown.

An Alternative Design Approach

However, the heating efficiency of the above said arrangement are not ideal, due to the heat that is lost due to said substrate or area of electrically-insulating material 326 being sandwiched between the heat-generating susceptor material and said thermally conductive microwave-blocking material 327 (e.g., aluminum foil)—assuming that the latter material is electrically conductive.

FIG. 21B

Figure 21B:
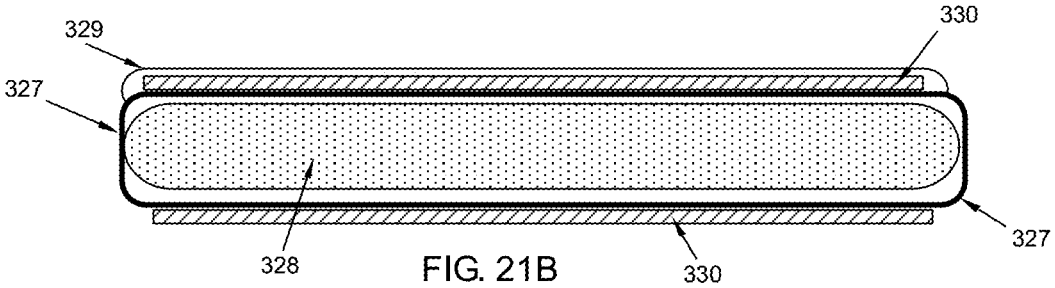
FIG. 21B is a cross-sectional view of a microwave-shielded food container 327, where heat generated in a lossy susceptor material 330 in direct contact with the microwave-shielding (e.g., aluminum foil) food-enclosing material is conducted through said material to heat food within said container.

A different arrangement is proposed below, and shown in FIG. 21B, which aims to avoid the need for an electrically-insulating substrate or layer of material between susceptor material and the microwave-shielding material described above—and thereby, to avoid the heat loss due to that electrically insulating layer or substrate.

In this alternative arrangement, a susceptor material 330, which is a lossy material such as a carbon-based material, which may for example be Carbon Black, is provided directly in contact with a substrate or area of thermally conductive material 327, such as aluminum foil for example, with the thickness of said lossy material being desirably greater than about 5 skin depths at 2.4 GHz.

By this means, with a sufficiently thick layer of said lossy susceptor material applied to, or provided immediately adjacent to, said thermally conductive, microwave-shielding (e.g., aluminum foil) material, the amplitude of the electromagnetic field will have decayed sufficiently at the interface between said lossy susceptor material and said thermally conductive (for example, aluminum foil) material that an electrically conductive microwave-shielding material (e.g., aluminum foil) will not short out the electromagnetic field penetrating the susceptor material.

Thus, microwave radiation is converted into heat by the (e.g.) carbon-based susceptor material—with said heat being conducted through said highly thermally conductive material 326 (e.g., aluminum foil), with which said lossy susceptor material is in direct contact, to heat food within the container formed by said microwave-blocking material (e.g., aluminum foil)—without the need for an insulating layer of material between susceptor material and any electrically conductive microwave-shielding layer or substrate—thereby avoiding the heat loss caused by using an electrically insulating layer of material.

FIG. 21C

Optionally, the arrangements disclosed elsewhere in this document, where one or more antennas are provided outside a microwave-shielded food container, applying electrical power to resistive heaters within the microwave-shielded container, thereby heating or cooking food located within said microwave-shielded container, could be combined with either of the two different design approaches described above, illustrated in FIGS. 21A and 21B, in order to provide additional food-heating means within the microwave-shielded food container.

Figure 21C:
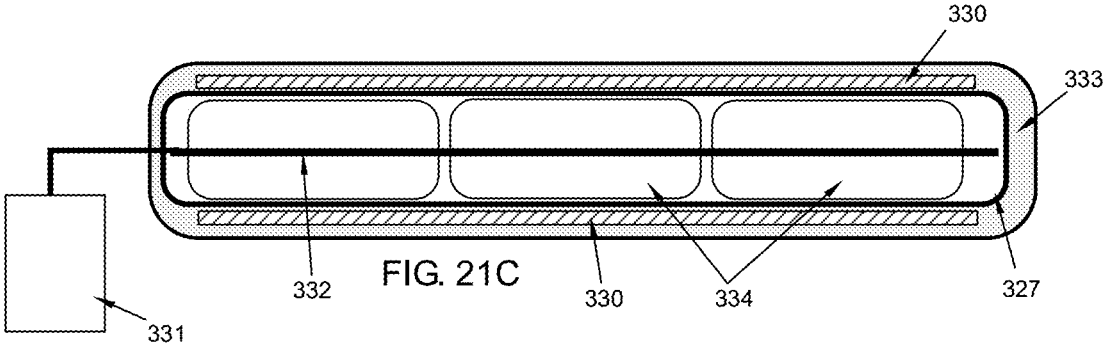
FIG. 21C is a cross-sectional view of a microwave-shielded food container 327 with lossy susceptor material, where antenna(s) 331 apply electrical power to resistive heating means 332 within said container.

In FIG. 21C, three food items 334 are provided within a microwave-shielded container 327 made of or incorporating aluminum foil, for example.

Outside but in direct physical contact with said microwave-shielding material 327 container or food package are shown two areas 330 of lossy susceptor material above and below the food products, which are heated by microwaves, with the heat being conducted through the microwave-shielding material (e.g., aluminum foil) to heat food items within the microwave-shielded container, which may advantageously be in direct contact with the inner faces of said microwave-shielding material. Also shown as an optional design element in FIG. 21C is heat-insulating material 333 surrounding said food container or package.

In FIG. 21C, one or more antennas are provided outside said microwave-shielded container, connected to a resistive heater 332 which in this particular example is located within, or which penetrates, the food items 334 shown. Additional resistive heaters connected to said antenna(s) 331 could optionally be provided elsewhere within said microwave-shielded food container or package 327.

Note that no provision for ventilation has been made in the embodiments shown in FIGS. 21A, B and C: this is simply because the purpose of these drawings is to focus on the inventive elements being explained here.

De-Freezing or Heating Frozen Food in a Microwave Oven

One or more movable substrates incorporating microwave-obstructing material, where said substrate only prevents a portion of microwaves from passing through it to adjacent frozen food, can be provided adjacent to a container of frozen food, to thereby de-freeze or heat that frozen food for a period of time, thereby performing a similar function to a 'de-frost' button on a microwave oven.

Then, after a period of time, using for example any of the actuator means described in this document, and using for example any of the time-delay means explained herein, said one or more substrates can be moved as illustrated in this document, to reduce or remove entirely their obstruction of microwaves reaching said food or in a food container.

Optionally, a plurality of said microwave-obstructing substrates can be provided on top of each other, and thereafter one-by-one removed by actuator means described herein, to thereby progressively increase the intensity of microwaves reaching adjacent frozen or de-freezing food.

Using Microwave-Exposed Susceptor Material to Heat Adjacent Frozen Food

As a different approach to assist in the defrosting or de-freezing of frozen food, a substrate incorporating microwave-exposed susceptor material could be caused by any suitable actuator means to move the substrate to be immediately adjacent to frozen food 13, or to move it away from said frozen food to a location away from frozen food, and thereby to heat said adjacent frozen food by susceptor-generated heat—or to modulate susceptor-generated heating of adjacent frozen food.

Optionally, both of the above types of heating—microwave and susceptor-generated—can be provided adjacent (for example) to the aperture of a food container containing frozen food, and each of the two types of substrate could be for example un-scrolled or lowered from a vertical angle above the food at different times during the de-freezing process.

A different approach to assist in the de-freezing of food located in a food container in a switched-on microwave oven would be to provide within the food container one or more areas of resistive heating material connected to antennas, and optionally within food items.

FIG. 22A

Figure 22A:
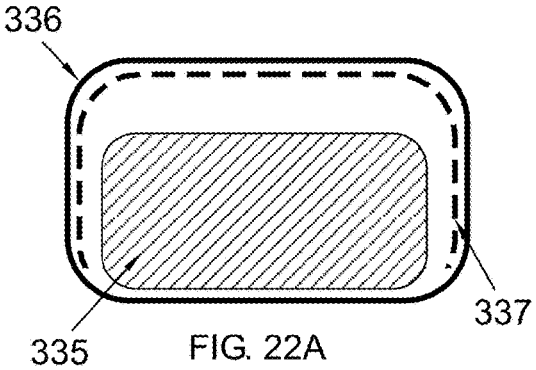
FIG. 22A shows a sleeve packaging with microwave-obstructing substrate within it.

FIG. 22A shows a food product 335 such as a 'Hot Pockets' or similar food product (merely as an example, to show disclosures which are applicable to many types of food package and food products), which may be frozen, and which has an (e.g., paper board) sleeve bearing a distribution of susceptor material (in this example) covering the area of the inner face of said packaging sleeve, which is used in a microwave oven to brown or crisp the exterior food areas.

Attached to the inside of the susceptor material-bearing sleeve 336 (e.g., paper board) substrate, there is a microwave-obstructing substrate 337, which progressively 'curls-up' or 'scrolls up' (or alternatively shrinks, if it incorporates heat-shrinkable material) due to microwave or susceptor-induced heating in the switched-on microwave oven. So, initially, when the microwave oven is switched on, said microwave-obstructing/blocking substrate 337 causes the level of microwaves reaching the food product 335 to be much lower than would have been the case without the microwave-obstructing substrate 337 being present, even though microwaves will still reach part of the food product, due to the sleeve being open at both ends. Then progressively and slowly, the substrate scrolls-up, and the intensity of microwaves reaching the food progressively increases.

In other words, the microwave-obstructing substrate 337 is initially performing a similar function to having the food product be initially cooked in the microwave oven on a 'defrost' or 'low' setting—and thereafter, as the frozen food product progressively melts due to both microwave and susceptor-induced heating, the intensity of microwaves and susceptor-induced heating of the food product increases. In this arrangement, susceptor material in the sleeve 336 would still be being heated by microwaves, even in the initial stage, when the microwave-obstructing substrate 337 occupies the side and top inner faces of the sleeve 336 paper board substrate.

FIG. 22B

Figure 22B:
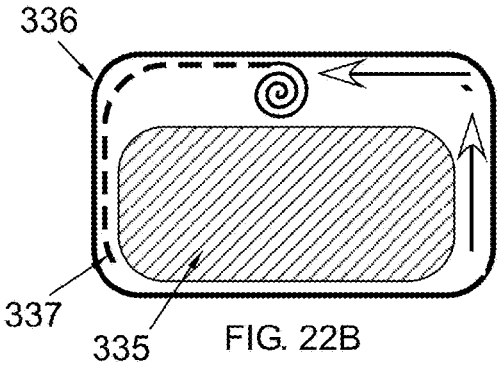
FIG. 22B shows a sleeve packaging where microwave-obstructing substrate is curling-up.

FIG. 22B shows said microwave-obstructing substrate has already 'scrolled-up' over about half its 'scrollable length', thereby exposing the food product to increased intensity of microwave heating than was the case in FIG. 22A. When the scrolling-up operation completes, the intensity of microwaves heating the food product will be similar to the situation if there had been no microwave-obstructing substrate 337 present in the sleeve at all.

FIG. 22C

Figure 22C:
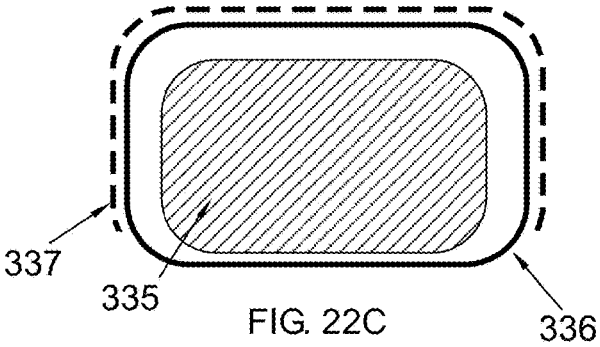
FIG. 22C shows a sleeve packaging where microwave-obstructing substrate is outside the sleeve.
Figure 22D:
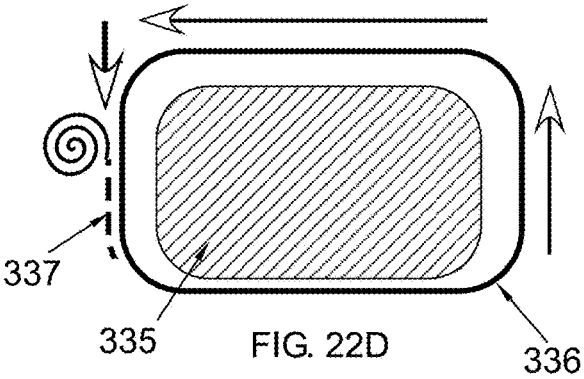
FIG. 22D shows a sleeve packaging where microwave-obstructing substrate has curled up.

In FIG. 22C, said microwave-obstructing substrate 337 is instead attached to the outer face of the 'susceptor wrapper'—thereby not only obstructing microwaves from reaching the food product 335, but also obstructing microwaves from reaching the susceptor material in the 'wrapper' substrate 336. Thus, in this arrangement, (a) there would be little or no heating of the microwave-obstructing substrate by susceptor material in the 'wrapper' 336 substrate, and susceptor heating of the food product 335 would be very low, or zero.

FIG. 22D

In FIG. 22 D, the microwave-obstructing substrate has scrolled-up over most of its area, thereby exposing both the food product 335 and the susceptor material in the sleeve 336 to microwaves.

FIG. 22E

Figure 22E:
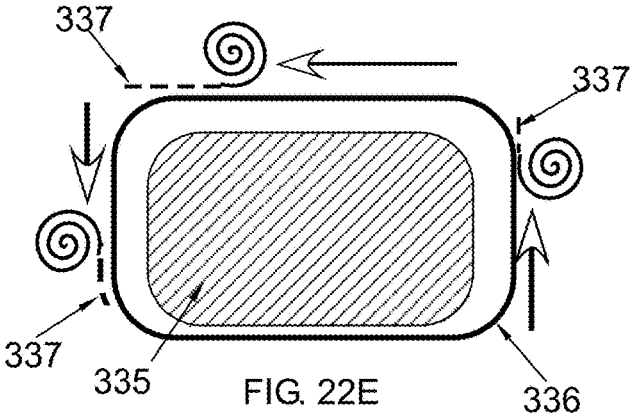
FIG. 22E shows a sleeve packaging where three separate microwave-obstructing substrates are curling up on three different sides of the sleeve, thereby increasing microwave intensity in the food product.

FIG. 22E shows an alternative embodiment, where instead of using a single microwave-obstructing substrate, three such substrates are used, one for each of the side and top faces of the 'susceptor wrapper'—thereby, for example, making the progressively increased exposure of the food product 22E to microwaves more evenly distributed.

The 'scrolling up' substrates shown in the above drawings could alternatively have changed their shape, dimensions, locations or other properties in many alternative ways, as are exampled by many different examples and actuator type examples provided in this document. The substrate(s) might instead have 'lifted up', or have been made of or incorporated heat-shrinkable material, for example—in the latter case, causing the microwave-obstructing substrate to be heated up and to shrink in its area, but the inventive principle would remain the same: the extent of the obstruction of microwaves reaching the food product 335 is being progressively reduced over time in a switched-on microwave oven.

It should be noted that the degree or extent to which said microwave-obstructing substrate(s) block microwaves from passing through said substrate could be configured as desired—but in many cases, said substrate would only block a portion of microwaves from passing through it, thereby allowing a relatively low level of microwaves to reach the adjacent food, compared with if that substrate had not been present.

Thus, one useful purpose is provided in the above said examples, in the case of the food product 335 being initially frozen: the food product is initially heated by microwaves to a relatively low extent—and the microwave heating is progressively increased. This would assist, for example, in giving more time for microwave-induced heating of food on the outer areas of the food product 335 to be conducted towards the inner areas of the food product to defrost (for example) those inner areas of the food product 335, while reducing the likelihood of the exterior areas of the food product being over-cooked, or over-heated, while leaving the inner areas of the food product insufficient heated or cooked. While this type of arrangement has the above said useful functions if the food product 335 is frozen, it also has usefulness for non-frozen food products, where the object is, for example, in the more even heating or cooking of outer and inner areas of a food product.

It should be noted that the 'scrolling-up' of the substrate 337 shown in these drawings could instead have been reversed in direction, so that it, for example, 'un-scrolled', using for example the heating of one or more cavities within said substrate illustrated in FIGS. 12A and 12B, or other novel actuator types described or implied in this document—or of course using many other alternative actuator means on the market, well-known to those skilled in the art.

It should also be noted that the (e.g.) shape-changing substrate 337 could alternatively itself incorporate a distribution of susceptor material over all, or a portion of, its area. Thus for example taking FIG. 22E as an example, optionally, the susceptor material in the sleeve substrate 336 might be removed from the arrangement shown. This would cause the moving substrate-adjacent food product 335 to be first heated by susceptor material in said movable substrate, and then for that susceptor-heating effect to be progressively reduced with time, as said substrate progressively (e.g.)

curled up as shown. Or it might be that for example a section or element within a food product—say, the upper face of the food product 335 shown here—required susceptor heating for a period of the time in the switched-on microwave oven—but not for the entirety of the time that the food product was in the oven. In such a case, the two other movable substrates on the side of the food container or enclosure shown might be removed from the design shown.

It should be emphasized that the innovative design principles explained above, and illustrated in the above-named drawings, can be applied to a very wide range of different types of food packaging—and the 'Hot Pockets'-type of food product and packaging is only cited as an example to illustrate the ideas being disclosed here.

A good number of different novel actuator types are disclosed in this document which could perform the 'scrolling up' or 'un-scrolling' function of a substrate described—and there are almost innumerable other existing materials or actuator arrangements well-known to those skilled in the art which could alternatively perform the functions described above—which would include, for example, a substrate materials which would naturally 'curl up' when heated, which could for example incorporate or have provided adjacent to them susceptor material if so required to provide the microwave-heating of that substrate material. There are adhesive materials, for example, which could be used to attach a such a substrate as is described above to the different faces of the 'wrapper' illustrated and described above, which would be progressively de-bonded due to heating in the microwave oven. If the substrate were not made of or incorporating material causing the substrate to naturally 'scroll up' or 'curl up' due to heating when released (for example) from heating-induced de-bonding adhesive to do so, such substrates could alternatively be tensioned for example with an 'at rest' state or shape of being curled-up, or otherwise to be configured so that when in said 'at rest' state, the substrate would (for example) obstruct microwaves to a much reduced extent from reaching the food product 335. Innumerable possible designs of shape-changing bi-material substrates are available, including those disclosed in this document—with different coefficients of thermal expansion properties, for example, as described in this document—which would cause the substrate to progressively bend or curl up, or otherwise to change properties so as to progressively (for example) obstruct fewer microwaves from reaching an adjacent food product 335. One or more lengths of a heat-shrinkable polymer substrate bonded to a microwave-obstructing material such as aluminum foil, for example, would curl up as shown in these drawings, for example, thereby progressively obstructing fewer and fewer microwaves reaching said sleeve material 336.

The Heat-Induced Expansion of the Air in One or More Closed Cells or Cavities, to Serve as an Actuator to Increase Tension in, on or Across Susceptor Material-Bearing Substrates.

A problem with microwave-heating susceptor material used in food packaging relates to the distance between susceptor material and the outer surfaces of the food that the microwave-exposed susceptor material is to heat, toast, 'grill' or cook In most applications, susceptor material needs to be either in physical contact with the outer surfaces of food, or to be at the least very close—for example, some food packaging companies say 'within 3 mm'—to the food. Apart from the fact that some food shrinks when it cooks—thus tending to move the food surfaces away from susceptor material—susceptor material in food packages is often not the ideal distance away from food.

Some susceptor film or susceptor packaging material manufacturers use polymer materials which 'cling' to the food when heated in a microwaves, thereby obtaining good thermal contact and heat transfer to the food—but this can result in an unattractive 'cling film' like appearance of the susceptor film, which can be crinkly, and not aesthetically pleasing.

One group of disclosures here relate to using the heating-induced expansion of air in one or more sealed cavities or 'cells' to act as an actuator means which, when the 'bubble' expands due to heating, it thereby increases the tension on the susceptor-bearing material, bringing the susceptor material to the desired distance from the food.

FIG. 23A

Figure 23A:
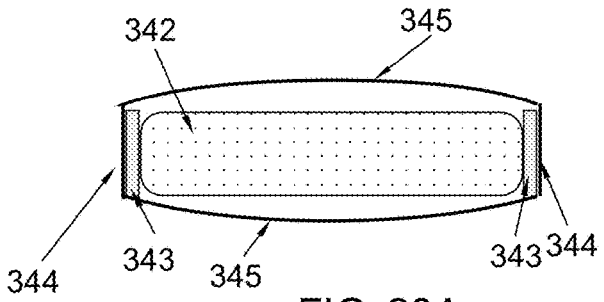
FIG. 23A illustrates a food product with a susceptor-bearing wrapper or packaging substrate 345 around the food, and two small rigid substrates at either end of the product, with a sealed cell adjacent incorporating susceptor material adjacent to and outside each of said substrates.

FIG. 23A illustrates a food product with two rigid or semi-rigid substrates 343 (e.g., paper board) provided at either end of the food item. Surrounding both the food item and said substrates ('the wrapper substrate') is a flexible (e.g., polymer) substrate 345 bearing a distribution of susceptor material over at least a portion of its area, but in most embodiments, at least over most of the area of the food product. The 'food wrapper substrate' 345, which is not stretchable in most possible configurations, is relatively loose in respect of the adjacent upper and lower faces of the food product in FIG. 23A—and thus, there is a certain distance between susceptor material in those areas, and the outer surfaces of the food product.

Incorporated in said 'wrapper substrate' 345 enveloping the above items are two sealed cavities 344 provided, in this particular example, immediately adjacent to the outer faces of the two (e.g., paperboard) said substrates 343 at either end of the food product.

Said sealed cells or cavities 344 could for example be formed by the bonding of said (e.g. polymer) 'food wrapper substrate' and a further small area of (e.g., polymer) substrate. Susceptor material could be provided in or adjacent to said sealed cells 344—for example, on one of the two substrates forming said sealed cells, or for example on said food wrapper substrate 345 in areas immediately adjacent to said two sealed cells 344.

FIG. 23B

Figure 23B:
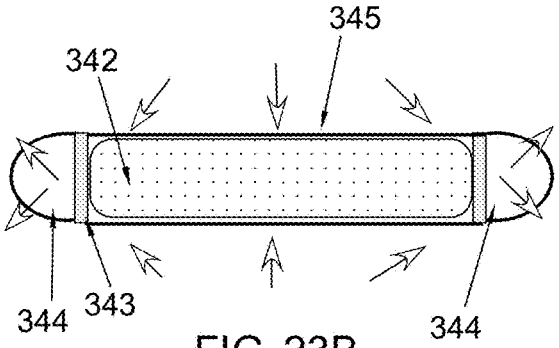
FIG. 23B shows how the sealed cells have inflated due to heating, thereby pulling taut the food wrapper substrate between said two substrates, thereby achieving the desired distance between susceptor material on said wrapper and the outer surfaces of the food product.

When the microwave oven within which the food container shown in FIG. 23A is located is switched on, the susceptor material in or adjacent to said two sealed cells heats the air inside the sealed cells—which then inflate. They press on one side of each sealed cell against the adjacent rigid or semi-rigid (e.g., paper board) substrates 343, and push outwards as they inflate in the opposite direction—outwards, and away from the food product, thereby tightening the food wrapper around the food product as the food wrapper substrate seeks to accommodate the increased volume which it is enclosing by spreading and tightening. The sealed cells might in reality be significantly larger than shown in FIG. 23B, depending on many variables including for example how great the largest possible distance could be between and the susceptor-bearing food wrapper and the sides of the food product, before the microwave oven is switched on.

The inflation of the two sealed cells causes the food wrapper substrate 345 to be tensioned and flattened in profile, as the food wrapper substrate is tensioned to accommodate the increased volume for the wrapper substrate to encompass, as a result of the inflated said two sealed cells'—thereby pulling the areas of the food wrapper substrate closer to the outer (top and bottom) surfaces of the food item.

Since in this example, the (e.g., paper board) two substrates 343 are provided at either end of the food product, the 'tightening' or increased tension in the food wrapper substrate causes the food wrapper substrate to bring the susceptor material on that substrate to a fixed distance from the outer surfaces of the food, dictated for example by the dimensions of the two rigid substrates 343—which could for example have been chosen to provide the ideal distance between the susceptor-bearing food wrapper and the sides of the food product.

If said two rigid or semi-rigid substrates 343 at either end of the food product were not provided in this arrangement, then with suitable configuration of the area of the food wrapper and the post-inflation size of the inflated sealed cells, a relatively predictable distance could be provided between susceptor material in the food wrapper substrate and the outer surfaces of food. This would arguably be particularly true if the two inflated' bubbles 344 were bigger than shown in this drawing, so that their dimensions could for example be used to determine the distance of susceptor material in the wrapper from the food outer surfaces after said sealed cells inflated.

It should be emphasized that—as is the case with all drawings in this document—this drawing is not to scale, but is instead only intended to illustrate the inventive principles being disclosed here. The inflated 'bubbles' 344 at either end of the food product, for example, might be substantially bigger in relation to the size of the food product that is shown in these drawings.

FIG. 23C

Figure 23C:
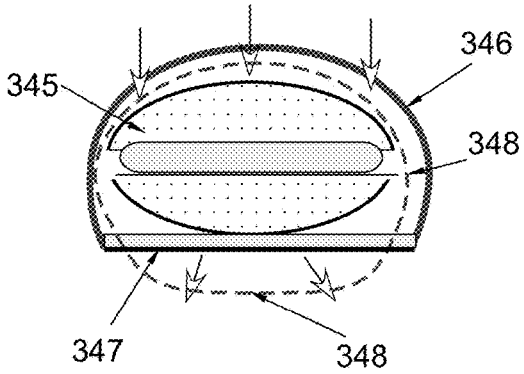
FIG. 23C shows where one or more sealed cells with adjacent susceptor material located beneath a base substrate 347 expand due to heating, thereby pulling the susceptor material-bearing wrapper substrate 346 tighter around the food product, to be the desired distance from the outer surfaces of the food product.

FIG. 23C shows a different embodiment using the novel design principles as above, where the heat-induced inflation of sealed cavities or cells causes a substrate bearing a distribution of susceptor material to be drawn closer to a food product—and where the desired distance between susceptor material and the outer surfaces of food can be quite accurately thereby achieved.

In this drawing, which is not to scale, there is a food item 345 such as a baguette or perhaps a hamburger enclosed by a 'wrapper substrate' 346 incorporating a distribution of susceptor material. There is a 'base' substrate 347 or area of material preferably incorporating a distribution of susceptor material, upon which base the food product 345 is resting.

In this particular embodiment of the invention, said susceptor material-bearing substrate 346 extends underneath said 'base' substrate 347, encompassing it, and at least one sealed cavity or cell is created immediately underneath the 'base' substrate 347—which could for example be achieved by bonding the 'wrapper substrate' 346 to the underside of the 'base substrate' 347.

When susceptor material provided in or adjacent to said one or more sealed cells thereby created under said 'base' substrate 347 are heated by microwaves, the sealed cell(s) inflate 348, thereby causing the (preferably non-stretchable) 'wrapper substrate' 346 surrounding the food product and the base substrate to be drawn inwards towards the outer surfaces of the food product—as exampled by the dotted line 348, showing one possible shape and location of different points along the food wrapper 346 profile after the inflation of said sealed cell(s).

If the base substrate 347 is flexible, and if it, and the inflated cell(s) underneath it, have suitable design and properties, it will become curved upwards due to the inflation of said one or more sealed cells—thereby providing the means of moving any distribution of susceptor material provided across the area of said base substrate to be the desired distance from adjacent food surfaces, after the inflation of said sealed cell(s).

If the base substrate is flexible, both the base substrate and the wrapper substrate 346 can be caused, due to the heat-induced inflation of said sealed cell(s) under the base substrate, to be drawn closer to the bottom half of the food product 345. The dotted line 348 suggests one possible profile and location of different points along the food wrapper 346 after the sealed cells under the base substrate 347 inflate—but if the base substrate 347 is sufficiently flexible over a big enough portion of its area, then the dotted 'post-inflation' line 348 of the food wrapper's shape and location(s) adjacent to the bottom half of the food product 345 shown could be caused to become much closer to the outer surfaces of the food item 345 than shown in this drawing. Basically, by Optionally, for example, the base substrate may have a central portion of its area which is rigid or relatively rigid, thereby causing it to not bend, or to be less flexible, in that more rigid area, thereby making the food product 347 more stable, and less likely to tilt or topple to one side due to the inflation of said one or more sealed cells under the base substrate. The area of the rigid (or relatively rigid) area of the base substrate can also serve to help determine the profile shape of the wrapper substrate when said sealed cell(s) inflate, and to determine the distances between the wrapper substrate 346 and the food product's outer surfaces at different points over the area of said wrapper substrate 346 in that inflated state of said sealed cell(s).

Thus, the dimensions and other properties of the 'base substrate' 347, together with the dimensions of the post-inflation sealed cells(s), can be used to determine the 'post-inflation' distance between the susceptor-bearing wrapper substrate 346 and the outer surfaces of the food product at different points over the area of the wrapper substrate 346—and in addition, to help determine the 'post-inflation' distance between the (preferably susceptor-bearing) base substrate 347 and adjacent outer surfaces of the food product. Thus, the base substrate 347 is essentially in that regard performing a similar role to the (e.g., paperboard) substrates 343 in FIG. 23A.

What is claimed is:

1. A microwavable food container comprising:

at least one microwave-obstructing movable object; and two or more food compartments each comprising at least one portion of food or at least one item of food;

where, during the time that the microwavable food container is in a switched-on microwave oven, at least one actuator-induced change in the location, angle, shape, dimensions or other property or properties of the at least one microwave-obstructing movable object serves to vary the microwave power or microwave power density reaching the at least one portion of food or the at least one item of food within at least one of the two or more food compartments, thereby heating, by microwaves, the at least one portion of food or the at least one item of food within the two or more food compartments for different controllable portions of the time that the microwavable food container is in the switched-on microwave oven.

2. The microwavable food container of claim 1, where at least some portion of at least one said movable object is located adjacent to at least some portion of an aperture provided in said food container, or in at least one said food compartment.

3. The microwavable food container of claim 1, where at least some portion of at least one said movable object is located adjacent to at least some portion of at least one aperture provided in at least one of the two or more food compartments; and where said change in the location, angle, shape, dimensions or other properties of said at least one movable object serves to vary the microwave power or microwave power density of microwave radiation which passes through the at least one aperture provided in at least one of the two or more food compartments to thereby vary the heating effect of microwave radiation on the at least one item or portion of food provided in at least one of the two or more food compartments.

4. The microwavable food container of claim 1, where said change in the location, angle, shape, dimensions or other properties of at least one said movable object serves to vary the microwave-shielding effect of said at least one movable object on at least one portion, area or item of food provided in said food container or said at least one food compartment during the time that said food container is located in a switched-on microwave oven, thereby serving to vary the microwave power or microwave power density reaching said at least one portion, area or item of food provided in at least one of the two or more food compartments.

5. The microwavable food container of claim 1, where said food container or at least one of the two or more food compartments incorporates microwave-obstructing material to shield food within said food container or said at least one food compartment against microwaves, except where one or more apertures are provided in said food container or at least one of the two or more food compartments; and where said change in the location, angle, shape, dimensions or other properties of at least one said movable object serves to controllably change the proportion of the area of at least one said aperture provided in said food container or at least one of the two or more food compartments which is occupied by, covered by or shielded against microwaves by said at least one movable object, thereby controllably varying the microwave power or microwave power density reaching at least one item or portion of food provided within at least one of the two or more food compartments.

6. The food container of claim 1, where said food container further incorporates one or more antennas;

where at least one said movable object is provided adjacent to said one or more antennas; and where said at least one actuator-induced change in the location, angle, shape, dimensions or other properties of at least one said movable object serves to vary the microwave power or microwave power density reaching said one or more antennas, thereby varying the amplitude of electrical power generated by said one or more antennas.

7. The food container of claim 1, where said change in the location, angle, shape, dimensions or other properties of said at least one movable object is caused by the controlled release of at least one pre-stressed, stressed or tensioned area of material, or device or item provided in said food container.

8. A food container comprising:

at least one microwave-obstructing movable object; and;

two or more food compartments;

where, during the time that the microwavable food container is in a switched-on microwave oven, at least one actuator-induced change in the location, angle, shape, dimensions or other property or properties of the at least one microwave-obstructing movable object serves to vary the microwave power or microwave power density reaching one or more portions of food or one or more items of food within at least two of the two or more food compartments of the microwavable food container;

where at least some portion of the at least one microwave-obstructing movable object is adjacent to at least one aperture in each of at least two of said two or more food compartments; and where said change in the location, angle, shape, dimension, dimensions or other property or properties of the at least one microwave-obstructing movable object serves to separately and controllably vary the microwave power or microwave power density reaching the one or more portions of food or the one or more items of food within at least two of the two or more food compartments.

9. A microwavable food container comprising:

at least one microwave-obstructing movable object; and one or more areas of susceptor material adjacent to at least one portion of food or at least one item of food within the microwavable food container;

where, when the microwavable food container is in a switched-on microwave oven, at least one actuator-induced change in the location, angle, shape, dimensions or other property or properties of the at least one microwave-obstructing movable object serves to vary the microwave power or microwave power density reaching the susceptor material, which thereby serves to vary the intensity of microwave-induced heat generated in the susceptor material which reaches the at least one portion of food or the at least one item of food within the microwavable food container.

10. The food container of claim 1, further incorporating one or more areas of susceptor material, where said one or more areas of susceptor material is incorporated in, or adjacent to, heat-shrinkable polymer material provided in said food container; and where said change in the location, angle, shape, dimensions or other properties of said at least one microwave-obstructing movable object serving to vary the microwave power or microwave power density reaching said susceptor material causes said heat-shrinkable polymer material to heat up and shrink, and to serve as an actuator.

11. A microwavable food container which incorporates at least one movable object incorporating a distribution of susceptor material; and where actuator-induced change in the location, angle, shape, dimensions or other properties of at least one said movable object which takes place during the time that said food container is located in a switched-on microwave oven serves to vary the intensity of microwave-induced heat generated in at least one said movable object which reaches at least one item or portion of food provided in said food container.

12. The food container of claim 11, where said food container may be a stand-alone receptacle without compartments, or may be a food compartment provided within a larger food receptacle;

and where said change in the location, angle, shape, dimensions or other properties of at least one said movable object serves to change the distance between at least one microwave-exposed said movable object and at least one portion, area or item of food provided in said food container or said food compartment, thereby varying the intensity of the heat generated in said movable object by microwaves which reaches said at least one portion, area or item of food.

13. The food container or said food compartment of claim 12, where at least some portion of said at least one movable object is located adjacent to at least some portion of at least one aperture provided in said food container or said food compartment.

14. The food container or said food compartment of claim 12, where at least one said movable object grills or heats at least one item, area or portion of food provided in said food container or said food compartment for some portion of the period of time during which said food container is located in a switched-on microwave oven;

and where for some other portion of said period of time, due to sufficient distance between said movable object and said at least one item, area or portion of food, said at least one movable object has no significant heating effect on the same said item, area or portion of food.

15. The food container of claim 11, or at least one food compartment provided within said food container, where said actuator-induced change in the location, angle, shape, dimensions or other properties of said at least one movable object serves to cause at least one item or portion of food provided in said food container or in at least one said food compartment to change from one of the following two modes of operations, to the other:

(1) where said at least one item or portion of food is primarily heated by microwave radiation;

(2) where said at least one item or portion of food is primarily grilled or heated by heat generated in at least one microwave-exposed said movable object.

* * * * *